US006429603B1

(12) United States Patent
Tsugita et al.

(10) Patent No.: US 6,429,603 B1
(45) Date of Patent: Aug. 6, 2002

(54) DISCHARGE LAMP LIGHTING APPARATUS

(75) Inventors: Kazuhiko Tsugita; Kouji Shibata; Tetsuya Kobayashi; Isamu Ogawa; Kenji Hamazaki; Hiroaki Nishikawa; Naoki Wada; Osamu Ishikawa; Moriaki Okuda; Yasunori Ieki, all of Kamakura (JP)

(73) Assignees: Mitsubishi Denki Kabushiki Kaisha, Tokyo; Mitsubishi Electric Lighting Corporation, Kanagawa, both of (JP)

( * ) Notice: Subject to any disclaimer, the term of this patent is extended or adjusted under 35 U.S.C. 154(b) by 0 days.

(21) Appl. No.: 09/559,174

(22) Filed: Apr. 27, 2000

(30) Foreign Application Priority Data

Apr. 28, 1999 (JP) ..... 11-120888
Mar. 30, 2000 (JP) ..... 12-093070

(51) Int. Cl.[7] ..... H05B 37/02

(52) U.S. Cl. ..... 315/224; 315/244; 315/209 R; 315/308; 315/DIG. 4; 315/DIG. 7

(58) Field of Search ..... 315/224, 225, 315/209 R, 209 CD, 209 T, 291, 307, 308, 244, DIG. 4, DIG. 7

(56) References Cited

U.S. PATENT DOCUMENTS 5,355,055 A * 10/1994 Tary ..... 315/209 R
5,410,221 A * 4/1995 Mattas et al. ..... 315/307
5,589,742 A * 12/1996 Ueda ..... 315/307
5,850,127 A * 12/1998 Zhu et al. ..... 315/307
5,883,473 A * 3/1999 Li et al. ..... 315/225
5,910,713 A * 6/1999 Nishi et al. ..... 315/308
6,008,590 A * 12/1999 Giannopoulos et al. . 315/209 R
6,011,358 A * 1/2000 Knobloch et al. ..... 315/224

FOREIGN PATENT DOCUMENTS

JP A10134972 5/1998

* cited by examiner

*Primary Examiner*—Haissa Philogene

(57) ABSTRACT

The discharge lamp lighting apparatus includes: a direct current power supply E; switching elements Q1 and Q2 for switching a direct current supplied from the direct current power supply E so as to generate a high frequency current; a discharge lamp load circuit LAC1 which is constructed in a manner that a discharge lamp LA and a coupling capacitor C4 are connected in series, and the discharge lamp LA is lit by a high frequency current generated by the switching elements Q1 and Q2; a switching element control circuit IC1 for controlling the switching elements Q1 and Q2. The discharge lamp lighting apparatus is further provided with a protective circuit NP2 which distinguishes a fault of the discharge lamp LA by detecting a voltage generated in the coupling capacitor C4, and outputs a control signal to the switching element control circuit IC1.

18 Claims, 35 Drawing Sheets

FIG. 8

| load state / potential | | fully normal lighting | Rectification lighting 1 | Rectification lighting 2 | no lighting no load |
|---|---|---|---|---|---|
| Direct current potential(V) of first embodiment | point "A" | 220 | 290 | 150 | 0 |
| | point "B" | 7 | 9.4 | 4.8 | 0 |

| load state / potential | | fully normal lighting | Rectification lighting 1 | Rectification lighting 2 | no lighting no load | Reduced lumen normal lighting |
|---|---|---|---|---|---|---|
| Direct current potential(V) of first embodiment | point "A" | 220 | 290 | 150 | 0 | 215 |
| | point "B" | 7 | 9.4 | 4.8 | 0 | 7 |
| Direct current potential(V) of second embodiment | point "A" | 220 | 290 | 150 | 0 | 218 |
| | point "B" | 7 | 14 | 0 | 0 | 7 |

FIG. 14

DISCHARGE LAMP LIGHTING APPARATUS

BACKGROUND OF THE INVENTION

1. Field of the Invention

The present invention relates to a discharge lamp lighting apparatus which lights a discharge lamp by a high frequency current generated by a switching element.

2. Prior Art

FIG. 34 is a circuit diagram showing a construction of a conventional discharge lamp lighting apparatus. In FIG. 34, a reference symbol IV denotes an inverter circuit which is connected to a direct current power supply E, and switches a direct current of the direct current power supply E so that the direct current is converted into a high frequency current, an LAC1 denotes a discharge lamp load circuit for lighting a discharge lamp LA by a high frequency current generated by the inverter circuit IV, and an NP1 denotes a protective circuit which detects a fault of the discharge lamp load circuit LAC1, and outputs a control signal for stopping an operation of the inverter circuit IV.

The following is a detailed description on each of the above circuits.

The inverter circuit IV includes a starting circuit, a pair of MOS-FETs Q1 and Q2 (hereinafter, referred to as switching element Q1 and Q2), an inverter control circuit IC1 (hereinafter, referred to as IV control circuit IC1), and a frequency control circuit FC1. More specifically, the starting circuit is constructed in a manner that a starting resistor R1 and a control power supply capacitor C1 are connected in series and a constant voltage diode DZ1 is connected in parallel with the control power supply capacitor C1. The pair of switching elements Q1 and Q2 are connected in series between both electrodes of the direct current power supply E. The inverter control circuit IC1 controls the switching elements Q1 and Q2. The frequency control circuit FC1 sets a switching frequency of the switching elements Q1 and Q2 via the IV control circuit IC1. The IV control circuit IC1 has terminals; more specifically, a power supply terminal 1 (hereinafter, referred to as terminal 1) is connected to the control power supply capacitor C1, output terminals 2, 3 and 4 (hereinafter, referred to as terminals 2, 3 and 4) are connected to the switching elements Q1 and Q2, and oscillation control terminals 6 and 7 (hereinafter, referred to as terminals 6 and 7) are connected to the frequency control circuit FC1. Moreover, the frequency control circuit FC1 is composed of a main oscillation resistor R2 and an oscillation capacitor C2 which are connected between a negative electrode of the direct current power supply E and the terminals 6 and 7 of the IV control circuit IC1, respectively. In this manner, the IV control circuit IC1 oscillates at a frequency f=K* (current flowing from the terminal 6 of the IV control circuit, which has a constant direct current potential) with respect to a constant K determined by a capacitance of the oscillation capacitor C2, and thereby, the switching elements Q1 and Q2 make a switching operation at the frequency f.

Next, the following is a description on the discharge lamp load circuit LAC1.

As shown in FIG. 34, the discharge lamp load circuit LAC1 is composed of a ballast chock T1, a discharge lamp LA having electrodes F1 and F2, and a coupling capacitor C4 which are connected in series between both terminals of the switching element Q2, and further of a starting capacitor C3 connected in parallel with the discharge lamp LA.

On the other hand, the protective circuit NP1 is so constructed that the protective circuit NP1 detects a peak-to-peak voltage (Vmax−Vmin) of a waveform of high frequency voltage between the electrode F1 side terminal of the ballast chock T1 and a negative electrode of the direct current power supply E by detection capacitors C5 and C6 connected to the discharge lamp load circuit LAC1, diodes D1 and D2 and a capacitor C7. Then, when a direct current voltage generated in both terminals of the capacitor C7 exceeds a Zener voltage of a constant voltage diode DZ2, the protective circuit NP1 outputs a signal to an oscillation stop terminal 5 (hereinafter, referred to as terminal 5) of the IV control circuit IC1 connected to the protective circuit NP1 so that a switching operation of the switching elements Q1 and Q2 is stopped. In this case, when the discharge lamp LA is normally lighting, the direct current voltage of the capacitor C7 is set so as to become lower than a Zener voltage of the constant voltage diode DZ2. Therefor, the protective circuit NP1 is not operated. Moreover, a resistor R4 is used for discharging a charge stored in the capacitor C7 when a power supply is turned off, and a resistor R16 and a capacitor C11 divide and control a voltage inputted to the terminal 5, and smooth an external high frequency noise, to prevent a malfunction of the IV control circuit IC1.

Next, the following is a description on an operation of a conventional discharge lamp lighting apparatus.

The discharge lamp is started up, and then, when a current is supplied to the inverter circuit IV from the direct current power supply E, the control power supply capacitor C1 is charged by a starting current flowing through the starting resistor R1 from the direct current power supply E. When a voltage of the terminal 1 of the IV control circuit IC reaches a predetermined operating voltage, the IV control circuit IC1 oscillates at a frequency f determined by the frequency control circuit FC1 so that a high frequency signal is outputted to the switching elements Q1 and Q2 from its terminals 2 and 4. Then, the switching elements Q1 and Q2 are alternately turned on and off, and thereby, a high frequency current is supplied to the discharge lamp load circuit LAC1. By the high frequency current, a series circuit comprising the ballast chock T1 and the starting capacitor C3 (for the coupling capacitor C4 is designed so as to have a capacitance several times as much as that of the starting capacitor C3, the coupling capacitor C4 has no influence on the following resonance phenomenon) generates an LC resonance. Subsequently, a high voltage is generated in the starting capacitor C3, that is, between both terminals of the discharge lamp LA. Thus, the discharge lamp LA is started, and continues to light at a frequency f. In this case, the control power supply capacitor C1 is connected in parallel with the constant voltage diode DZ1, so that a voltage applied to the terminals 1 of the IV control circuit IC1 is limited by a Zener voltage of the constant voltage diode DZ1.

Next, the following is a description on an operation of a conventional protective circuit NP1.

When the discharge lamp LA is lighting, a high frequency voltage as shown in FIG. 35 is generated between the electrode F1 side terminal of the ballast chock T1 and a negative electrode of the direct current power supply E. The high frequency voltage is generated so as to be overlapped with a constant direct current voltage. In the protective circuit NP1, a peak-to-peak voltage (Vmax—Vmin) is detected by the detection capacitors C5 and C6 and the diodes D1 and D2 which are connected between the ballast chock T1 and the direct current power supply E, and further, is converted into a direct current voltage by the capacitor C7, and thus, is inputted to the constant voltage diode DZ2. In this case, when the discharge lamp LA is normally lighting, the direct current voltage of the capacitor C7 is set so as to become less than a Zener voltage of the constant voltage diode DZ2; therefore, no oscillation stop signal is outputted to the IV control circuit IC1 from the protective circuit NP1.

However, for example, in the case where the discharge lamp LA is rectified and lighting in the end of its file, a high frequency lamp voltage of the discharge lamp LA rises up; for this reason, a voltage of the capacitor C7 becomes higher than the Zener voltage of the constant voltage diode DZ2. Whereupon the protective circuit NP1 outputs an oscillation stop signal to the terminal 5 of the IV control circuit IC1, and further, by the oscillation stop of the IV control circuit IC1, a switching operation of the switching elements Q1 and Q2 is also stopped. As a result, that prevents the switching elements Q1 and Q2 from being abnormally exothermic, and a temperature in the vicinity of the electrodes F1 and F2 of the discharge lamp LA from becoming abnormally high to break down the discharge lamp LA. In this case, the oscillation stop state of the IV control circuit IC1 is reset at the time when a voltage of the control power supply capacitor C1 becomes less than a predetermined voltage, and an oscillation is started at the time when a voltage of the control power supply capacitor C1 becomes more than the predetermined voltage.

Moreover, in the case where a high resonance voltage is generated in the starting capacitor C3, a large current flows through the ballast chock T1 and the starting capacitor C3. Therefore, in the case where the discharge lamp LA is not lighting because of being defective or in the end of life, a voltage between terminals of the starting capacitor C3 is continuously kept abnormally high, and a direct current voltage of the capacitor C7 becomes higher than a Zener voltage of the constant voltage diode DZ2. Thus, in the same manner as described above, the protective circuit NP1 outputs an oscillation stop signal to the terminal 5 so as to stop an oscillation of the inverter circuit IV. As a result, it is possible to prevent an excessive current from continuously flowing through the ballast chock T1 and the starting capacitor C3 and the ballast chock T1 and the starting capacitor C3 from being broken down.

Moreover, in the case where the discharge lamp LA is dismounted during lighting, a resonance current flows through a series circuit comprising the ballast chock T1 and the detection capacitors C5 and C6, and thereby, the direct current voltage of the capacitor C7 becomes higher than the Zener voltage of the constant voltage diode DZ2. For this reason, the protective circuit NP1 outputs an oscillation stop signal to the terminal 5 so as to stop an oscillation of the inverter circuit IV. In this manner, in the case where the discharge lamp LA is dismounted during lighting, the oscillation of the inverter circuit IV is stopped, and then, no high frequency current flows through the discharge lamp load circuit LAC1; therefore, no high frequency voltage is generated terminals in a socket of the discharge lamp LA. As a result, it is possible to prevent accidents such as a ground fault occurring in lamp replacement.

However, the above conventional discharge lamp lighting apparatus shown in FIG. 34 has the following problems. The discharge lamp lighting apparatus detects a voltage difference between the maximum value and the minimum value of a high frequency voltage waveform between the electrode F1 side terminal of the ballast chock T1 and the negative electrode of the direct current power supply E. Then, by taking advantage of the fact that the above voltage difference becomes higher in abnormal cases (rectification lighting, no-lighting, no-load) than that in the case where the discharge lamp LA is normally lighting, an oscillation of the inverter circuit IV is stopped; for this reason, it is very difficult to make a circuit constant design for determining a protection level of the protective circuit NP1. Namely, in order to enhance a reliability of the protective circuit NP1, a sufficient margin needs to be left so that the protective circuit NP1 does not output an oscillation stop signal during normal lighting of the discharge lamp LA, and on the other hand, a sufficient margin needs to be set so that the protective circuit NP1 securely outputs an oscillation stop signal during abnormal lighting of the discharge lamp LA. As is evident from the circuit diagram shown in FIG. 34, the voltage difference detected by the protective circuit NP1 is, after all, a voltage applied to the discharge lamp LA (i.e., both terminals of the starting capacitor C3). In general, considering that a lamp voltage of the discharge lamp LA greatly varies according to a different between individual products and an environmental temperature, there is a problem, in this fault detecting system of the conventional protective circuit NP1 that the aforesaid two design margins cannot be set sufficiently large. In particular, in the discharge lamp lighting apparatus having a dimming function, a lamp voltage greatly rises when a lamp current of the discharge lamp LA is lowered to reduce a lumen output. Therefore, as a design of the protective circuit NP1 is very difficult, there is a problem that the above protective circuit NP1 cannot be actually applied to the discharge lamp lighting apparatus having a dimming function.

SUMMARY OF THE INVENTION

The present invention has been made in order to solve the above problems. It is, therefore, a first object of the present invention to provide a discharge lamp lighting apparatus which can take a sufficient design margin of a protective circuit, and can make high a reliability of the protective circuit and readily make a design of the protective circuit by securely distinguishing a normal lighting state from an abnormal lighting state.

Further, a second object of the present invention is to provide a discharge lamp lighting apparatus which can detect various faults of discharge lamp lighting apparatus, such as rectification lighting, no-lighting, and a no-load state, and can securely control an operation of an inverter circuit.

Further, a third object of the present invention is to provide a discharge lamp lighting apparatus having a preheat function of an electrode of a discharge lamp, which can securely light the discharge lamp and can securely control an operation of an inverter circuit in a fault state.

Further, a fourth object of the present invention is to provide a discharge lamp lighting apparatus which can securely light a discharge lamp in the case where an operating point in a steady state of the discharge lamp approaches or passes a resonance frequency of a discharge lamp load circuit, and can securely control an operation of an inverter circuit in a fault state.

Further, a fifth object of the present invention is to provide a discharge lamp lighting apparatus which can securely restart a discharge lamp after power supply is reset even in the case of an instantaneous failure of power supply, and can securely control an operation of an inverter circuit in a fault state.

Further, a sixth object of the present invention is to provide a discharge lamp lighting apparatus having a dimming function of a discharge lamp, which can take a sufficient design margin of a protective circuit securely light the discharge lamp by securely distinguishing a normal lighting state from an abnormal lighting state, securely control an operation of an inverter circuit in a fault state and have protective circuit having a high reliability.

Further, a seventh object of the present invention is to provide a discharge lamp lighting apparatus which has a low electrode loss consumed in an electrode of a discharge lamp, and has a high energy efficiency.

In order to achieve the above objects, the present invention provides a discharge lamp lighting apparatus comprising: a direct current power supply; a switching element for switching a direct current supplied from the direct current power supply so as to generate a high frequency current; a discharge lamp load circuit which is constructed in a manner that a discharge lamp and a coupling capacitor are connected in series, and the discharge lamp is lit by a high frequency current generated by the switching element; a protective circuit which detects a voltage generated in the coupling capacitor, and output a control signal; and a switching element control circuit for controlling the switching element by the control signal outputted from the protective circuit.

Further, the present invention provides the discharge lamp lighting apparatus wherein the protective circuit is composed of: a voltage detecting unit for detecting a voltage generated in the coupling capacitor, and converting the detected voltage into a direct current voltage; a comparator unit for comparing the direct current voltage detected and converted by the voltage detecting unit with a reference voltage; and a control signal output unit for generating and outputting a control signal on the basis of the comparative result made by the comparator unit.

Further, the present invention provides the discharge lamp lighting apparatus wherein the voltage detecting unit includes a divided resistor and a constant voltage diode for dividing a voltage inputted to the voltage detecting unit from the coupling capacitor, and is constructed so as to output a voltage divided by the divided resistor and the constant voltage diode to the comparator unit.

Further, the present invention provides the discharge lamp lighting apparatus wherein the comparator unit has at least two different reference voltages, and is a window type comparator which is constructed so as to compare a direct current voltage outputted from the voltage detecting unit with the at least two reference voltages.

Further, the present invention provides the discharge lamp lighting apparatus wherein the direct current voltage outputted from the voltage detecting unit is compared with two different reference voltages by the comparator unit, and when the voltage becomes lower than a reference voltage on a low voltage side or becomes higher than a reference voltage on a high voltage side, the control signal output unit outputs a stop signal or an output reducing signal of the switching element to the switching element control circuit.

Further, the present invention provides the discharge lamp lighting apparatus wherein the reference voltage of the comparator unit is set so as to be variable.

Further, the present invention provides the discharge lamp lighting apparatus wherein a plurality of discharge lamp load circuits having a coupling capacitor and a discharge lamp are driven by a high frequency current outputted from the switching element, and said protective circuit is provided with voltage detecting units each for detecting a voltage generated in the coupling capacitor of each of the discharge lamp load circuits, and converting the detected voltage into a direct current voltage; comparator units each for comparing the direct current voltage detected and converted by the voltage detecting unit with a reference voltage; and a control signal output unit for collecting outputs from the comparator units provided for the plurality of discharge lamp load circuits so as to generate a single control signal, and outputting the single control signal to the switching element control circuit.

Further, the present invention provides the discharge lamp lighting apparatus wherein the protective circuit is provided with a mask circuit for masking a control signal outputted from the protective circuit for a predetermined time.

Further, the present invention provides the discharge lamp lighting apparatus wherein the apparatus further includes an over resonance detection circuit for detecting a high frequency current supplied to the discharge lamp load circuit and outputting a control signal to the switching element control circuit, so that the switching element is controlled by the control signal from the protective circuit and the control signal from the over resonance detection circuit via the switching element control circuit.

Further, the present invention provides the discharge lamp lighting apparatus wherein the apparatus further includes an over resonance detection circuit for detecting a high frequency current supplied to the discharge lamp load circuit and outputting a control signal to the switching element control circuit, so that when the high frequency current detected by the over resonance detection circuit reaches a predetermined current value, even during a masking time of the protective circuit, the over resonance detection circuit outputs a stop signal or an output reducing signal of the switching element to the switching element control circuit.

Further, the present invention provides the discharge lamp lighting apparatus wherein the apparatus further includes a service interruption in the case restoring circuit for automatically resetting the mask circuit when a feed from the direct current power supply is shut off, so that after the feed is restored, the mask circuit is operated so as to mask a control signal outputted from the protective circuit to the switching element control circuit for a predetermined time.

Moreover, the present invention provides a discharge lamp lighting apparatus comprising: a direct current power supply; a switching element for switching a direct current supplied from the direct current power supply so as to generate a high frequency current; a discharge lamp load circuit which is constructed in a manner that a discharge lamp and a coupling capacitor are connected in series, and the discharge lamp is lit by a high frequency current generated by the switching element; a switching element control circuit for controlling the switching element; and a plurality of starting capacitors which are connected in parallel with the discharge lamp, at least one of the starting capacitors being connected to the switching element side with respect to the discharge lamp.

Further, the present invention provides the discharge lamp lighting apparatus wherein a plurality of discharge lamp load circuits each having a coupling capacitor and a discharge lamp are driven by a high frequency current outputted from the switching element, and the protective circuit is provided with a first voltage detecting unit for detecting a stepped-up voltage of each coupling capacitor of the discharge lamp load circuit, and converting the detected voltage into a direct current voltage; a second voltage detecting unit for detecting a dropped voltage of each coupling capacitor, and converting the detected voltage into a direct current voltage; a first comparator unit for comparing the stepped-up direct current voltage detected by the first voltage detecting unit with a reference voltage; a second comparator unit for comparing the drop direct current voltage detected and converted by the second voltage detecting unit with a reference voltage; and a control signal output unit for generating a control signal on the basis of an output from any of the first or second comparator units, and outputting the single control signal to the switching element control circuit.

Further, the present invention provides the discharge lamp lighting apparatus wherein the first voltage detecting unit includes a divided resistor and a constant voltage diode for dividing a voltage of each coupling capacitor, and reverse current blocking diodes interposed between the divided resistor and each coupling capacitor, and outputs the voltage divided by the divided resistor and the constant voltage diode to the first comparator unit, and the second voltage detecting unit includes a divided resistor and a constant voltage diode for dividing a predetermined voltage, and reverse current blocking diodes interposed between the divided resistor and each coupling capacitor, and outputs the voltage divided by the divided resistor and the constant voltage diode to the second comparator unit in the case where any voltage of each coupling capacitor is higher than the predetermined voltage, and further, is constructed in a manner that in the case where any voltage of each coupling capacitor is lower than the predetermined voltage, the predetermined voltage is applied to a coupling capacitor having a lower voltage via the reverse current blocking diode.

Further, the present invention provides the discharge lamp lighting apparatus wherein one end of each reverse current blocking diode of the second voltage detecting unit is connected to a starting capacitor side of the discharge lamp.

Further, the present invention provides the discharge lamp lighting apparatus wherein the first voltage detecting unit includes divided resistors and constant voltage diodes each for dividing a voltage of each coupling capacitor, and reverse current blocking diodes interposed between the constant voltage diodes and the first comparator unit, and outputs the voltage divided by the divided resistor and the constant voltage to the first comparator unit via the diode reverse current blocking diodes, and the second voltage detecting unit includes a divided resistor and a constant voltage diode for dividing a predetermined voltage, and reverse current blocking diodes interposed between the constant voltage diode and each of the constant voltage diodes of the first voltage detecting unit, and outputs the voltage divided by the divided resistor and the constant voltage diode to the second comparator unit in the case where any voltage of each coupling capacitor is higher than the predetermined voltage, and further, is constructed in a manner that in the case where any voltage of each coupling capacitor is lower than the predetermined voltage, the predetermined voltage is applied to a coupling capacitor having a lower voltage via the reverse current blocking diode, the divided resistor of the first voltage detecting unit and the constant voltage diode.

As is evident from the above description, the present invention has the aforesaid construction; and therefore, has the following effects.

More specifically, the present invention provides a discharge lamp lighting apparatus comprising: a direct current power supply; a switching element for switching a direct current supplied from the direct current power supply so as to generate a high frequency current; a discharge lamp load circuit which is constructed in a manner that a discharge lamp and a coupling capacitor are connected in series, and the discharge lamp is lit by a high frequency current generated by the switching element; a switching element control circuit for controlling the switching element. Further, the discharge lamp lighting apparatus includes a protective circuit which detects a voltage generated in the coupling capacitor, and output a control signal. Therefore, it is possible to securely distinguish a normal lighting state from an abnormal lighting state, and to stably light the discharge lamp in the normal lighting state. Moreover, it is possible to obtain a discharge lamp lighting apparatus which can control an oscillation of an inverter circuit in a fault state by securely operating the protective circuit, and has a high reliability.

Further, the protective circuit is composed of: a voltage detecting unit for detecting a voltage generated in the coupling capacitor, and converting the detected voltage into a direct current voltage; a comparator unit for comparing the direct current voltage detected by the voltage detecting unit with a reference voltage; and a control signal output unit for generating and outputting a control signal on the basis of the comparative result made by the comparator unit. Moreover, the comparator unit has at least two different reference voltages, and is a window type comparator which is constructed so as to compare a direct current voltage outputted from the voltage detecting unit with at least two reference voltages. Therefore, it is possible to detect a fault not only in a rectification lighting 1 state that a detection voltage steps up as compared with the fully normal lighting state, but also in a rectification lighting 2 state that a detection voltage steps up as compared with the fully normal lighting state and in a no-lighting state, and thus, to detect various faults generated in the discharge lamp.

The voltage detecting unit includes a divided resistor and a constant voltage diode for dividing a voltage inputted to the voltage detecting unit from the coupling capacitor, and is constructed so as to output a voltage divided by the divided resistor and the constant voltage diode to the comparator unit. Therefore, it is possible to largely set a difference in a reference voltage between the normal lighting state and the abnormal state, and thus, to further improve a reliability of the protective circuit.

The direct current voltage outputted from the voltage detecting unit is compared with two different reference voltages by the comparator unit, and when the voltage becomes lower than a reference voltage on a low voltage side or becomes higher than a reference voltage on a high voltage side, the control signal output unit outputs a stop signal or output reducing signal of the switching element to the switching element control circuit. Therefore, it is possible to securely detect various faults generated in the discharge lamp, and by stopping or reducing an output to the discharge lamp, it is possible to prevent a breakdown or ground fault of the discharge lamp, the discharge lamp load circuit or the like.

The reference voltage of the comparator is set so as to be variable. Therefore, it is possible to more precisely set a reference value in accordance with a characteristic of the discharge lamp.

Each of the plurality of discharge lamp load circuits is provided with a voltage detecting unit for detecting a voltage generated in the coupling capacitor, and converting the detected voltage into a direct current voltage; a comparator unit for comparing the direct current voltage detected by the voltage detecting unit with a reference voltage; and a control signal output unit for collecting an output from the comparator units provided in the plurality of discharge lamp load circuits so as to generate a single control signal, and outputting the single control signal to the switching element control circuit. Therefore, it is possible to detect a fault at the point of time when any discharge lamps are in a fault state, and to reduce the number of components of the control signal output unit.

The protective circuit is provided with a mask circuit for masking a control signal outputted from the protective circuit for a predetermined time. Therefore, it is possible to obtain a discharge lamp lighting apparatus which can securely light a normal discharge lamp, and can securely stop an oscillation in a fault state. Moreover, the protective circuit is applicable to a discharge lamp lighting apparatus having a preheat function of preheating an electrode of the discharge lamp.

The discharge lamp lighting apparatus further includes an over resonance detection circuit which detects a high frequency current supplied to the discharge lamp load circuit and outputs a control signal to the switching element control circuit, and is constructed so that the switching element is controlled by the control signal from the protective circuit and the control signal from the over resonance detection circuit via the switching element control circuit. Therefore, it is possible to more precisely detect a fault, and to further improve a reliability of the protective circuit. Moreover, it is possible to apply the protective circuit to a discharge lamp lighting apparatus which is constructed in a manner that an oscillation frequency of the inverter circuit approaches a resonance frequency f0.

The discharge lamp lighting apparatus further includes a service interruption restoring circuit for automatically resetting the mask circuit when a feed from the direct current power supply is shut off, and after the feed is restored, the mask circuit is operated so as to mask a control signal outputted from the protective circuit to the switching element for a predetermined time. Therefore, even in the case where a service interruption takes place, after the service interruption is restored, it is possible to again operate the mask circuit, and to securely light the discharge lamp again simultaneously with when the power supply is restored.

Moreover, the present invention provides a discharge lamp lighting apparatus comprising: a direct current power supply; a switching element for switching a direct current supplied from the direct current power supply so as to generate a high frequency current; a discharge lamp load circuit which is constructed in a manner that a discharge lamp and a coupling capacitor are connected in series, and the discharge lamp is lit by a high frequency current generated by the switching element; a switching element control circuit for controlling the switching element. Further, the discharge lamp lighting apparatus includes a plurality of starting capacitors which are connected in parallel with the discharge lamp, at least one of the starting capacitors being connected to the switching element side with respect to the discharge lamp. Therefore, it is possible to make small an electrode loss consumed in the electrode of the discharge lamp, and thus, to improve an energy efficiency.

The plurality of discharge lamp load circuits having a coupling capacitor and a discharge lamp are driven by a high frequency current outputted from the switching element, and each of the plurality of discharge lamp load circuits is provided with a first voltage detecting unit for detecting a step-up voltage of each coupling capacitor, and converting the detected voltage into a direct current voltage; a second voltage detecting unit for detecting a drop voltage of each coupling capacitor, and converting the detected voltage into a direct current voltage; a first comparator unit for comparing the step-up direct current voltage detected by the first voltage detecting unit with a reference voltage; a second comparator unit for comparing the drop direct current voltage detected by the second voltage detecting unit with a reference voltage; and a control signal output unit for generating a control signal on the basis of an output from any of the first or second comparator units, and for outputting the single control signal to the switching element control circuit. Therefore, it is possible to detect a fault at the point of time when any of the discharge lamps is in a fault state, and to reduce the number of components as compared with the case where the comparator unit and the voltage detecting unit are independently provided in accordance with an increase of the discharge lamp load circuit.

The first voltage detecting unit includes a divided resistor and a constant voltage diode for dividing a voltage of each coupling capacitor, and a reverse current blocking diode interposed between the divided resistor and each coupling capacitor, and outputs the voltage divided by the divided resistor and the constant voltage diode to the first comparator unit, and the second voltage detecting unit includes a divided resistor and a constant voltage diode for dividing a predetermined voltage, and a reverse current blocking diode interposed between the divided resistor and each coupling capacitor, and outputs the voltage divided by the divided resistor and the constant voltage diode to the second comparator unit in the case where any voltage of each coupling capacitor is higher than the predetermined voltage, and further, is constructed in a manner that the predetermined voltage is applied to a coupling capacitor having a lower voltage via the reverse current blocking diode in the case where any voltage of each coupling capacitor is lower than the predetermined voltage. Therefore, even if the number of the discharge lamp load circuits is increased, the voltage detecting unit for detecting a voltage of each coupling capacitor is divided into the first voltage detecting unit for detecting a step-up voltage and the second voltage detecting unit for detecting a drop voltage, and thereby, it is possible to reduce the number of components of the voltage detecting unit by increasing the number of the divided resistors and the reverse current blocking diodes. Moreover, even if the number of the discharge lamp load circuits is increased, it is possible to detect the presence of the discharge lamp which is in the following states; more specifically, in a state such that any of the plurality of discharge lamps is in a fault state, that is, in a rectification lighting 1 state such that a detection voltage steps up as compared with the fully normal lighting state, in a rectification lighting 2 state such that a detection voltage drops as compared with the fully normal lighting state, and a detection voltage becomes 0 V by the removal of the discharge lamp. Moreover, it is possible to detect various faults of the discharge lamp.

In addition, the first voltage detecting unit outputs the voltage divided by the divided resistor and the constant voltage diode to the first comparator unit, and the second voltage detecting unit outputs the voltage divided by the divided resistor and the constant voltage diode to the second comparator unit in the case where any voltage of each coupling capacitor is higher than the predetermined voltage. Therefore, it is possible to largely set a difference in a reference voltage between the normal lighting state and the abnormal lighting state in the first and second comparator units, and thus, further improve a reliability of the protective circuit.

One end of the reverse current blocking diode of the second voltage detecting unit is connected to a starting capacitor side of the discharge lamp. Therefore, when the number of the discharge lamp load circuits is increased, in the case where any of the discharge lamps is dismounted, a circuit of the coupling capacitor of the discharge lamp and the reverse current blocking diode is shut off; as a result, the discharge lamp all becomes a normal state in the second voltage detecting unit, and the presence of the discharge lamp is not detected, and thereby, it is possible to make a detection in only case where any of the plural discharge lamps is in an abnormal state and a normal state.

The first voltage detecting unit includes a divided resistor and a constant voltage diode for dividing a voltage of each coupling capacitor, and a reverse current blocking diode interposed between each constant voltage diode and the first comparator unit, and outputs the voltage divided by the divided resistor and the constant voltage to the first comparator unit via the diode reverse current blocking diode, and the second voltage detecting unit includes a divided resistor and a constant voltage diode for dividing a predetermined voltage, and a reverse current blocking diode interposed between the constant voltage diode and each constant voltage diode of the first voltage detecting unit, and further, a direct current voltage of each coupling capacitor is dived by a divided circuit comprising the divided resistor and the constant voltage diode, and the divided voltage is inputted to the first comparator unit via each reverse current blocking diode, and a direct current voltage of a direct current power supply is dived by a divided circuit comprising the divided resistor and the constant voltage diode, and the divided voltage is inputted to each coupling capacitor via each reverse current blocking diode. Therefore, it is possible to use a reverse current blocking diode having a low withstand voltage.

BRIEF DESCRIPTION OF THE DRAWINGS

FIG. 8 is a comparative chart showing a change of potential of the discharge lamp lighting apparatus according to the first embodiment of the present invention;

FIG. 14 is a comparative view showing a change of potential of the discharge lamp lighting apparatuses according to the first and second embodiments of the present invention;

BEST MODE FOR CARRYING OUT THE INVENTION

FIRST EMBODIMENT

Figure 1:
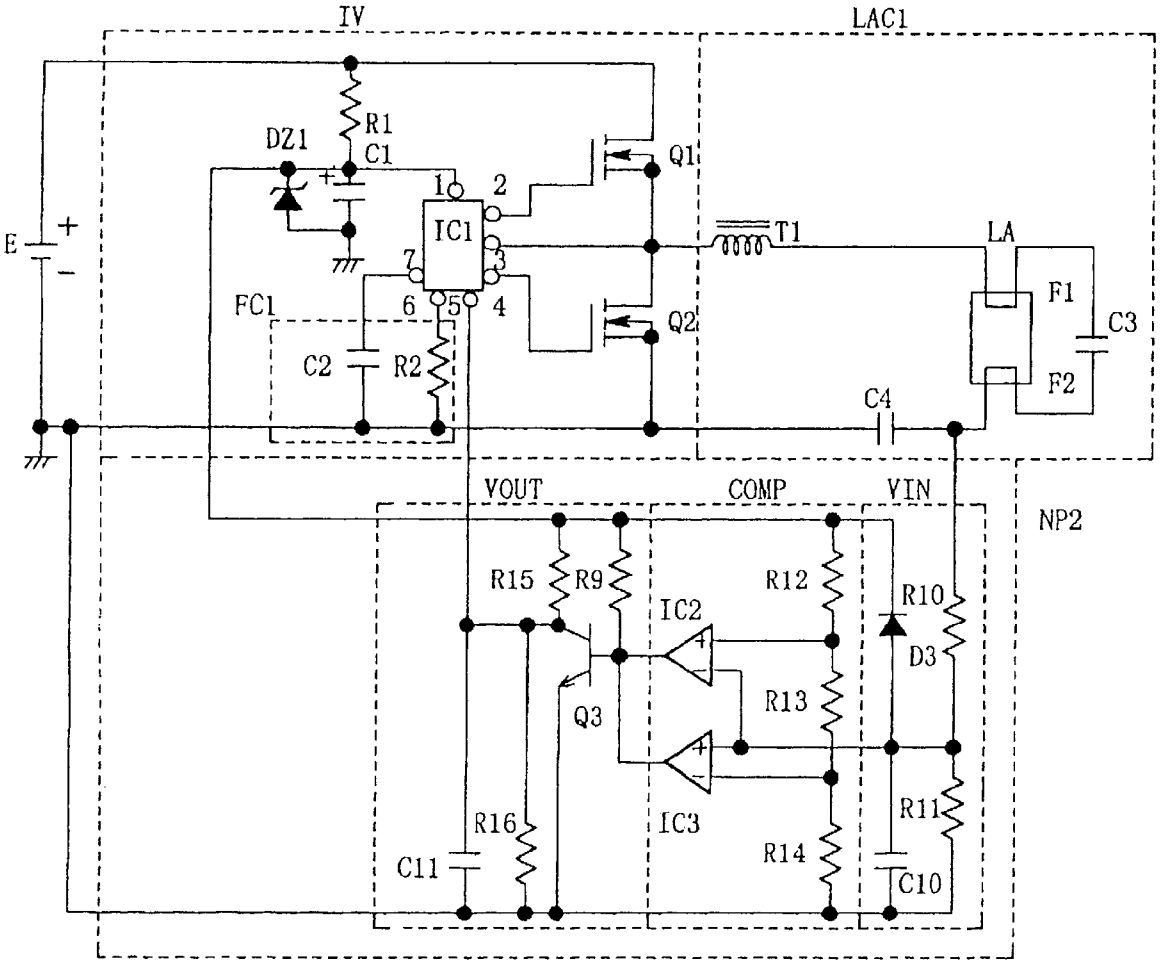
FIG. 1 is a circuit diagram showing a construction of a discharge lamp lighting apparatus according to a first embodiment of the present invention.

FIG. 1 is a circuit diagram showing a construction of a discharge lamp lighting apparatus according to a first embodiment of the present invention. Like reference numerals are used to designate the same portion as the conventional discharge lamp lighting apparatus described in FIG. 34 or the portion corresponding thereto, and the details are omitted.

Figure 34:
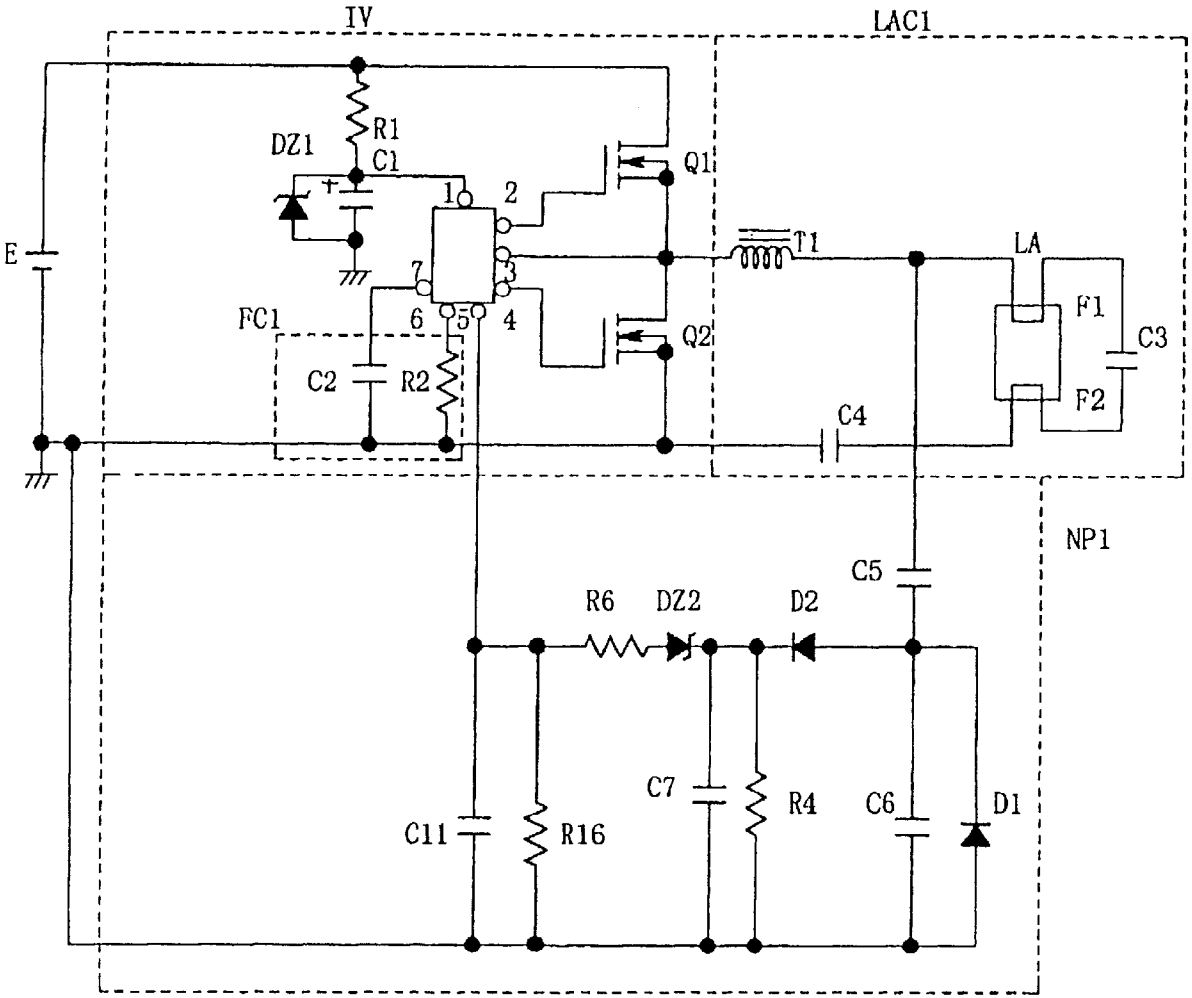
FIG. 34 is a circuit diagram showing a construction of a conventional discharge lamp lighting apparatus.
Figure 35:
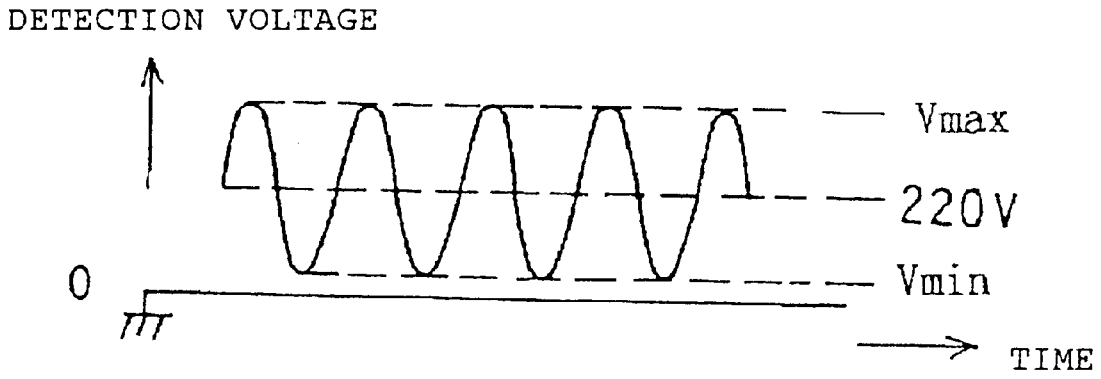
FIG. 35 PRIOR ART
FIG. 35 is a voltage waveform chart showing an operation of the conventional discharge lamp lighting apparatus.

The discharge lamp lighting apparatus of the first embodiment shown in FIG. 1 is different from the conventional discharge lamp lighting apparatus shown in FIG. 34 in a construction of the protective circuit and in a detecting object for detecting a fault. More specifically, in this first embodiment, a protective circuit NP2 detects a voltage between both terminals of a coupling capacitor C4, and thereby, a fault of the discharge lamp load circuit LAC1 is detected, and then, a control signal is outputted to the IV control circuit IC1. Thus, the protective circuit NP2 includes: a voltage detecting unit VIN for detecting a direct current voltage between both terminals of the coupling capacitor C4; a comparator unit COMP for comparing the direct current voltage detected by the voltage detecting unit VIN with a reference voltage; and a control signal output unit VOUT for generating and outputting a control signal on the basis of the comparative result made by the comparator unit COMP.

The following is a description on a detailed construction of each unit constituting the above protective circuit NP2.

First, the voltage detecting unit VIN includes detection resistors R10 and R1l for dividing the voltage between both terminals of the coupling capacitor C4, and a capacitor C10 for removing a high frequency ripple component of the divided voltage. A detected voltage converted into a direct current is outputted to the comparator unit COMP. The comparator unit COMP includes two comparator IC2 and IC3, and is constructed as a window type comparator in a manner that, two reference voltages are prepared by dividing a direct current voltage of the control power supply capacitor C1 with the resistors R12, R13 and R14, a voltage of a connecting point of the resistors R12 and R13 for determining a high threshold value is inputted to a non-inverting input terminal of the comparator IC2, a voltage of a connecting point of the resistors R13 and R14 for determining a low threshold value is inputted to an inverting input terminal of the comparator IC3, and further, the detected voltage from the voltage detecting unit VIN is inputted to an inverting input terminal of the comparator IC2 and an non-inverting input terminal of the comparator IC3. An output terminals of either comparator IC2 or IC3 is an open collector, and both output terminals are connected to a base of a transistor Q3. A collector terminal of the transistor Q3 is connected to the terminal 5 of the IV control circuit IC1, a parallel circuit comprising a capacitor C11 and a resistor R16 for dividing a voltage and removing an external high frequency noise is connected between the collector terminal and the negative electrode of the direct current power supply E, and a resistor R15 for dividing a voltage is connected between the collector terminal and a positive electrode of the control power supply capacitor C1, so that a control signal output unit VOUT is constructed.

Incidentally, a diode D3 connected between the non-inverting input terminal of the comparator IC3 and the control power supply capacitor C1 is a protective diode for clipping a voltage of the comparator IC3 into a Zener voltage of the constant voltage diode DZ1.

Figure 2A:
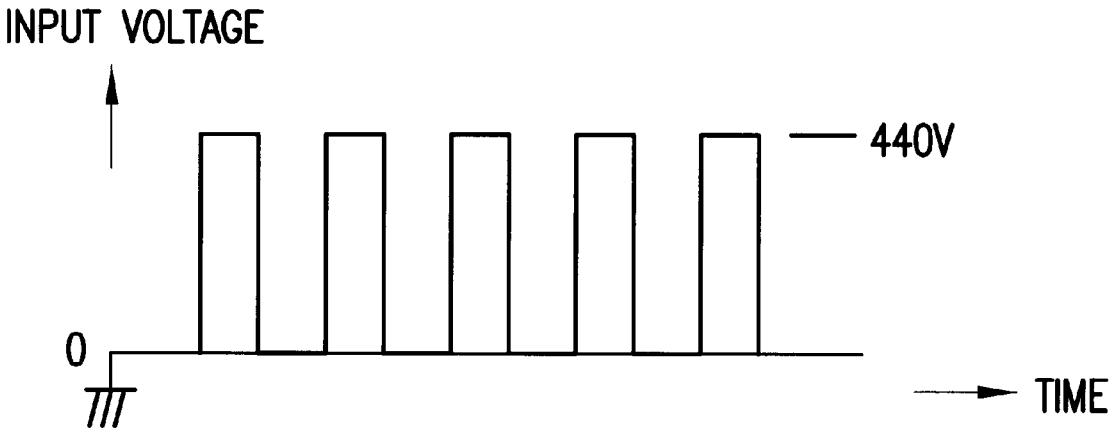
FIG. 2 is a voltage waveform chart between terminals of a switching element showing an operation of the discharge lamp lighting apparatus according to the first embodiment of the present invention.
Figure 2B:
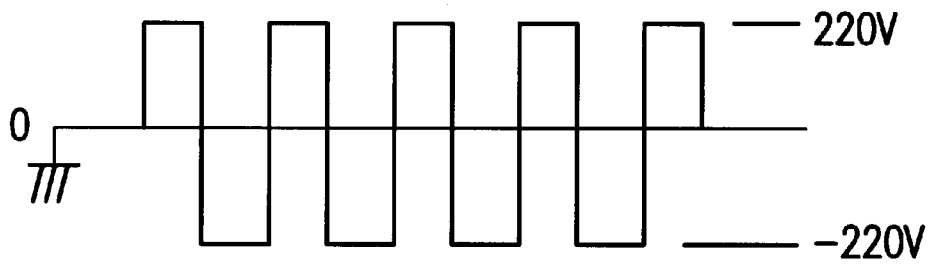
Figure 2C:
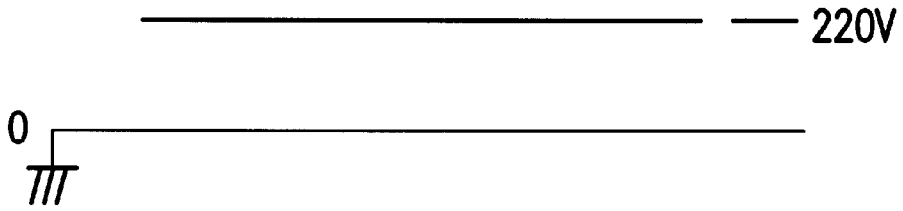

Next, an operation of the circuit of the first embodiment shown in FIG. 1 will be described below with reference to FIG. 1 and FIG. 2. An operation of the circuit during a time between a start of the discharge lamp lighting apparatus and a start of discharge lamp LA is the same as the above conventional apparatus shown in FIG. 34. Therefore, its description is omitted, and an operation of the protective circuit NP2 is described below in particular.

When the discharge lamp lighting apparatus is started up and the IV control circuit IC1 oscillates at a frequency f, the switching elements Q1 and Q2 are alternately turned on and off at the same frequency, and then, the discharge lamp LA is lighted. At this time, a terminal voltage of the switching element Q2, that is, an input voltage to the discharge lamp load circuit LAC1 is a high frequency voltage as shown in FIG. 2 (*a*), having a frequency f and a peak value of the voltage of the direct current power supply E (hereinafter, 440 V as one example). The high frequency voltage of FIG. 2 (*a*) is expressed by a resultant (synthetic) voltage made of both a high frequency alternating voltage AC having a peak value of 220 V (440 V/2) and a frequency f as shown in FIG. 2 (*b*) and a direct current voltage DC having a peak value of 220 V (440 V/2) as shown in FIG. 2(*c*). Now, the voltage generated between both terminals of the coupling capacitor C4 (i.e., negative electrode side of the direct current power supply E and discharge lamp LA side of the coupling capacitor C4) is examined. Since a capacity of the coupling capacitor C4 is designed sufficiently larger, a high frequency voltage component shown in FIG. 2(*b*) is offset by a charge and discharge of the coupling capacitor C4. As a result, in the coupling capacitor C4, a quasi-direct current voltage is generated which includes the direct current voltage shown in FIG. 2(*c*), consisting of a direct current component, and a slight high frequency voltage.

In this manner, the quasi-direct current voltage is divided by the voltage detecting unit VIN of the protective circuit NP2, and then, a high frequency component is removed by the capacitor C10 so as to be converted into a direct current voltage, and thereafter, is outputted to the comparator unit COMP. Then, the direct current voltage is compared with two reference voltages by the window type comparator composed of the comparator IC2 and the comparator IC3. If the direct current voltage is out of the range between the reference voltages, the transistor Q3 is turned off so that an oscillation stop signal is inputted to the terminal 5 of the IV control circuit IC1. Thus, the oscillation of the IV control circuit IC1 is stopped, and also, each switching operation of the switching elements Q1 and Q2 is stopped. Although following is a description on the case where a control signal of the protective circuit NP2 is inputted to the oscillation stop signal input terminal 5 of the IV control circuit IC1, these control signals may be inputted to, for example, a frequency control terminal 6 directly or via the frequency control circuit FC1 so as to control the switching frequency of the switching elements Q1 and Q2 to reduce a high frequency output supplied to the discharge lamp LA.

Figure 3:
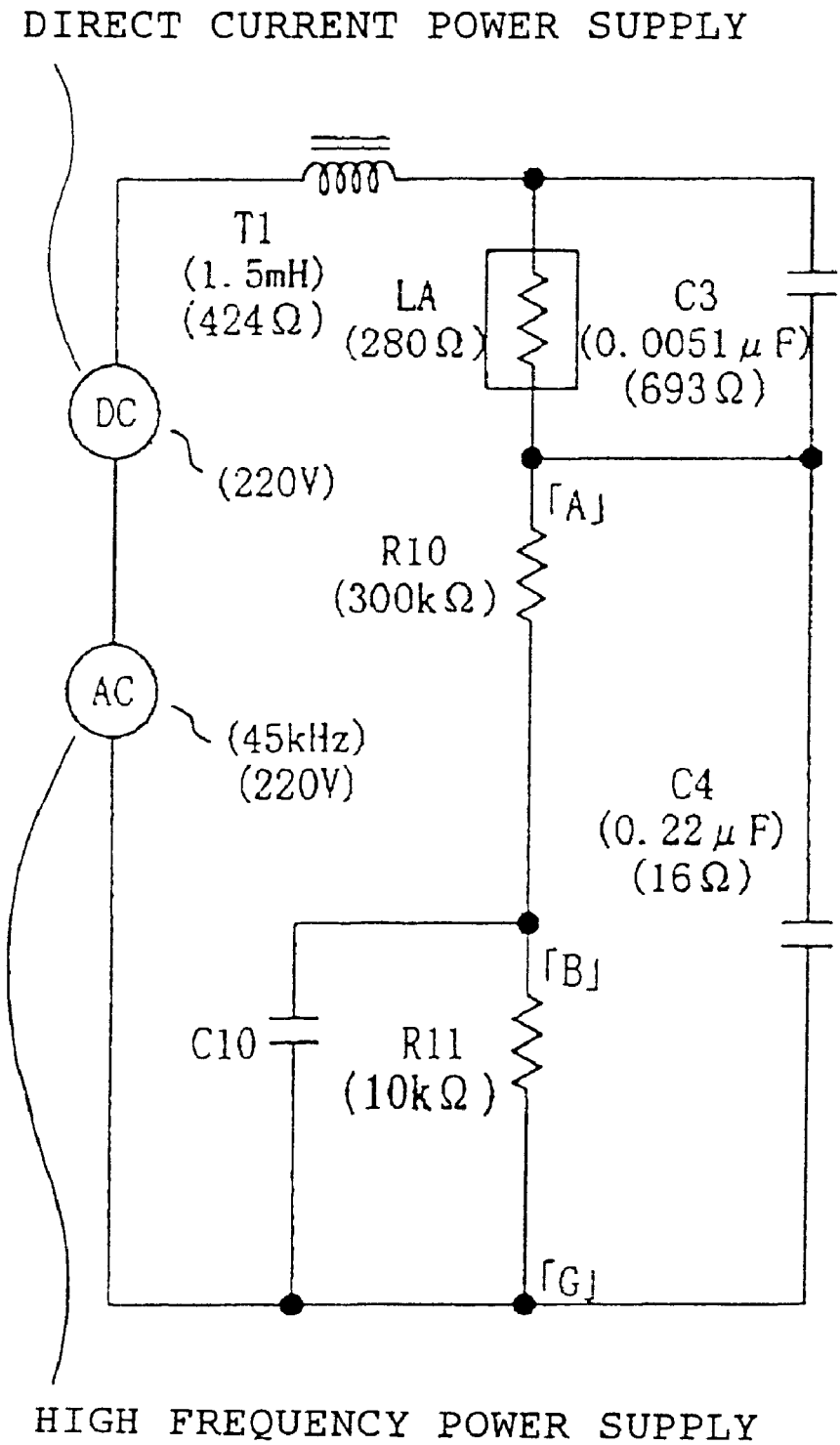
FIG. 3 is an equivalent circuit diagram showing a fully normal lighting state of the discharge lamp lighting apparatus according to the first embodiment of the present invention.

Subsequently, an operation of the protective circuit NP2 corresponding to each load state of the discharge lamp LA will be successively described below in detail. FIG. 3 is a diagram showing an equivalent circuit of a discharge lamp load circuit LAC1 and the voltage detecting unit VIN of the protective circuit NP2, in a fully normal lighting state based on the concept shown in FIG. 2 and shows one example of a practical frequency, circuit constant and impedance. In FIG. 3, "A" and "B" show a potential of the coupling capacitor C4 on a positive electrode side and a potential of a detection resistor R11, respectively, on the basis of a negative electrode potential "G" of the direct current power supply E, respectively.

As shown in the equivalent circuit diagram of FIG. 3, for the discharge lamp LA is lighting at a high frequency of 45 kHz in this case, it is equivalently regarded as a resistance. Here, the resistance is set as 280Ω considering an FHF32 (Hf) lamp of JIS standard to be used. In this equivalent circuit, a voltage generated between both terminals of the coupling capacitor C4 is considered as follows. The total of resistance values of the detection resistors R10 and R11 is a high resistance of about 1000 times as much as the discharge lamp LA. For this reason, the coupling capacitor C4 is charged to about 220 V by the direct current power supply DC via the ballast chock T1 and the discharge lamp LA while the same charge is alternately charged and discharged by the high frequency power supply AC via the ballast chock T1, the discharge lamp LA and the starting capacitor C3. As a result, a potential "A" of the coupling capacitor C4 becomes a direct current voltage of about 220 V with which a slight high frequency component is overlapped. Moreover, a potential "B" of the detection resistor R11 becomes a direct current voltage of about 7 V because the potential "A" is divided by the detection resistor R10 (300 kΩ) and the detection resistor R11 (10 kΩ), and a high frequency component is removed by the capacitor C10. As described in the conventional example, in the discharge lamp LA, a lamp voltage generally varies according to a variation of environmental temperature, an aged deterioration or a difference between individual product even if a lamp current is fixed; namely its equivalent resistance value greatly varies. However, according to the first embodiment described above, the detection resistors R10 and R11 have a high resistance value; therefore, for example, even if the equivalent resistance value of the discharge lamp LA varies by about 30% to 50%, the potentials "A" and "B" of the coupling capacitor C4 and the detection resistor R11 hardly change.

Figure 4:
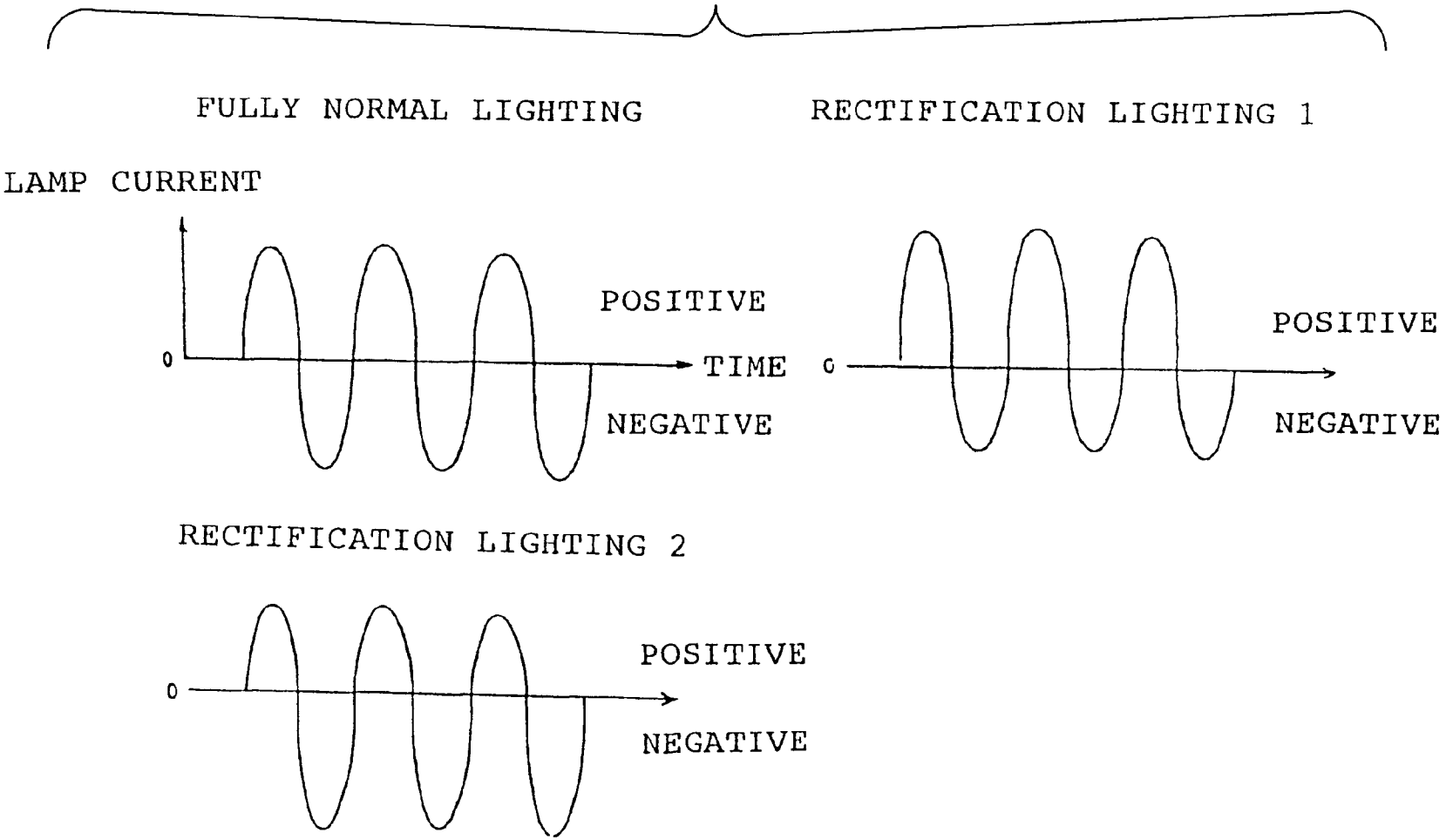
FIG. 4 is a lamp current waveform chart of a fully normal lighting state and a rectification lighting state of the discharge lamp lighting apparatus according to the first embodiment of the present invention.

Next, the following is a description on an operation of rectification lighting 1 (a state where electrons are hardly emitted from the electrode F1 in the end of life) and rectification lighting 2 (a state where electrons are hardly emitted from the electrode F2 in the end of life) of fault states of the discharge lamp LA. FIG. 4 shows a high frequency lamp current waveform of the discharge lamp LA in each case of full lighting, rectification lighting 1 and rectification lighting 2 (directions for charging and discharging the coupling capacitor C4 are shown as positive and negative, respectively). As seen from FIG. 4, in the full lighting state, a waveform is symmetrical; on the contrary, in the rectification lighting 1 state and the rectification lighting 2 state, a waveform is asymmetrical. A characteristic change of the discharge lamp LA by a difference in the above lighting states is shown in FIG. 5 and FIG. 6.

Figure 5:
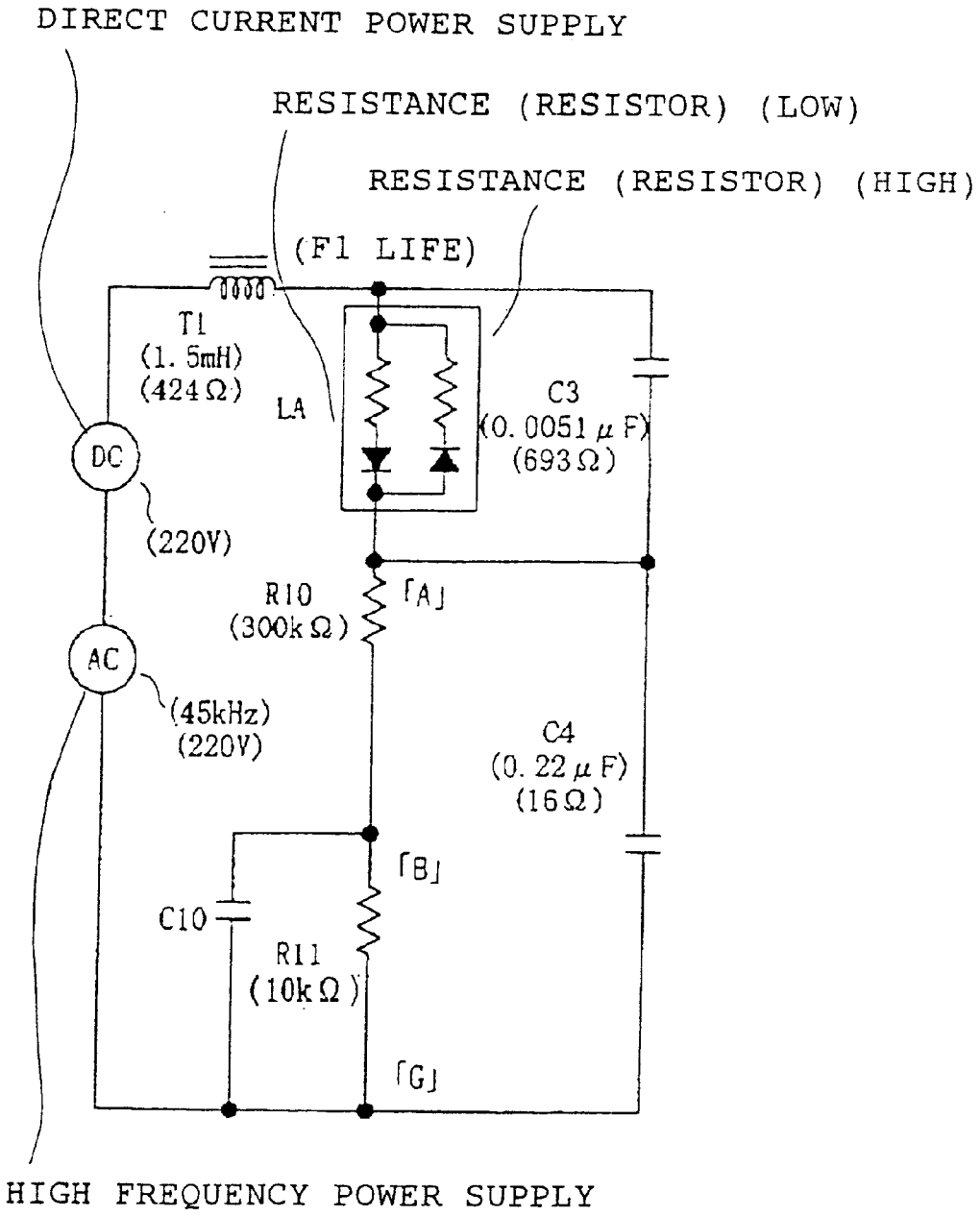
FIG. 5 is an equivalent circuit diagram showing a rectification lighting state of the discharge lamp lighting apparatus according to the first embodiment of the present invention.
Figure 6:
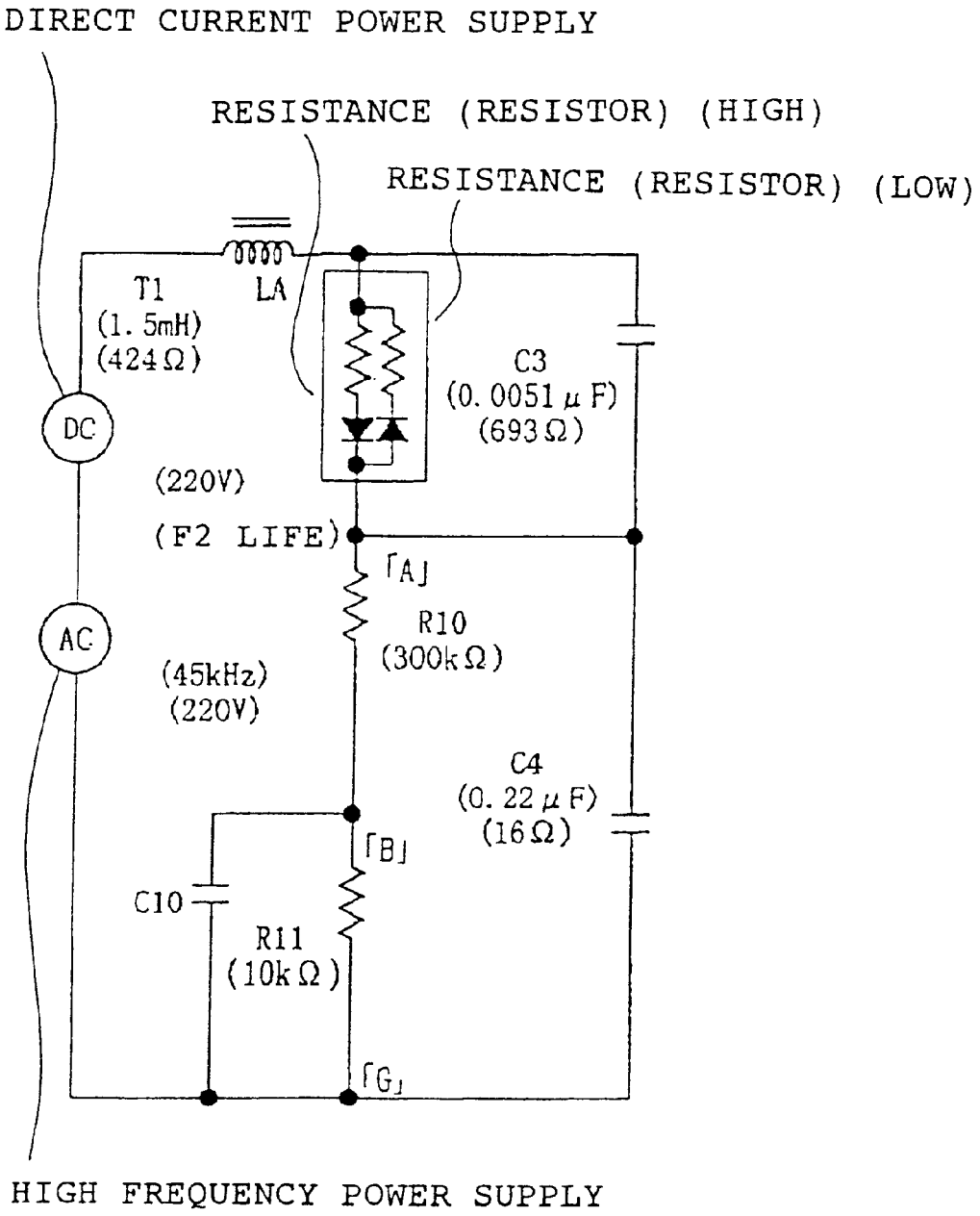
FIG. 6 is an equivalent circuit diagram showing a rectification lighting state of the discharge lamp lighting apparatus according to the first embodiment of the present invention.

FIG. 5 and FIG. 6 are equivalent circuit diagrams of the discharge lamp load circuit LAC1 and the voltage detecting unit VIN in the protective circuit NP2 with respect to rectification lighting 1 and rectification lighting 2, wherein a characteristic change of the discharge lamp LA is expressed by a connective direction of an equivalent circuit comprising an anti-parallel circuit of both a series circuit of a resistor (low) (tens of ohms(Ω) to hundreds of ohms(Ω)) and a diode, and a series circuit of a resistor (high) (hundreds of ohms(Ω) to several kilo-ohms (KΩ)) and a diode. In regard to FIG. 5 and FIG. 6, a potential of the coupling capacitor C4 in the rectification lighting states 1 and 2 is considered as follows. The coupling capacitor C4 is charged to about 220 V by the direct current power supply DC via the ballast chock T1 and the discharge lamp LA (the resistor (low) and the diode in the rectification lighting 1 state, and the resistor (high) and the diode in the rectification lighting 2 state), like the normal lighting state of FIG. 3. Moreover, the same charge is charged and discharged from the high frequency power supply AC via the ballast chock T1 and the starting capacitor C3. By the above characteristic change of the discharge lamp LA, in the rectification lighting 1 state, a charging current becomes much via the discharge lamp LA in comparison to a discharging current; conversely, in the rectification lighting 2 state, a discharging current becomes much in comparison to a charging current. For this reason, the potentials "A" and "B" are individually changed to a high value in the rectification lighting 1 state (in this equivalent circuit, "A" is 290 V, and "B" is 9.4 V), and to a low value in the rectification lighting 2 state (in this equivalent circuit, "A" is 150 V, and "B" is 4.8 V) in comparison to the normal full lighting state.

Figure 7:
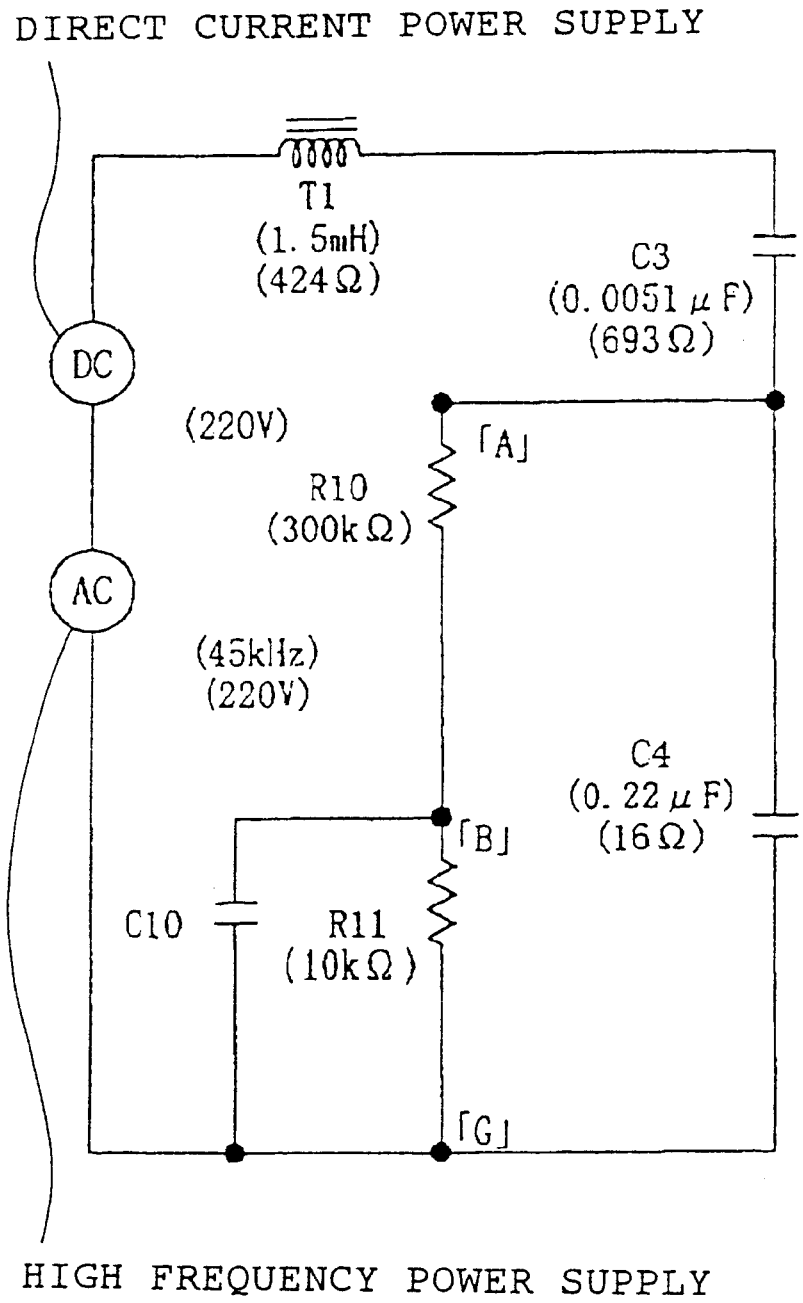
FIG. 7 is an equivalent circuit diagram showing a no-lighting state of the discharge lamp lighting apparatus according to the first embodiment of the present invention.

Next, the following is a description on the case where the discharge lamp is in a non-lighting state or no-load state of fault states of the discharge lamp LA. In the case where the discharge lamp LA is in a non-lighting state or no-load state, an equivalent resistance value of the discharge lamp LA becomes infinite. Consequently, the equivalent circuit becomes as shown in FIG. 7 where a circuit of the discharge lamp LA is deleted. In FIG. 7, a potential of the coupling capacitor C4 is considered as follows. Since, there is no path for charging the coupling capacitor C4 from the direct current power supply DC and the same charge is alternately charged and discharged to the coupling capacitor C4 from the high frequency power supply AC via the ballast chock T1 and the starting capacitor C3, both the potentials "A" and "B" become 0 V.

FIG. 8 shows the potential "A" of the coupling capacitor C4 and the potential "B" of the detection resistor R11 corresponding to each load state of the discharge lamp in this first embodiment.

Thus, the resistors R12, R13 and R14 are previously designed so that a reference voltage of a high threshold value of the comparator unit COMP composed of the comparator IC2 and IC3 in FIG. 1 is set 8 V, and a reference voltage of a low threshold value is set to 6 V. Then, the above potential "B" shown in FIG. 8 is inputted to the comparator unit, and thereby, in the normal full lighting state, the outputs of the comparator IC2 and IC3 are both HIGH, and the transistor Q3 of the control signal output unit VOUT is in an on state. Therefore, no oscillation stop signal is outputted to the terminal 5 of the IV control circuit IC1; as a result, it is possible to continue the normal full lighting state. On the other hand, in the rectification lighting 1 state, the output of the comparator IC2 becomes LOW, and in the rectification lighting 2 state and no-lighting or no-load state, the output of the comparator IC3 becomes LOW, and the transistor Q3 is in an off state. Therefore, an oscillation stop signal is outputted to the terminal 5 of the IV control circuit IC1 so as to stop an oscillation of the inverter circuit IV. As a result, an over current to the ballast chock T1 and the starting capacitor C3 is shut out in the rectification lighting state or no-lighting state to prevent a breakdown of the circuit, and a high frequency voltage generated in a socket of the discharge lamp LA is turned off in a no-load state.

As described above, according to this first embodiment, a voltage between both terminals of the coupling capacitor C4 is detected to detect a fault of the discharge lamp circuit LC1, as a variation of lamp voltage due to a difference between individual products of discharge lamp LA and a variation of environmental temperature hardly influence the voltage between the both terminals in the normal lighting state, and moreover, the voltage between both terminals greatly varies in accordance with each load state of the discharge lamp in the fault states. Therefore, a margin for making no operation of the protective circuit in the normal lighting state of the discharge lamp LA is sufficiently secured, and the protective circuit is securely operated in a fault state of the discharge lamp LA so as to stop an oscillation of the inverter circuit IV. Thereby, it is possible to obtain a discharge lamp lighting apparatus having a high reliability. As a result, there is an effect that a continued operation of rectification lighting generated with a discharge lamp LA which is in the end of life or is defective, a failure of the discharge lamp lighting apparatus and a breakdown of the discharge lamp LA, caused by no-lighting of lamp or accidents such as ground fault in a lamp replacement can be effectively prevented.

Further, according to this first embodiment, as described above, there is an effect that a sufficient margin is secured in an operation of the protective circuit NP2, and a design of the protective circuit NP2 such as setting of reference voltage or the like can be easily made.

Furthermore, according to this first embodiment, the protective circuit NP2 is composed of the voltage detecting unit VIN, the comparator unit COMP and the control signal output unit VOUT, and the comparator unit COMP is constructed as a window type comparator having two reference voltages. Therefore, there is an effect to detect the rectification lighting 1 state in which a detection voltage rises up as compared with the normal full lighting state, and both faults of the rectification lighting 2 state and no-lighting state, in which a detection voltage rises up as compared with the fully normal lighting state.

The above FIG. 1 shows the case where only one discharge lamp LA is connected. Even in the case where a plurality of discharge lamps LA are connected in series, the protective circuit NP2 detects the fault state at the point of time when one of the plural discharge lamps is in a fault state, according to the same circuit operation as above, and then, outputs an oscillation stop signal to the IV control circuit IC1. Therefore, the same effect as above can be obtained.

In addition, the above FIG. 1 shows the case where the resistors R12, R13 and R14 for setting reference voltages of the comparator unit are composed of fixed resistors. However, if some of these resistors are composed of variable resistors so as to vary the reference voltages, there is an effect that for discharge lamps having different rated values, a reference value can be precisely set in accordance with a characteristic of the discharge lamps LA, for example.

SECOND EMBODIMENT

Figure 9:
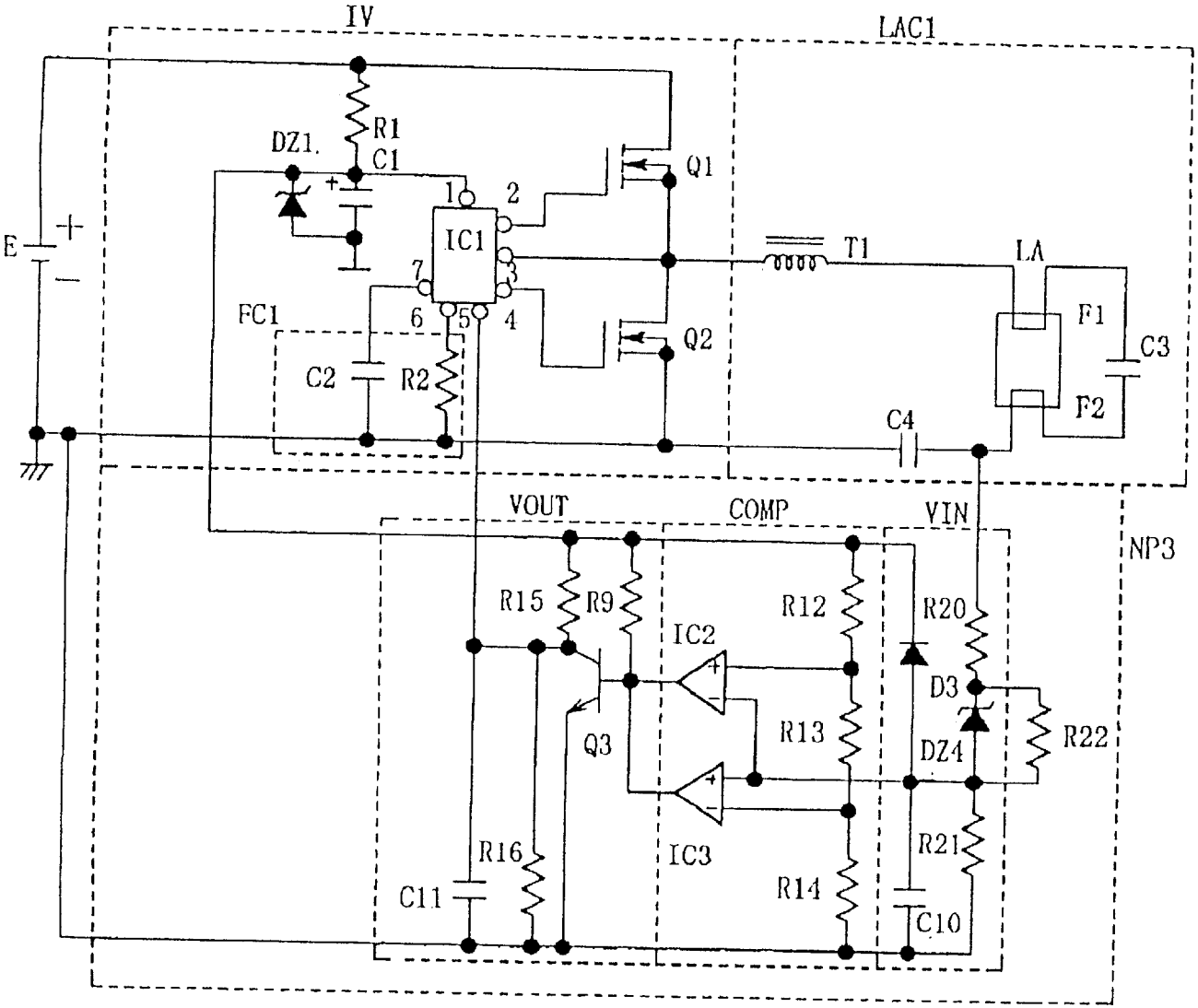
FIG. 9 is a circuit diagram showing a construction of a discharge lamp lighting apparatus according to a second embodiment of the present invention.
Figure 10:
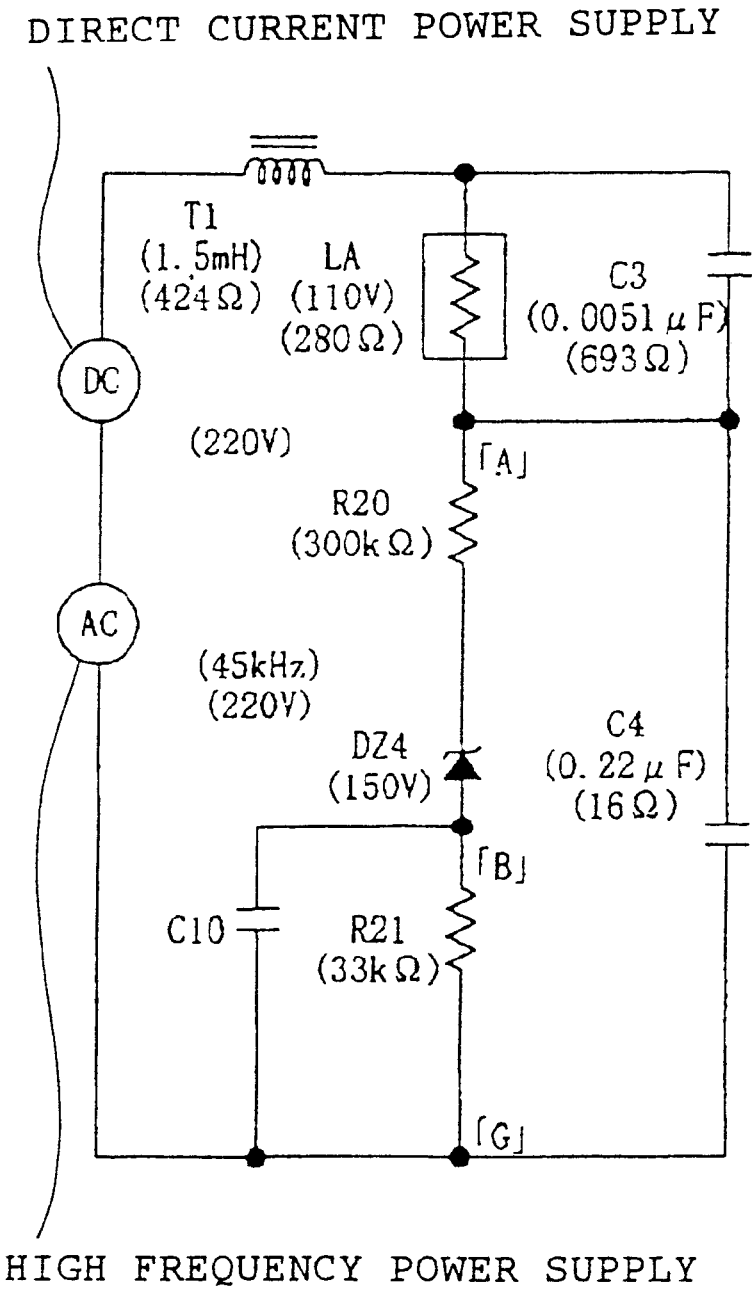
FIG. 10 is an equivalent circuit diagram showing a fully normal lighting state of the discharge lamp lighting apparatus according to the second embodiment of the present invention.
Figure 11:
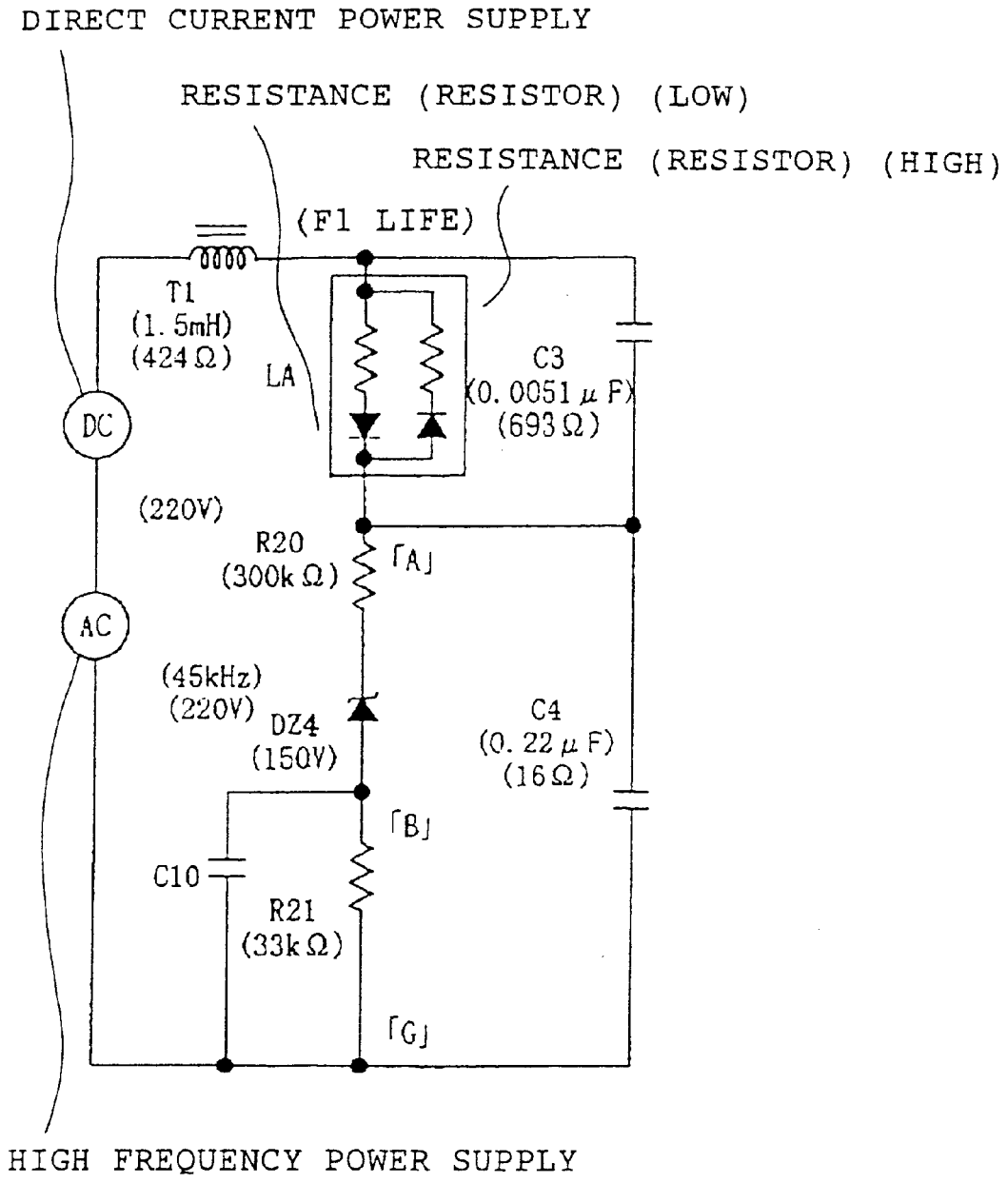
FIG. 11 is an equivalent circuit diagram showing a rectification lighting state of the discharge lamp lighting apparatus according to the second embodiment of the present invention.
Figure 12:
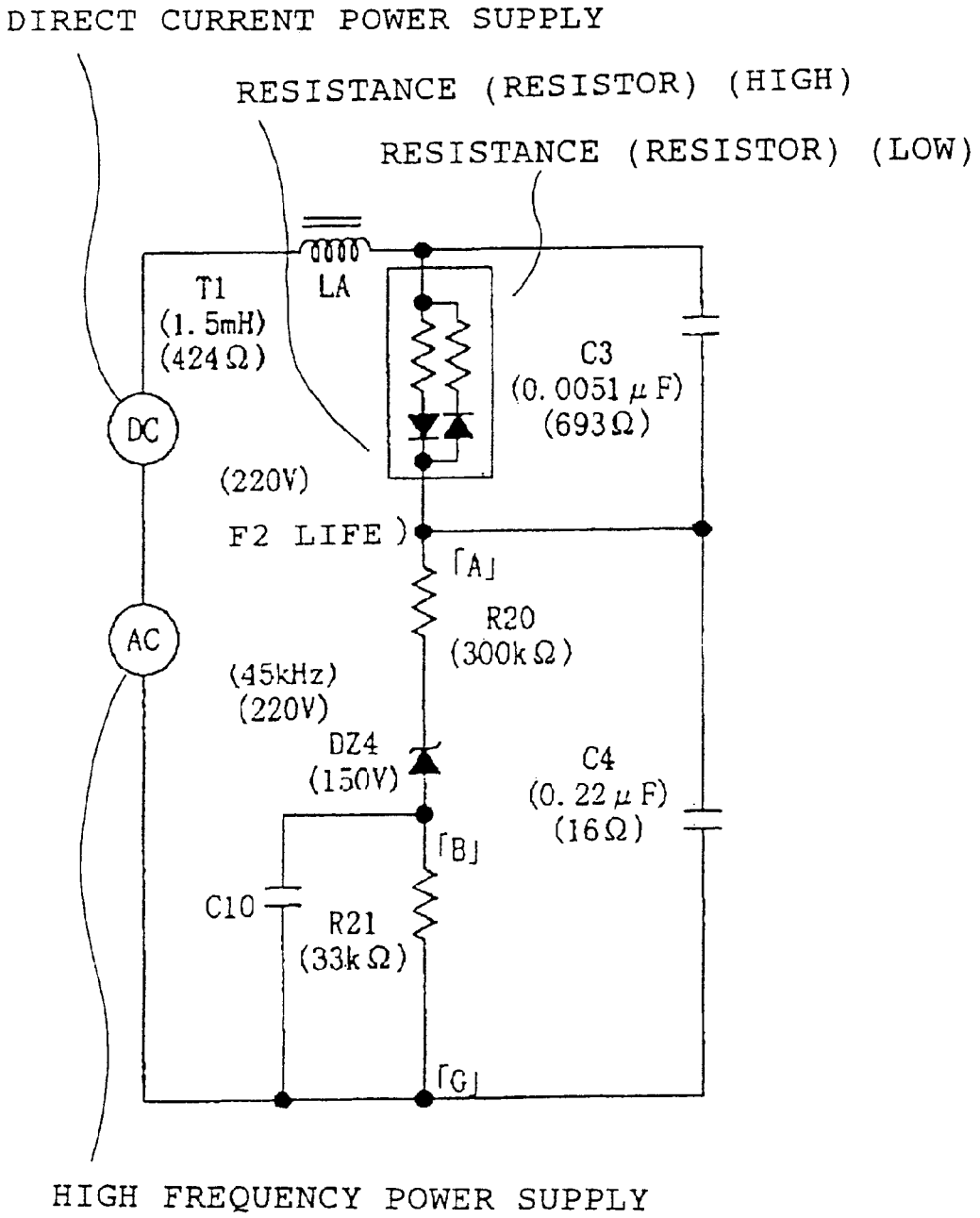
FIG. 12 is an equivalent circuit diagram showing a rectification lighting state of the discharge lamp lighting apparatus according to the second embodiment of the present invention.
Figure 13:
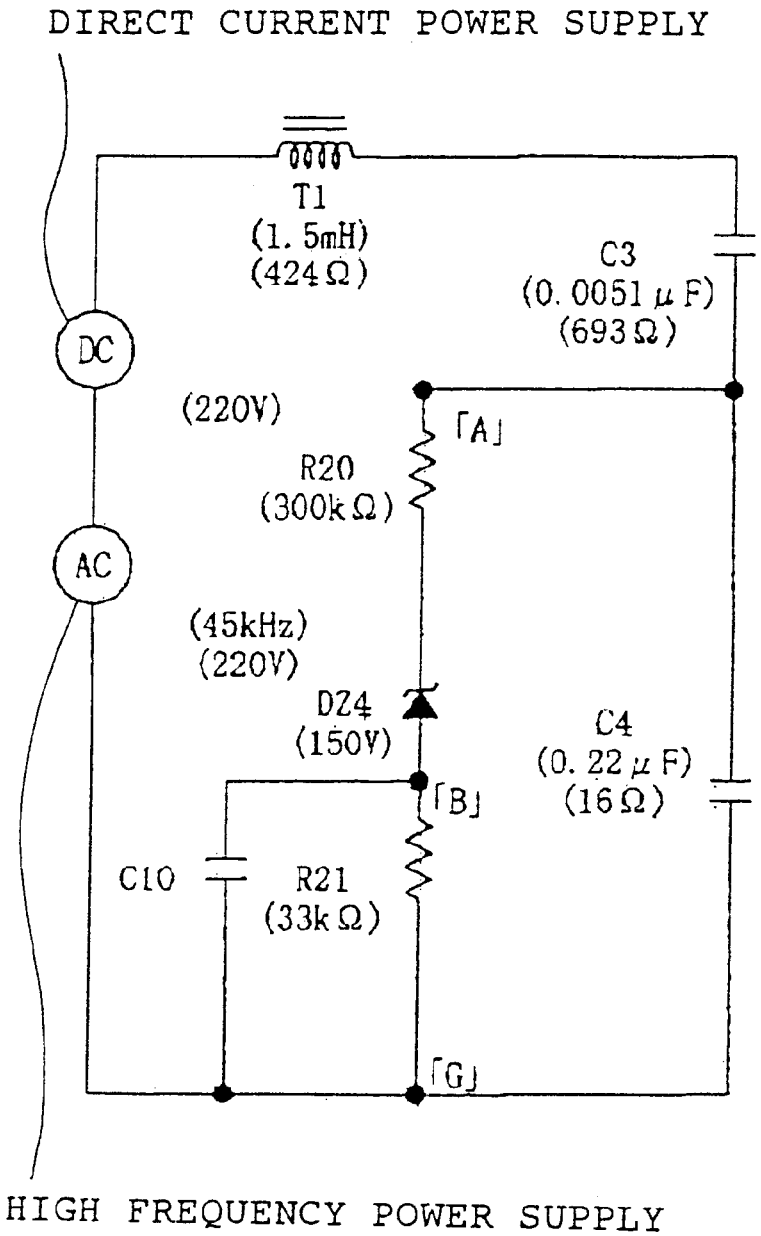
FIG. 13 is an equivalent circuit diagram showing a no-lighting state of the discharge lamp lighting apparatus according to the second embodiment of the present invention.

FIG. 9 is a circuit diagram showing a construction of a discharge lamp lighting apparatus according to a second embodiment of the present invention. This second embodiment is different from the above first embodiment in only construction of the voltage detecting unit VIN of the protective circuit. More specifically, in the above first embodiment, the voltage detecting unit VIN is composed of the detection resistors R10 and R11; on the contrary, according to this second embodiment, in a protective circuit NP3, a voltage is divided by detection resistors R20 and R21 and a constant voltage diode DZ4. In this case, a resistor R22 connected in parallel with the voltage regulation diode DZ4 has a high resistance of several times or more as much as these detection resistors R20 and R21, and further, discharges a charge of the coupling capacitor C4 after the inverter circuit IV stops its oscillation. Even if no resistor R22 is provided, there is no influence in an operation of the protective circuit NP3. Like reference numerals are used to designate the same portion as the first embodiment shown in FIG. 1 or portion corresponding thereto, and the details are omitted.

FIG. 10 to FIG. 13 exemplify equivalent circuit diagrams of a discharge lamp load circuit LAC1 and a voltage detecting unit VIN of the protective circuit NP3 in each load state of a normal full lighting state (FIG. 10), a rectification lighting 1 state (an electrode F1 is in the end of life) (FIG. 11), a rectification lighting 2 state (an electrode F2 is in the end of life) (FIG. 12), and a no-lighting state or no-load state (FIG. 13), of the discharge lamp lighting apparatus in the second embodiment. In these FIG. 10 to FIG. 13, symbols "A" and "B" express a potential of the coupling capacitor C4 and a potential of the detection resistor R21, respectively, like FIG. 3.

In the same manner as the first embodiment, direct current potentials "A" and "B" in each load state of the discharge lamp LA are calculated from these equivalent circuit diagrams, and the calculated result is as shown in FIG. 14. In FIG. 14, potentials in the case of the above first embodiment and potentials in a case of a reduced lumen output operation described later in the fourth embodiment are set forth together, in order to make a comparison.

As is evident from FIG. 14, the potential "A" of the coupling capacitor C4 becomes the same value in the above first embodiment and this second embodiment. On the other hand, it can be seen in this second embodiment as compared with the first embodiment, that the potential "B" changes more clearly between the normal full lighting state and fault states (rectification lighting 1 state, rectification lighting 2 state, no-lighting state and no-load state) because of a threshold value characteristic of the voltage regulation diode DZ4. Therefore, according to this second embodiment, a voltage on a high threshold value side of the window type comparator composed of the comparator IC2 and IC3 can be set to, for example, 10 V, and a voltage on a low threshold value side thereof can be set to, for example, 4 V. That is, a difference of threshold values of the potential "B" in a normal state and an abnormal state can be set greater than the first embodiment, so that there is another effect that a reliability of the protective circuit can be further improved. Incidentally, a voltage of the voltage regulation diode DZ4 of the protective circuit NP3 is set to the vicinity of the voltage generated in the coupling capacitor C4 during normal lighting of the discharge lamp, the aforesaid operation can be performed more effectively.

As described above, in this second embodiment, the voltage detecting unit VIN of the protective circuit NP3 is composed of the detection resistors R20 and R21 and the voltage regulation diode DZ4. Therefore, the potential "B" can be changed greatly, and even if there is a dispersion in a characteristic value of parts and a lamp characteristic, the protective circuit NP3 continues an oscillation of the inverter circuit IV (without stopping it) during normal lighting of the discharge lamp, and surely stops the oscillation of the inverter circuit IV during abnormal lighting of the discharge lamp. As a result, there is another effect that a reliability is further improved as compared with the first embodiment.

In this second embodiment (FIG. 9), the coupling capacitor C4 is arranged on a negative electrode side of the switching element Q2. The coupling capacitor C4 may be arranged on a positive electrode side of the switching element Q1 so as to detect each voltage of both terminals. Moreover, in FIG. 9, a voltage between both terminals of the coupling capacitor C4 (negative electrode side of direct current power supply E and discharge lamp LA side of coupling capacitor C4) is used as a voltage inputted to the protective circuit NP3. However, the voltage between a positive electrode side of the direct current power supply E and the discharge lamp LA side of coupling capacitor C4 may be detected, for example. In this case, the detection voltage is a resultant voltage of the voltage of the direct current power supply E and the voltage of the coupling capacitor C4, and the voltage of the coupling capacitor C4 is readily detected from the resultant voltage. Substantially, a quasi-direct current voltage between both terminals of the coupling capacitor C4 is detected, so that to obtain the same effect as the above second embodiment can be obtained. Moreover, the coupling capacitor C4 may be composed of a plurality of coupling capacitors to detect a voltage of any of these capacitors. In addition, a capacitor for detection may be provided independently of the coupling capacitor C4. In this manner, various modification examples can be considered as a method of detecting a quasi-direct current voltage generated in the coupling capacitor C4 while maintaining the substantial construction of the above second embodiment.

THIRD EMBODIMENT

Figure 15:
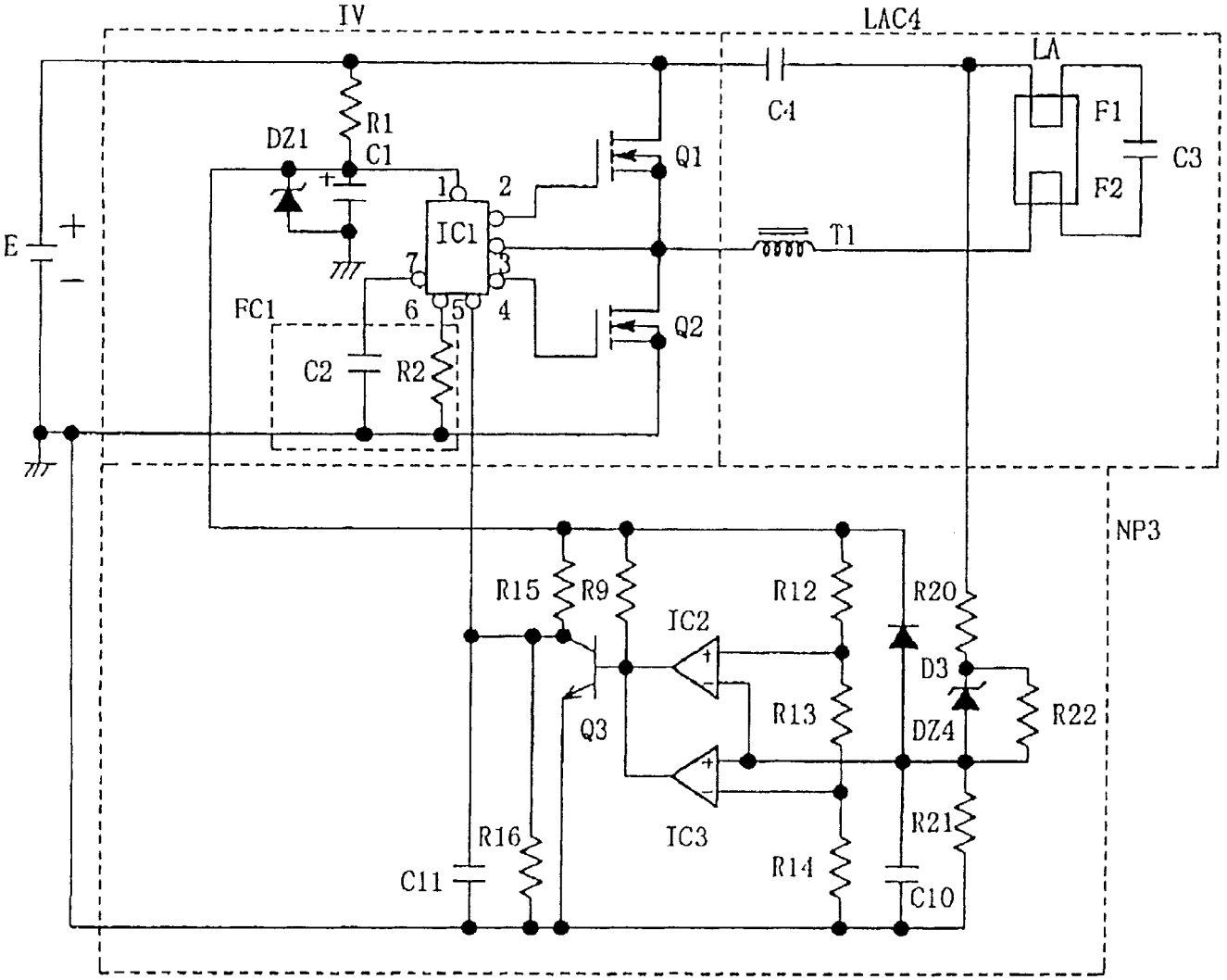
FIG. 15 is a circuit diagram showing a construction of a discharge lamp lighting apparatus according to a third embodiment of the present invention.

FIG. 15 shows a circuit diagram of a discharge lamp lighting apparatus according to a third embodiment of the present invention as one of modification example. In the above second embodiment (FIG. 9), the discharge lamp load circuit LAC1 is connected to both terminals of the switching element Q2 of the inverter circuit IV. On the contrary, in this third embodiment, a discharge lamp load circuit LAC4 is connected to both terminals of the switching element Q1, that is, to a positive electrode side of the direct current power supply E, and a voltage detected by the protective circuit NP3 is set to a voltage between the negative electrode side of the direct current power supply E and the discharge lamp LA side of the coupling capacitor C4. In this case, a detected voltage is a voltage subtracting a voltage of both terminals of the coupling capacitor C4 from a voltage of the direct current power supply E. Even if the above voltage value is used, it is possible to construct a protective circuit in the same manner as the above second embodiment, and further, even if a connecting position of the coupling capacitor C4 and a position of voltage to be detected are variously changed, the same effect as the above second embodiment can be obtained.

FOURTH EMBODIMENT

Figure 16:
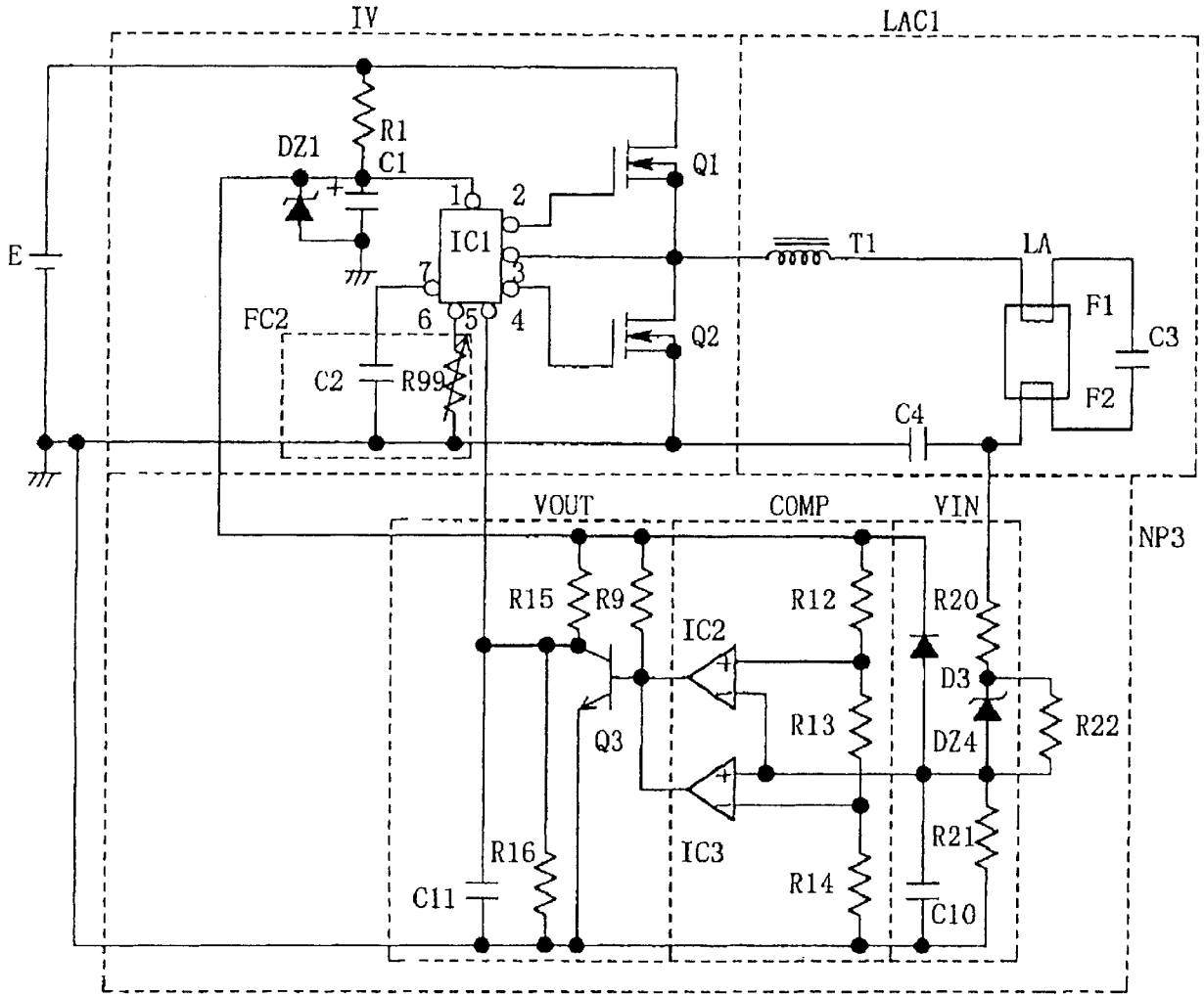
FIG. 16 is a circuit diagram showing a construction of a discharge lamp lighting apparatus according to a fourth embodiment of the present invention.

FIG. 16 shows a circuit diagram of a discharge lamp lighting apparatus according to a fourth embodiment of the present invention. In this fourth embodiment, a function of continuously dimming a discharge lamp LA is added to the above second embodiment. For this purpose, a main oscillation resistor R99 of the frequency control circuit FC2 for determining an oscillation frequency of the IV control circuit IC1 is composed of a variable resistor. In FIG. 16, like reference numerals are used to designate the same portion as FIG. 9 or the portion corresponding thereto, and the details are omitted.

Figure 17:
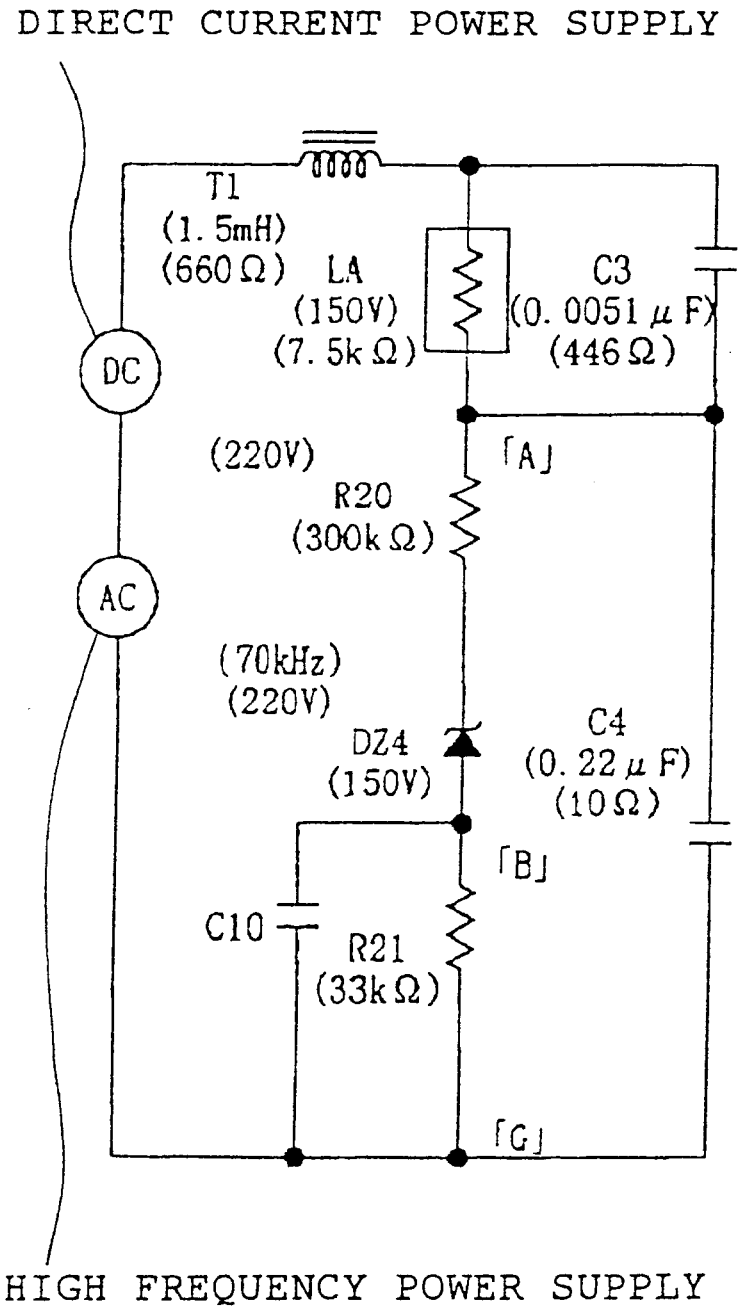
FIG. 17 is an equivalent circuit diagram showing a reduced lumen output lighting state of the discharge lamp lighting apparatus according to the fourth embodiment of the present invention.

The following is a description on an operation of this fourth embodiment. In FIG. 16, when the IV control circuit IC1 is oscillating, the terminal 6 of the IV control circuit IC1 has a constant direct current voltage. The IV control circuit IC1 has a characteristic such that an oscillation frequency becomes higher in the case when a current flowing to a negative electrode of the direct current power supply E from the terminal 6 increases. Therefore, when the variable resistor R99 gradually decreases from a state that the discharge lamp LA is fully lighting, a current flowing to a negative electrode of the direct current power supply E from the terminal 6 increases. As a result, an oscillation frequency of the IV control circuit IC1 becomes gradually high, and then, an impedance of the ballast chock T1 becomes large, so that a current of the discharge lamp LA decreases, and then, a light is reduced. FIG. 17 shows an equivalent practical circuit of the discharge lamp load circuit LAC1 and the voltage detecting unit VIN of the protective circuit NP3 in a reduced lumen output normal lighting state. As shown in the equivalent circuit diagram of FIG. 17, in this case, a switching frequency is increased to 70 kHz by a reduced lumen output operation, and an equivalent resistance value of the discharge lamp LA is consequently increased 27 times as much as the normal full lighting state, that is, to 7.5 KΩ. As the resistance value of the detection resistors R20 and R21 is set to a sufficient by high value with respect to the resistance 7.5 KΩ, the potentials "A" and "B" of the coupling capacitor C4 and the detection resistor R11 in the reduced lumen output lighting state are 218 V and 7 V, that is, they hardly change from 220 V and 7 V in the normal full lighting state as shown in FIG. 14. Thus, these potentials become the substantially same voltage as the normal full lighting state.

As described above, even if the equivalent resistance value of the discharge lamp LA changes from hundreds of Ω to several KΩ or tens of KΩ by a dimming operation during the normal lighting of the discharge lamp LA, the potential "B" to be detected has almost no change. Therefore, the protective circuit NP3 is applicable to the discharge lamp lighting apparatus having a dimming function. Further, the potential "B" has a great change with normal and abnormal states of the discharge lamp LA so that there is an effect that a protective circuit and a discharge lamp lighting apparatus having a high reliability can be obtained in the same way as the above first and second embodiments. Furthermore, a circuit constant of the protective circuit NP3 can be set to the same, regardless of a kind of the discharge lamp LA and the presence of dimming function, so that there is an advantage that components can be standardized in various discharge lamp lighting apparatuses.

Figure 18:
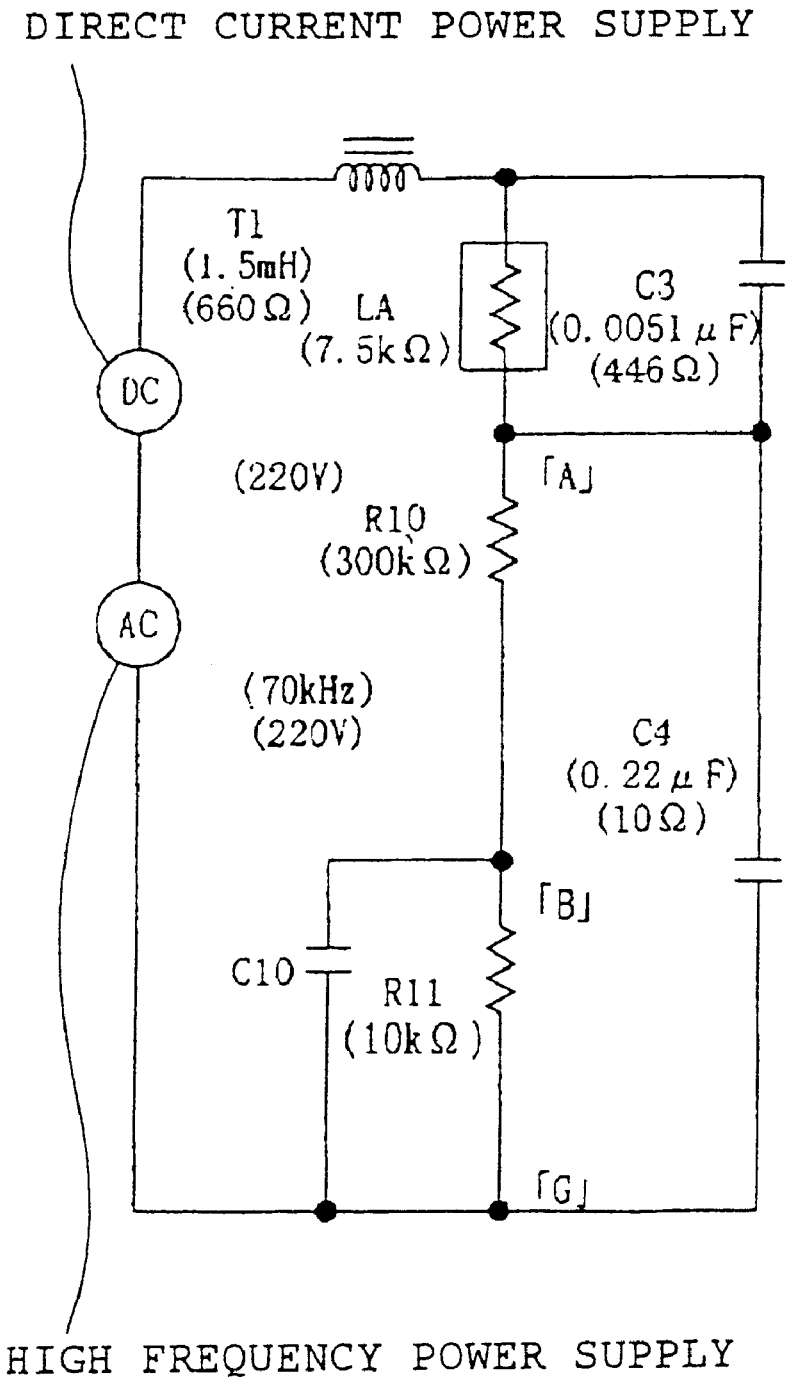
FIG. 18 is an equivalent circuit diagram showing a reduced lumen output lighting state of the discharge lamp lighting apparatus according to the first embodiment of the present invention.

FIG. 18 shows an equivalent circuit diagram in the case where the resistor R2 is replaced with a variable resistor to carry out a reduced lumen output operation in the first embodiment. In this case, the potentials "A" and "B" are 215 V and 7 V, that is, they hardly change from 220 V and 7 V in the normal full lighting state as shown in FIG. 14. Therefore, the same effect as the above fourth embodiment can be obtained.

FIFTH EMBODIMENT

Figure 19:
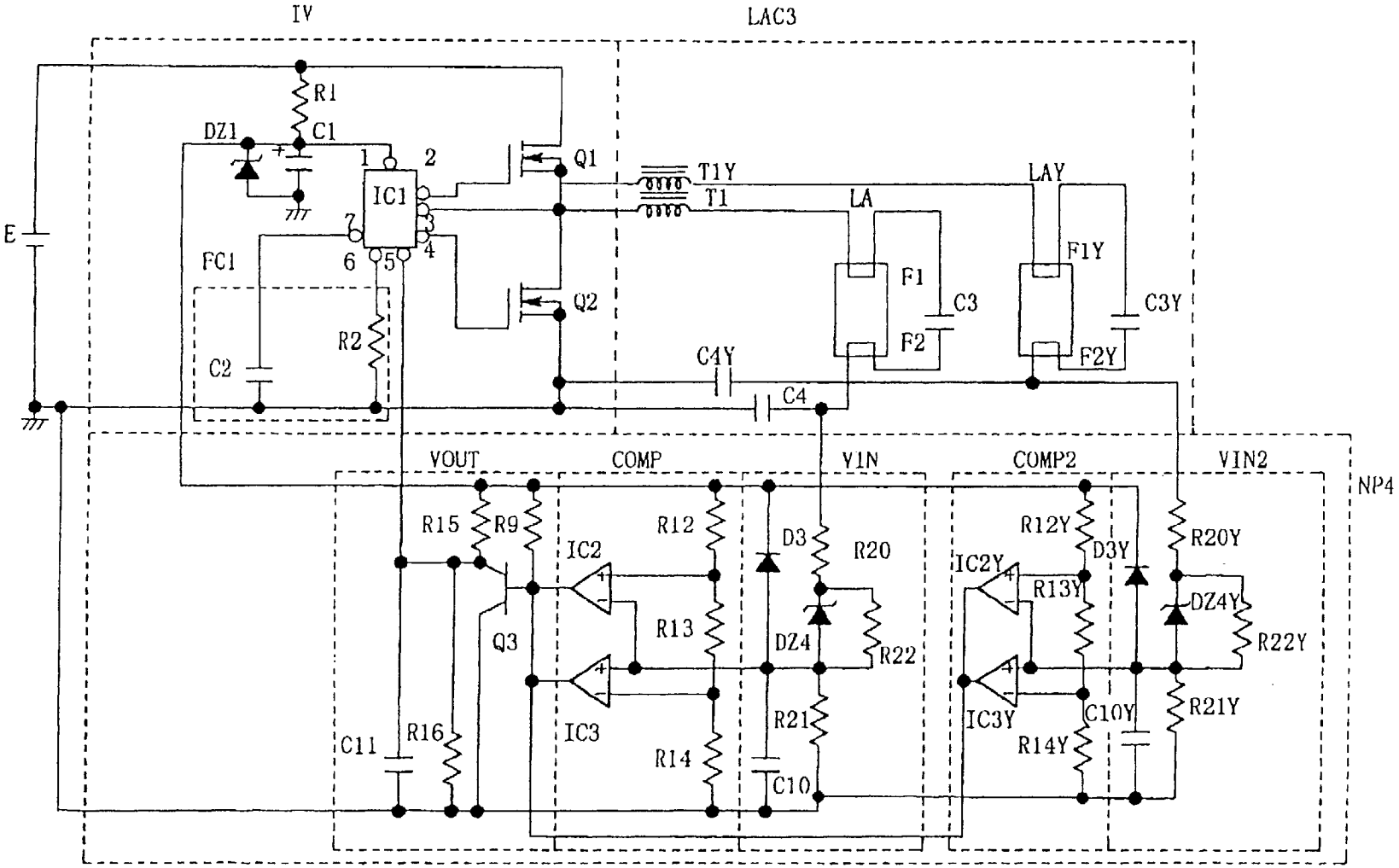
FIG. 19 is a circuit diagram showing a construction of a discharge lamp lighting apparatus according to a fifth embodiment of the present invention.

FIG. 19 is a circuit diagram of a discharge lamp lighting apparatus according to a fifth embodiment of the present invention. In this fifth embodiment, to form a discharge lamp load circuit LAC3, a discharge lamp load circuit comprising a discharge lamp LAY (parallel with a starting capacitor C3Y), a coupling capacitor C4Y and a ballast chock T1Y is connected in parallel to a discharge lamp load circuit of the above second embodiment comprising the discharge lamp LA (parallel with the starting capacitor C3), the coupling capacitor C4 and the ballast chock T1. In accordance with this construction, a protective circuit NP4 includes two detecting units consisting of a voltage detecting unit VIN (detection resistor R21, voltage regulation diode DZ4, detection resistor R21) and a voltage detecting unit VIN2 (detection resistor R21Y, voltage regulation diode DZ4Y, detection resistor R21Y), and two comparator units consisting of a comparator unit COMP (comparators IC2 and IC3 and reference resistors R12, R13 and R14) and a comparator unit COMP2 (comparators IC2Y and IC3Y and reference resistors R12Y, R13Y and R14Y). Outputs from these two comparator units are inputted to a single control signal output unit VOUT, and then, the control signal output unit VOUT puts them together to output one control signal to the terminal 5 of the IV control circuit IC1. Like reference numerals are used to designate the same portion as the above second embodiment or a portion corresponding thereto, and the details are omitted.

The following is a description on an operation of the fifth embodiment. In FIG. 19, when both discharge lamps LA and LAY are normally lighting, outputs of the comparators IC2, IC3, IC2Y and IC3Y all become HIGH in the same manner as the second embodiment. Consequently, the transistor Q3 is turned on so that the protective circuit NP4 outputs no oscillation stop signal to let the discharge lamps LA and LAY continue normal lighting. On the other hand, when any of discharge lamps LA and LAY is in a fault state, a detection voltage outputted from the voltage detecting unit connected to each discharge lamp load circuit is compared with reference voltages by the comparators IC2 and IC3 or IC2Y and IC3Y, and then, any of these outputs becomes LOW. Consequently, the transistor Q3 is turned off so that the protective circuit NP4 outputs an oscillation stop signal to the IV control circuit IC1 to stop an oscillation of the inverter circuit IV.

As described above, according to this fifth embodiment, the voltage detecting units VIN and VIN2 are connected to respective one of the plurality of discharge lamp load circuits. Therefore, the oscillation of the inverter circuit IV is stopped at the point of time when any of discharge lamps is in a fault state, so that there is an effect that the above protective circuit is applicable to a two-lamp parallel lighting circuit of the discharge lamps LA and LAY.

Further, since the comparator units COMP and COMP2 are connected to the voltage detecting units VIN and VIN2, respectively, reference voltages of the comparator units COMP and COMP2 can be set in accordance with the characteristic of each discharge lamp load circuit. Thus, there is an effect to perform precise setting.

Furthermore, a single control signal output unit VOUT is provided with respect to a plurality of the voltage detecting units VIN and VIN2 and the comparator units COMP and COMP2, and the outputs from the plurality of the comparator units COMP and COMP2 are put together to output a control signal. Therefore, there is an effect to reduce the number of the control signal output units VOUT.

Though, FIG. 19 shows the case where the discharge lamp load circuit is two, the protective circuit is, of course, applicable to a plural parallel lighting circuit for three or more discharge lamps.

SIXTH EMBODIMENT

Figure 20:
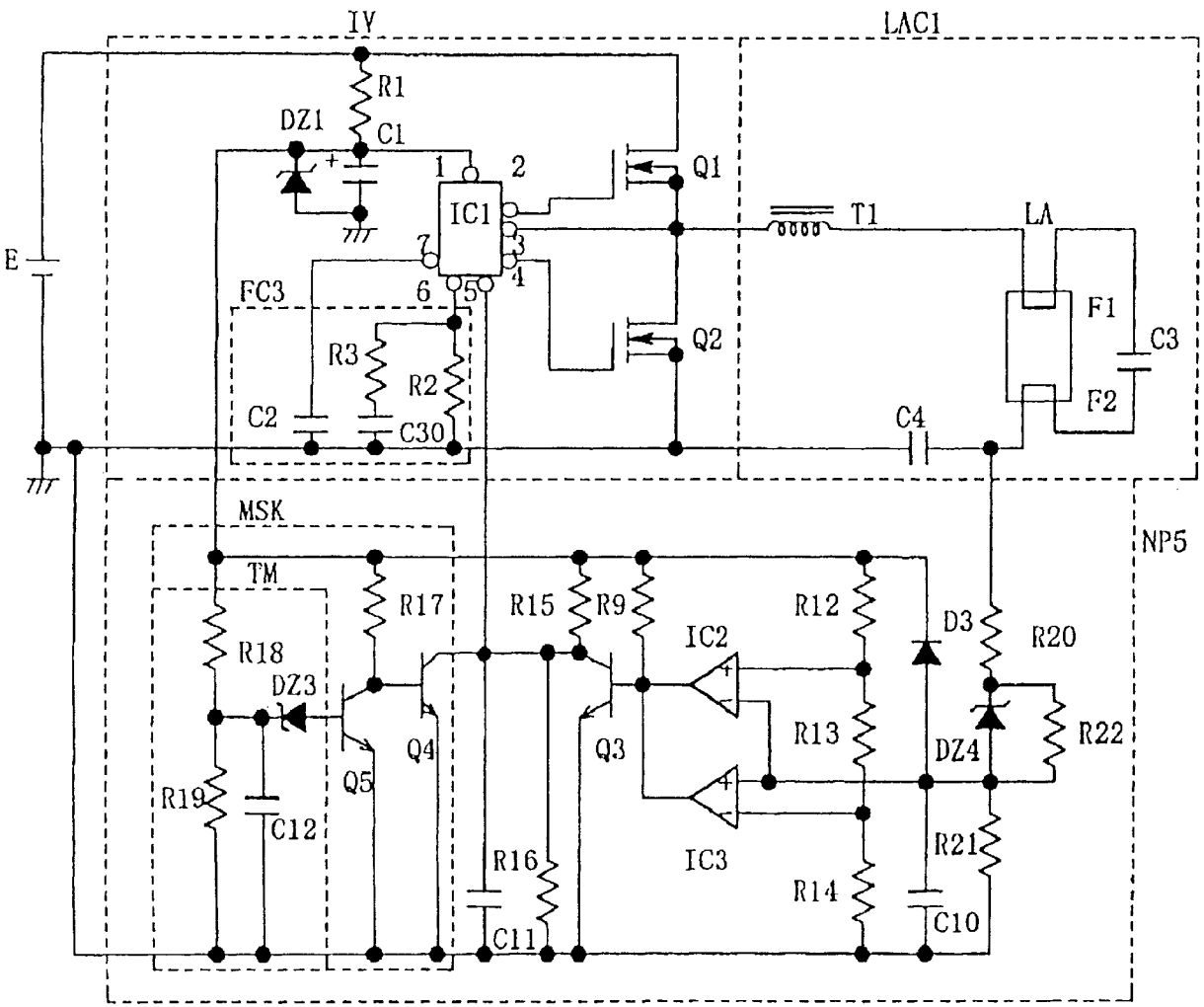
FIG. 20 is a circuit diagram showing a construction of a discharge lamp lighting apparatus according to a sixth embodiment of the present invention.

FIG. 20 is a circuit diagram of a discharge lamp lighting apparatus according to a sixth embodiment of the present invention. In this sixth embodiment, the protective circuit of the above second embodiment is provided with a mask circuit MSK which masks a function of the protective circuit for a predetermined time after the discharge lamp lighting apparatus is turned on. For example, the above protective circuit is applicable to a discharge lamp lighting apparatus which preheats an electrode of the discharge lamp LA for a predetermined time, and thereafter, lights the discharge lamp LA. The mask circuit MSK and a frequency control circuit FC3 which are constituent components characterizing this sixth embodiment will be mainly described below. Like reference numerals are used to designate the same portion as the above second embodiment (FIG. 9) or the portion corresponding thereto, and the details are omitted.

As shown in FIG. 20, in this sixth embodiment, the frequency control circuit FC3 includes a series circuit comprising a preheat oscillation resistor R3 and a preheat oscillation capacitor 30 between the terminal 6 of the IV control circuit IC1 and the negative electrode of the direct current power supply E, in addition to a main oscillation resistor R2 and an oscillation capacitor C2. Moreover, a protective circuit NP5 includes a mask circuit MSK having a timer circuit TM composed of resistors R18 and R19, a capacitor C12 and a voltage regulation diode DZ3. The mask circuit MSK includes a transistor Q4 which is connected between the oscillation stop terminal 5 of the IV control circuit IC1 and the negative electrode of the direct current power supply E. An input terminal of the transistor Q4 is connected with an output terminal of a transistor Q5 which is driven by an output of the timer circuit TM. When the discharge lamp lighting apparatus is turned on, the capacitor C12 is charged via the resistors R1 and R18, and at the point of time when a voltage of the capacitor C12 exceeds a Zener voltage of the constant voltage diode DZ3 after a predetermined time, the transistor Q5 is turned on to turn off the transistor Q4. In order to drive the timer circuit TM, a positive electrode side of the resistor R18 is connected to the control power supply capacitor C1, and further, in order to drive the transistor Q4, the resistor R17 is connected between the control power supply capacitor C1 and a base of the transistor Q4.

Figure 21:
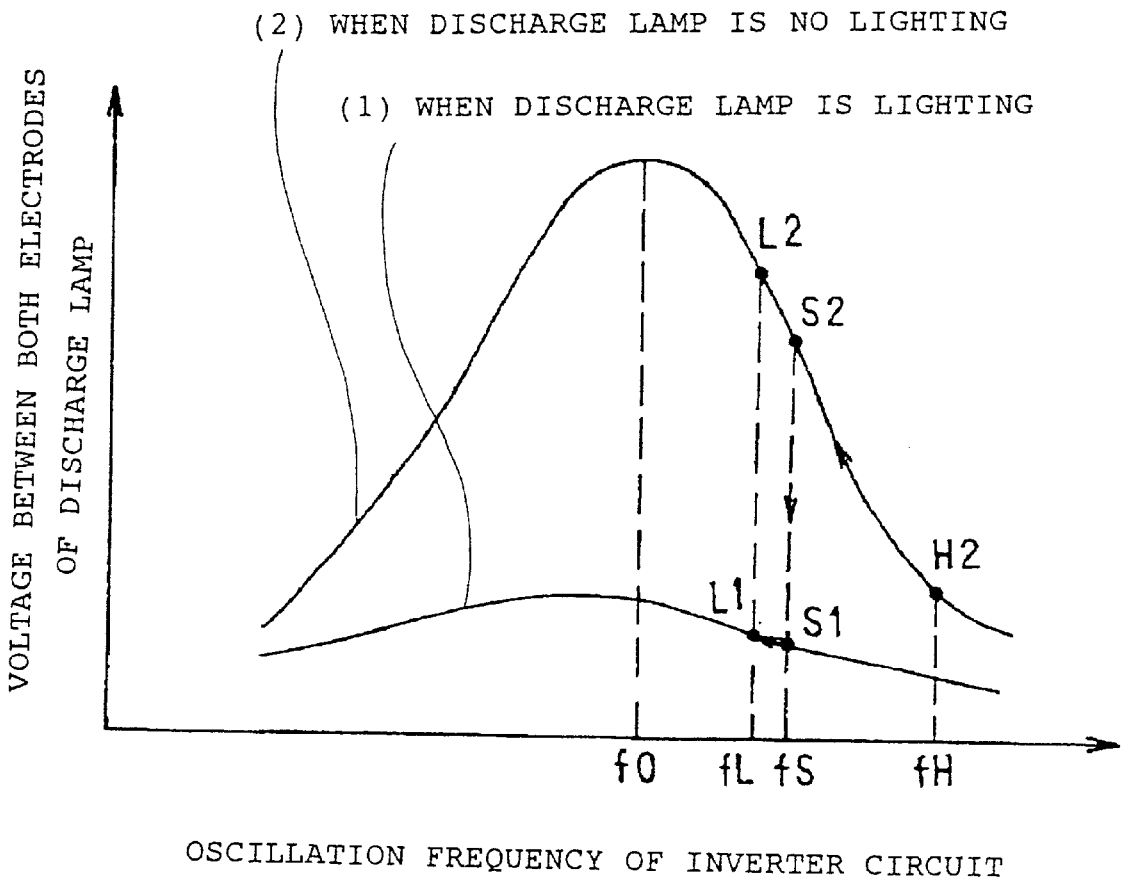
FIG. 21 is a view showing an LC serial resonance curve showing a circuit operation of the discharge lamp lighting apparatus according to the sixth embodiment of the present invention.
Figure 22:
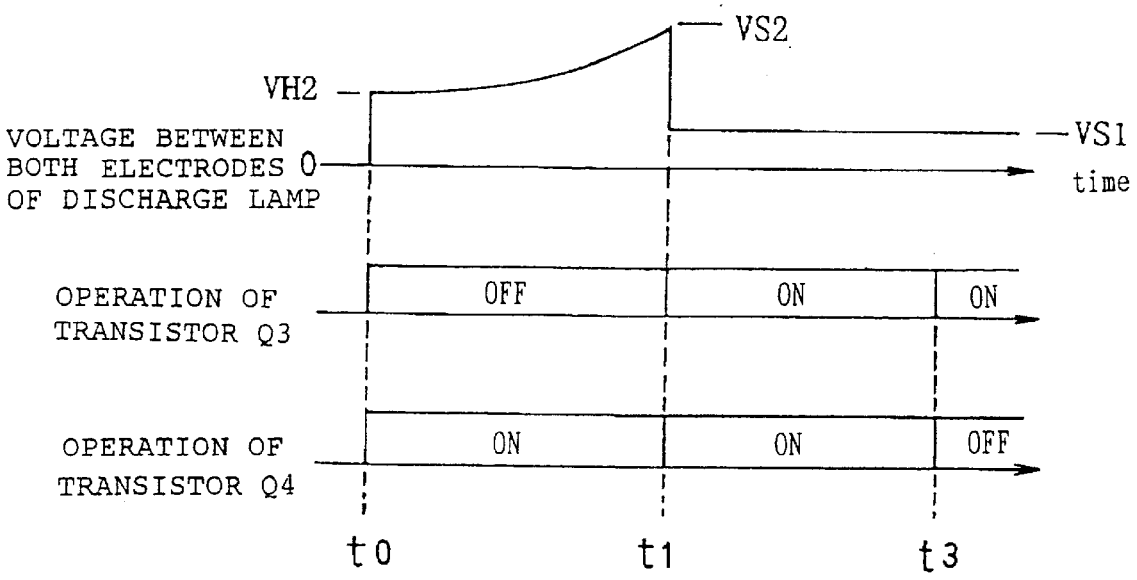
FIG. 22 is a view showing a lamp voltage waveform showing a circuit operation of the discharge lamp lighting apparatus according to the sixth embodiment of the present invention and a transistor operation.
Figure 23:
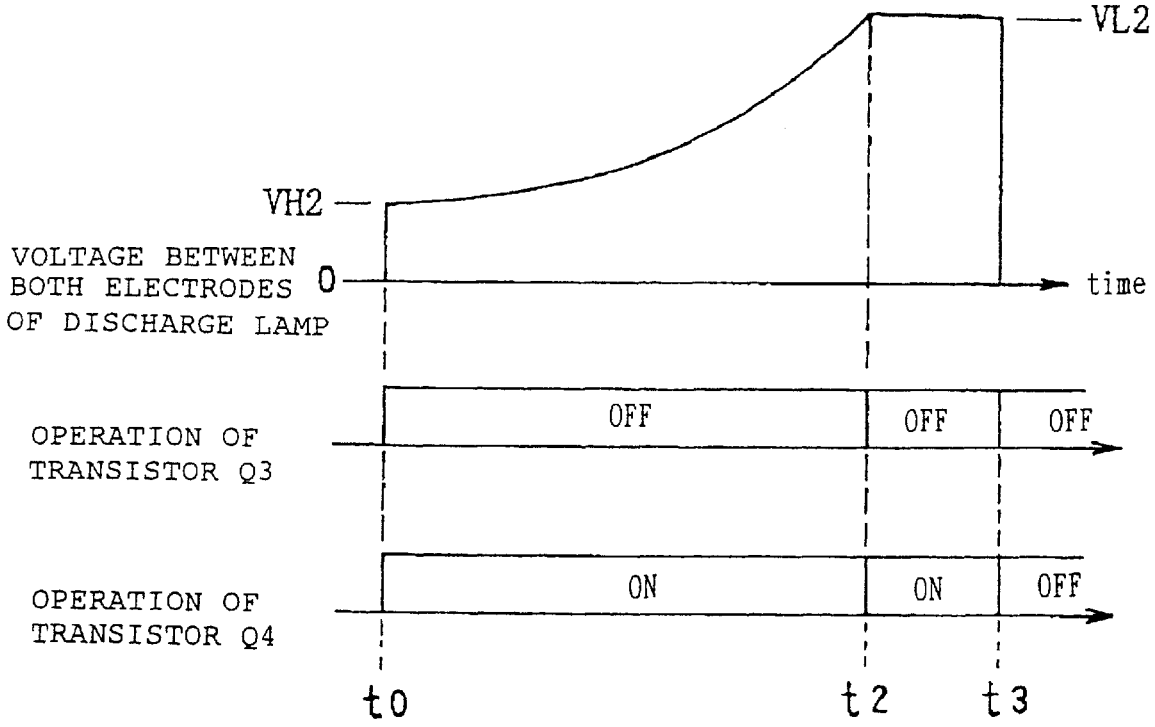
FIG. 23 is a view showing a lamp voltage waveform showing a circuit operation of the discharge lamp lighting apparatus according to the sixth embodiment of the present invention and a transistor operation.

Next, with reference to FIG. 20 to FIG. 23, an operation of the mask circuit MSK and the frequency control circuit FC3 in this sixth embodiment will be described below. FIG. 21 is a diagram showing an LC series resonance curve of the ballast chock T1 and the starting capacitor C3 in the discharge lamp load circuit LAC1. In FIG. 21, (1) is a resonance curve at the time when the discharge lamp LA is lighting, and (2) is a resonance curve at the time when the discharge lamp LA is no-lighting. FIG. 22 and FIG. 23 show a time change of voltage between both electrodes of the discharge lamp LA after turning on the direct current power supply E, in the cases where the discharge lamp LA is normally lighting and no-lighting, and each operation of transistors Q3 and Q4, respectively.

First, in FIG. 20, when the inverter circuit IV is connected to the direct current power supply E and a charged voltage of the control power supply capacitor C1 reaches an oscillation starting voltage of the IV control circuit IC1, the IV control circuit IC1 starts its oscillation. At this time, the terminal 6 of the IV control circuit IC has a constant direct current voltage, and a current flows out from the terminal 6 via the main oscillation resistor R2 and the preheat oscillation resistor R3. However, a current via the preheat oscillation resistor R3 charges a preheat oscillation capacitor C30, and then, the charge decreases with an elapsed time, and becomes zero after about 3 seconds, for example. By the way, the IV control circuit IC1 has a characteristic such that the more the flowing out current from the terminal 6 is, the higher an oscillation frequency becomes. Thus, with a decrease of the flowing out current from the terminal 6, the IV control circuit IC1 first starts an oscillation at a high frequency, and then, is controlled so that the oscillation frequency is gradually lowered to a predetermined frequency.

A change of oscillation frequency of the IV control circuit IC1 and a change of resonance voltage between both electrodes of the discharge lamp LA will be described below with reference to FIG. 21 and FIG. 22. The direct current power supply E is turned on, and thereafter, an oscillation frequency at the time when the IV control circuit IC1 first oscillates after turning on the direct current power supply is designed so as to be controlled to a frequency range higher than a resonance frequency f0 of the ballast chock T1 and the starting capacitor C3. Therefore, the direct current power supply E is turned on, and thereby, the discharge lamp lighting apparatus starts an oscillation at a time t0, at a frequency fH, and at an operating point H2. On the other hand, a voltage between both electrodes of the discharge lamp LA at this time is designed so as to become a voltage VH2 lower than a starting voltage VS2 of the discharge lamp LA. Therefore, the discharge lamp LA is no lighting, and the electrodes F1 and F2 are preheated by a resonance current flowing through electrodes F1 and F2 of the discharge lamp LA.

Thereafter, when the oscillation frequency of the IV control circuit IC1, that is, a switching frequency of the switching elements Q1 and Q2 gradually becomes low, a voltage between both electrodes of the discharge lamp LA gradually rises up along a resonance curve for no lighting of the discharge lamp LA. When the voltage between both electrodes of the discharge lamp LA reaches VS2 at the time t1, and at an operating point S2 of the frequency fS, the discharge lamp LA starts (thus, a time from t0 to t1 is a preheat time). When the discharge lamp LA starts lighting, an impedance of the discharge lamp LA changes, and at the same time with the start, the operating point is shifted from S2 to S1 on the resonance curve for lighting of the discharge lamp, so that the voltage between both electrodes of the discharge lamp LA is lowered to VS1. Thereafter, the frequency is lowered to an fL which is a steady state, in response to lowering of the oscillation frequency of the IV control circuit IC1, and then, the discharge lamp LA continues lighting by a predetermined lamp current determined by an impedance of the ballast chock T1.

On the other hand, the entire operation of the protective circuit NP5 is as shown in FIG. 22. More specifically, a duration from the time t0 when the direct current power supply E is turned on to the starting time t1 of the discharge lamp LA is subject to a no-lighting state as described in the above second embodiment so that the transistor Q3 is turned off. Until the capacitor C12 of the timer circuit TM is charged to a predetermined voltage, the transistor Q5 is in an off state, and the transistor Q4 is in an on state so that a potential of the terminal 5 is kept at a low potential. In the case where there is no mask circuit MSK, the transistor Q3 is turned off during preheat, and the protective circuit NP5 outputs an oscillation stop signal to the IV control circuit IC1 so as to prevent the discharge lamp LA from lighting. However, according to this sixth embodiment, as the potential of the terminal 5 is kept at a low potential by the mask circuit MSK even during preheat, no oscillation stop signal is outputted to the terminal 5 of the IV control circuit IC1 from the protective circuit NP5, so that the discharge lamp LA can be lit at the time t1 without hindrance.

The capacitor C12 is charged by a current of closed loop consisting of the control power supply capacitor C1→the resistor R18→the capacitor C12→the control power supply capacitor C1. When a charged voltage of the capacitor C12 reaches a Zener voltage of the voltage regulation diode DZ3 at the time t3, the transistor Q5 is turned on and the transistor Q4 is turned off (therefore, the time from t0 to t3 is a mask time of the protective circuit NP5 by the mask circuit MSK, and the mask time is set longer than the above preheat time). However, the discharge lamp LA is already lighting at the time t3, and this state corresponds to the normal full lighting state as described in the above second embodiment. Therefore, the transistor Q3 is turned on, and no oscillation stop signal is outputted from the protective circuit NP5; as a result, a lighting state is continued.

Meanwhile, in the case where the discharge lamp LA is not lighting because of being in the end of life or being defective, in FIG. 21, the oscillation frequency of the IV control circuit IC1 lowers from an initial oscillation frequency to a steady state frequency as fH→fS→fL, and the operating point is shifted as H2→S2→L2 in accordance with lowering of the frequency. The voltage between both electrodes of the discharge lamp LA rises from VH2 to VL2 during the time from t0 to t2, and thereafter, becomes constant as shown in FIG. 23. For the duration, a state of the discharge lamp load circuit LAC1 corresponds to the no-lighting state as described in the above second embodiment; therefore, the transistor Q3 of the protective circuit NP5 is in an off state. However, in the case of no-lighting state, the transistor Q3 keeps an off state even after the time t2. Therefore, at the time t3 when a mask time of the mask circuit MSK is completed, the transistor Q4 is turned off, and, at the same time, the protective circuit NP5 outputs an oscillation stop signal to the terminal 5 of the IV control circuit IC1. As a result, an oscillation of the inverter circuit IV is stopped so as to shut off an over resonance current from continuously flowing through the ballast chock T1 and the starting capacitor C3.

As described above, in this sixth embodiment, the protective circuit NP5 is additionally provided with the mask circuit which masks the protective circuit NP5 so as to output no oscillation stop signal for a predetermined time from the time when the direct current power supply E is turned on. Therefore, there are effects that the protective circuit NP5 is applicable to a discharge lamp lighting apparatus having a function of lighting the discharge lamp LA after preheating of the electrodes F1 and F2, and lighting of a non-defective discharge lamp can be secured, and a discharge lamp lighting apparatus which can securely stop an oscillation in a fault state can be obtained.

The mask time is set by the above-mentioned timer circuit, or by another method in which, for example, the lighting state of the discharge lamp LA is detected by an output state of the comparator IC2 and IC3, and then, a mask function is released in synchronous with the detection result.

SEVENTH EMBODIMENT

Figure 24:
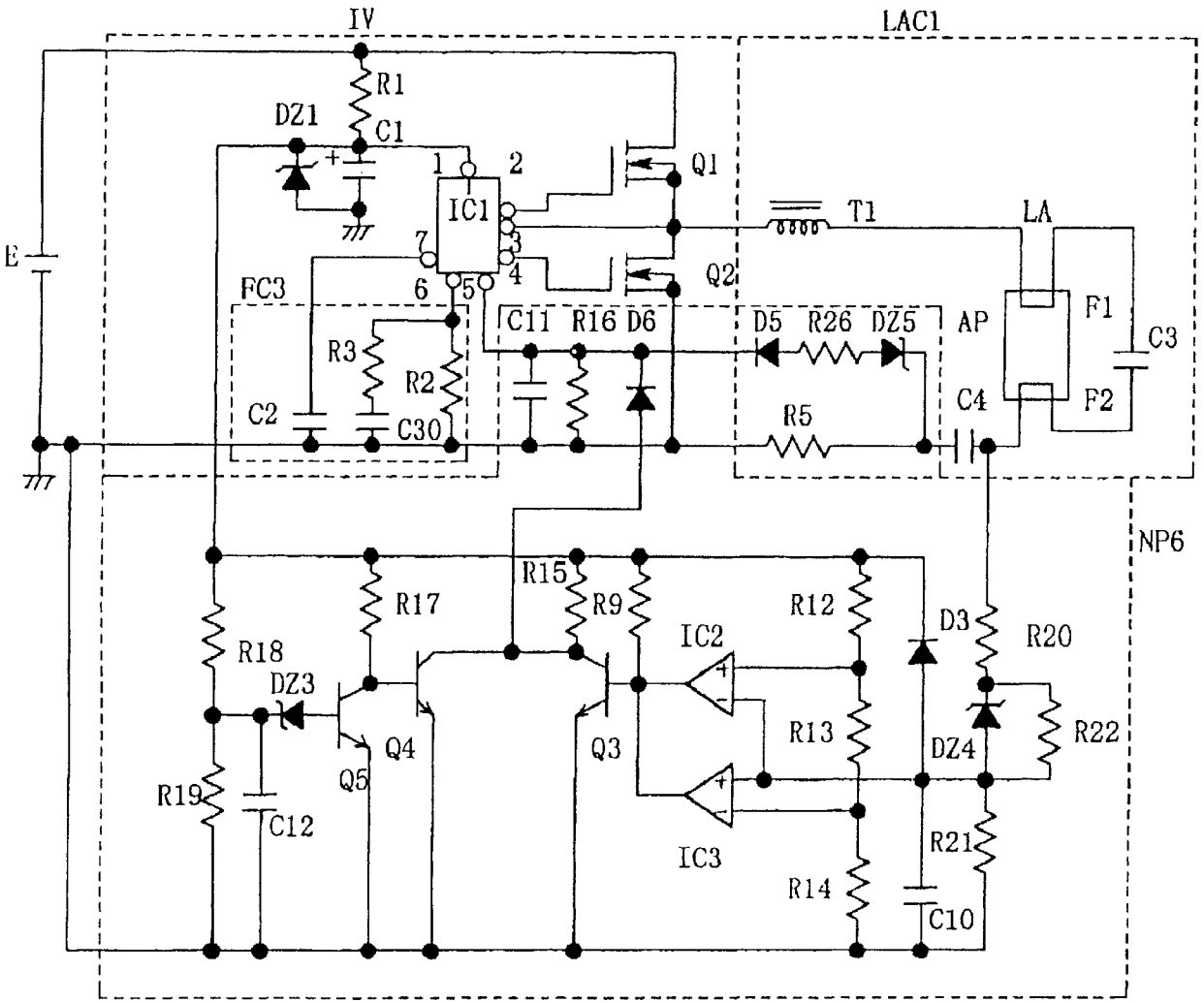
FIG. 24 is a circuit diagram showing a construction of a discharge lamp lighting apparatus according to a seventh embodiment of the present invention.

FIG. 24 is a circuit diagram of a discharge lamp lighting apparatus according to a seventh embodiment of the present invention. In this seventh embodiment, the discharge lamp lighting apparatus of the above sixth embodiment is further provided with an over resonance detection circuit AP which detects a high frequency current flowing through the discharge lamp load circuit LAC1 so as to detect faults. By doing so, for example, even in a discharge lamp lighting apparatus which is so constructed that a control range of oscillation frequency of the inverter circuit IV passes a resonance frequency f0 of the ballast chock T1 and the starting capacitor C3, or approaches the resonance frequency f0, the discharge lamp lighting apparatus can securely light the discharge lamp LA and detect the faults more precisely. Like reference numerals are used to designate the same portion as the above sixth embodiment (FIG. 20) or the portion corresponding thereto, and the details are omitted.

As shown in FIG. 24, in this seventh embodiment, an over resonance detection circuit AP is additionally interposed between the terminal 5 of the IV control circuit IC1 and the negative electrode of the direct current power supply E. The over resonance detection circuit AP is composed of a detection resistor R5 of about 1Ω connected between the coupling capacitor C4 and the negative electrode of the direct current power supply E, and a series circuit comprising a voltage regulation diode DZ5, a resistor 26 and a diode D5 which are connected between a connecting portion of the detection resistor R5 and the coupling capacitor C4 and the terminal 5 of the IV control circuit IC1. Moreover, in a protective circuit NP6, a diode D6 for separating the protective circuit NP6 from the over resonance detection circuit AP is connected between the terminal 5 of the IV control circuit IC1 and a collector of the transistor Q3.

Figure 25:
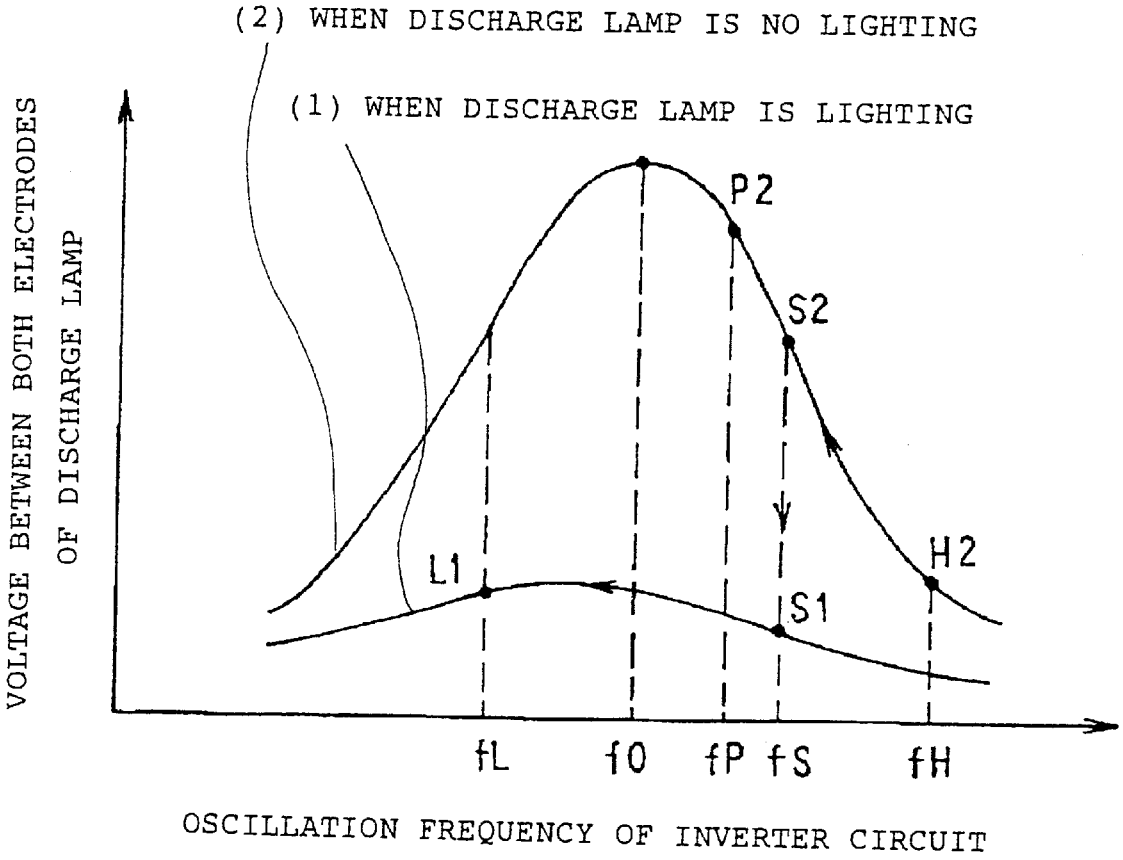
FIG. 25 is a view showing an LC serial resonance curve showing a circuit operation of the discharge lamp lighting apparatus according to the seventh embodiment of the present invention.

An operation of the protective circuit NP6 and the over resonance detection circuit AP will be described below with reference to FIG. 24 and FIG. 25 showing a LC series resonance curve of this seventh embodiment. In FIG. 24 and FIG. 25, the inverter circuit IV is connected to the direct current power supply E, and when a charged voltage of the control power supply capacitor C1 reaches an oscillation starting voltage of the IV control circuit IC1, like the above sixth embodiment, the IV control circuit IC1 starts its oscillation at a frequency fH and at the operating point H2. When the frequency gradually lowers in accordance with decrease of a flowing out current from the terminal 6, a voltage between both electrodes of the discharge lamp LA rises along an LC series resonance curve for no-lighting of the discharge lamp, and for the duration, the electrodes F1 and F2 of the discharge lamp LA are preheated. Then, when the voltage between both electrodes of the discharge lamp LA reaches the starting voltage at a frequency fS, the discharge lamp LA starts up, and simultaneously, the operating point is shifted from S2 to S1 on the resonance curve for lighting of the discharge lamp. Thereafter, the frequency further passes through f0 which is a resonance frequency, and then, gradually lowers to fL which is an operating point, and thus, at the operating point L1, the discharge lamp LA is continuously lit by a predetermined lamp current determined by an impedance of the ballast chock T1. In the above operation, the protective circuit NP6 of this seventh embodiment includes a mask circuit as the sixth embodiment, so that no oscillation stop signal is outputted until the discharge lamp LA starts lighting.

The above is a description on the case where the discharge lamp is lighting. In the discharge lamp lighting apparatus which is so constructed that a control range of oscillation frequency of the inverter circuit IV passes a resonance frequency f0 of the ballast chock T1 and the starting capacitor C3, or approaches the resonance frequency f0, for example, in the case where the discharge lamp LA is no lighting because of being in the end of life or being defective, the operating point rises along a resonance curve for no-lighting of the discharge lamp, and a resonance voltage and a resonance current between the electrodes F1 and F2 of the discharge lamp LA becomes excessive around the resonance frequency f0, so that there is a problem that the discharge lamp LA and parts of the discharge lamp load circuit are broken down.

Figure 26:
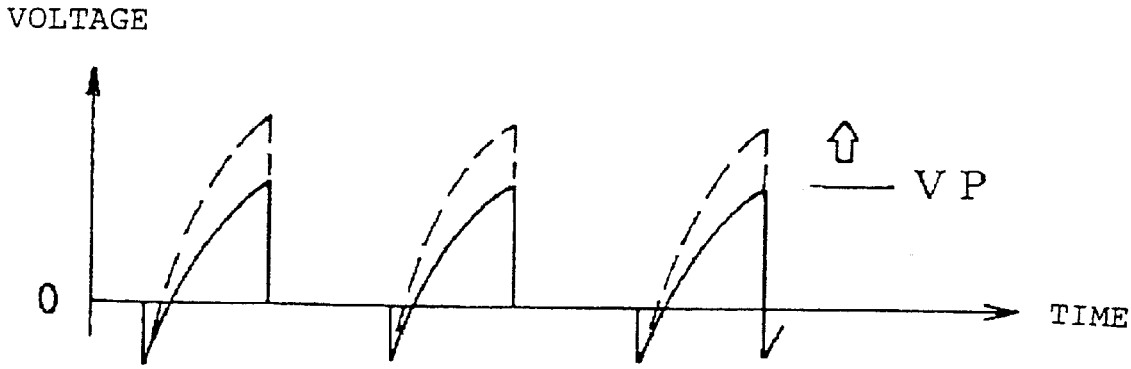
FIG. 26 is a view showing a high frequency current waveform of the discharge lamp lighting apparatus according to the seventh embodiment of the present invention.

The following is a description how to solve the above problem by the over resonance detection circuit AP of this seventh embodiment. An operation of the over resonance detection circuit AP will be described below with reference to FIG. 25 and FIG. 26. In FIG. 25, when an oscillation frequency of the IV control circuit IC1 lowers from fH→fS (the operating point is shifted from H2→S2), a resonance current flowing through the detection resistor R5 of the over resonance detection circuit AP increases, and then, a positive peak value VP of high frequency voltage waveform of both terminals of the detection resistor R5 rises up as shown in FIG. 26. If the discharge lamp LA does not start lighting during the time when the frequency lowers from fS to f0, a positive voltage peak value VP of the detection resistor R5 exceeds a Zener voltage of the voltage regulation diode DZ5 at the point of time when the voltage reaches the maximum voltage VP2 set for protecting a circuit (operating point P2, frequency fp); for this reason, an oscillation stop signal is outputted to the terminal 5 of the IV control circuit IC1 so as to stop an oscillation of the inverter circuit IV.

As described above, in this seventh embodiment, independently of the protective circuit NP6, there is provided the over resonance detection circuit AP which detects a high frequency current flowing through the discharge lamp load circuit LAC1 to output an oscillation stop signal to the IV control circuit IC1 in a fault state. Therefore, the above protective circuit is applicable to the discharge lamp lighting apparatus which is so constructed that an oscillation frequency of the inverter circuit IV approaches the resonance frequency f0, and the same effect as the above sixth embodiment can be obtained.

Moreover, in the above description, the operation of the over resonance detection circuit AP is explained as a means for avoiding an over resonance state generated in the discharge lamp lighting apparatus which is so constructed that an oscillation frequency of the inverter circuit IV approaches the resonance frequency f0. However, the over resonance detection circuit AP may be additionally provided in all of the above embodiments to detect a fault state of the discharge lamp LA in cooperation with the protective circuit. In this case, a high frequency current waveform supplied from the switching element is detected in addition to a voltage generated in the coupling capacitor C4, to make a fault detection, so that there effects that a fault can be detected more precisely, and a reliability of the protective circuit can be further improved.

EIGHTH EMBODIMENT

Figure 27:
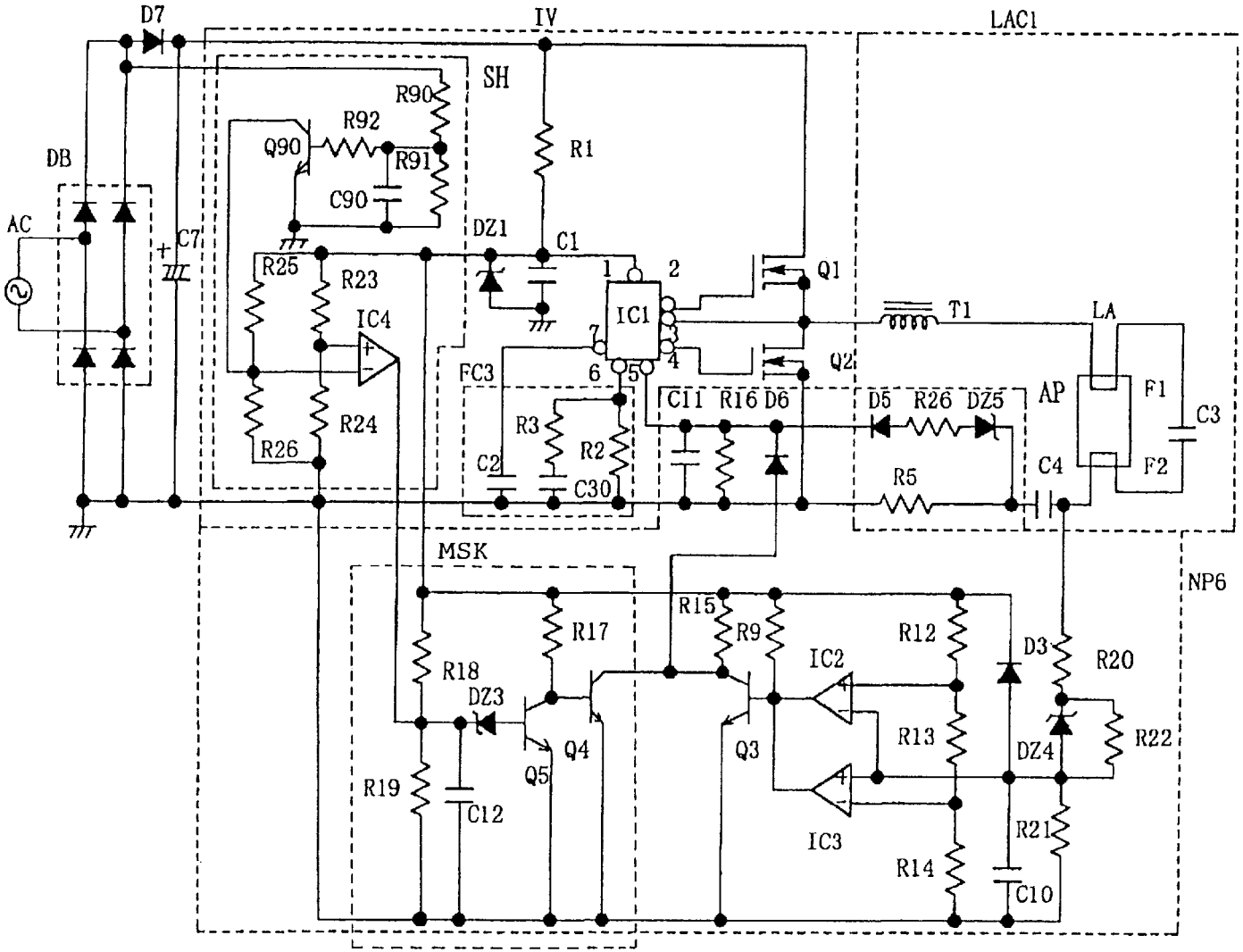
FIG. 27 is a circuit diagram showing a construction of a discharge lamp lighting apparatus according to an eighth embodiment of the present invention.

FIG. 27 is a circuit diagram showing a construction of a discharge lamp lighting apparatus according to an eighth embodiment of the present invention. In this eighth embodiment, a power supply rectifying and smoothing a commercial alternating power supply is used as the direct current power supply E of the above seventh embodiment. In service interruption (in particular, instantaneous blackout) of the commercial alternating power supply, in order to prevent the discharge lamp LA from being turned off after service interruption is returned, an instantaneous blackout restoring circuit SH is provided so that a mask function of the protective circuit NP6 again becomes effective. Like reference numerals are used to designate the same portion as FIG. 24 or the portion corresponding thereto, and the details are omitted.

The following is a description on a power supply and an instantaneous blackout restoring circuit SH which are constituent features of this eighth embodiment. In FIG. 27, an AC is a commercial alternating power supply, and the commercial alternating power supply AC is connected to a diode bridge DB, and further, an output terminal of the diode bridge DB is connected to a smoothing capacitor C7 and an input terminal of the inverter circuit IV via a separate diode D7. Moreover, the output terminal of the diode bridge DB is connected with the instantaneous blackout restoring circuit SH which is constructed as follows. More specifically, a ripple current voltage inputted to the instantaneous blackout restoring circuit SH from the diode bridge DB is divided by resistors R90 and R91, and then, a voltage of the resistor R91 is connected to an input terminal of a transistor Q90 via a resistor R92, and further, both terminals of the resistor R91 are connected in parallel with a capacitor C90. An output of a comparator IC4 is connected to a contact point of the resistors R18 and R19 of the protective circuit NP6, and a connecting portion of resistors R23 and R24 connected in series to both terminals of the control power supply capacitor C1 and a connecting portion of resistors R25 and R26 are connected to a non-inverting terminal which is a reference voltage input terminal of the comparator IC4, and to an inverting terminal which is a detection voltage input terminal thereof, respectively. Further, a collector of the transistor Q90 is connected to the inverting terminal of the comparator IC4.

The following is a description on an operation of the instantaneous blackout restoring circuit SH. First, in the case where the commercial alternating power supply AC stably supplies a power, in FIG. 27, an alternating current inputted to the diode bridge DB from the commercial alternating power supply AC is rectified into a direct current by the diode bridge DB, and further, is smoothened by the smoothing capacitor C7, and thereafter, is inputted to the inverter circuit IV so as to function as a direct current power supply. On the other hand, a base current is always supplied from the commercial alternating power supply AC to the transistor Q90 via the diode bridge DB, the resistors R90 and R92; for this reason, the transistor Q90 is always in an on state. As a result, the output of the comparator IC4 becomes an off state, and then, the mask circuit MSK functions, and further, by the same circuit operation as the seventh embodiment of FIG. 24, the commercial alternating power supply AC is turned on, and thereafter, the discharge lamp LA is stably lighting.

Next, the following is a description on an operation of the instantaneous blackout restoring circuit SH in the case where an instantaneous blackout is generated in the commercial alternating power supply AC such that during lighting of the discharge lamp LA, the discharge lamp LA is instantaneously turned off First, during normal lighting of the discharge lamp LA, like the seventh embodiment, the transistor Q3 of the protective circuit NP6 is in an on state; on the other hand, the transistor Q4 is in an off state. In this state, an instantaneous blackout is generated in the commercial alternating power supply AC, and when the discharge lamp LA is instantaneously turned off, this is equivalent to a no-lighting state as described in the above second embodiment; for this reason, the transistor Q3 of the protective circuit NP6 becomes an off state. However, at this time, a ripple current voltage output of the diode bridge DB becomes zero; for this reason, a base current supplied to the transistor Q90 from the ripple current voltage output via the resistors R90 and R92 is instantaneously shut off. As a result, the transistor Q90 is instantaneously turned off.

In this case, each resistance value of resistors R23, R24, R25 and R26 is set so that an inverting input terminal voltage of the comparator IC4 becomes higher than a non-inverting input terminal thereof; therefore, the output terminal of the comparator IC4 is instantaneously inverted together with an off of the transistor Q90, that is, becomes L0. In this manner, a charge stored in the capacitor C12 of the timer circuit TM is instantaneously discharged; for this reason, the transistor Q5 is in an off state; on the other hand, the transistor Q4 is in an on state. As a result, the mask circuit MSK is automatically reset. When the service interruption is restored, the transistor Q90 becomes in an on state while the mask circuit MSK starting to function, and then, the capacitor C12 is again charged, and until the voltage is charged up to a Zener voltage of the constant voltage diode DZ3, an on-state of the transistor Q4 is continued. Therefore, after the service interruption is restored, the mask circuit MSK functions for a predetermined time; as a result, even if the discharge lamp LA is instantaneously turned off by the instantaneous blackout and the transistor Q3 of the protective circuit NP6 once becomes an off state, after restart, the protective circuit NP6 outputs no oscillation stop signal to the IV control circuit IC1; therefore, the discharge lamp is securely lighting.

As described above, in this eighth embodiment, there is additionally provided the instantaneous blackout restoring circuit SH which automatically resets the mask circuit MSK in response to a blackout. For example, in the case of using a power supply rectifying and smoothening a commercial alternating power supply AC as the direct current power supply of the inverter circuit IV, even if an instantaneous blackout is generated in a commercial alternating power supply AC, after the blackout is restored, the mask circuit again functions effectively, and thereby, it is possible to securely again light the discharge lamp LA after the power supply is restored, and to apply a protective function of the protective circuit NP6 as it is.

In particular, in this eighth embodiment, the instantaneous blackout restoring circuit SH is constructed so that a charge of the capacitor C12 is rapidly discharged; therefore, it is possible to reset the mask circuit MSK at a high speed as compared with the case where a charge of the capacitor C12 is discharged via the resistor R19, and to take a suitably step with respect to a fast phenomenon such as an instantaneous blackout or the like.

The above eighth embodiment has described the operation and effect of the instantaneous blackout restoring circuit SH for an instantaneous blackout. It is evident from the operation principle that the instantaneous blackout restoring circuit SH effectively functions with respect to a general service interruption other than the instantaneous blackout. Moreover, it is evident that the instantaneous blackout restoring circuit SH is effective not only to a service interruption such that a voltage fully becomes zero, but also to a so-called sag such that a voltage drops down.

NINTH EMBODIMENT

Figure 28:
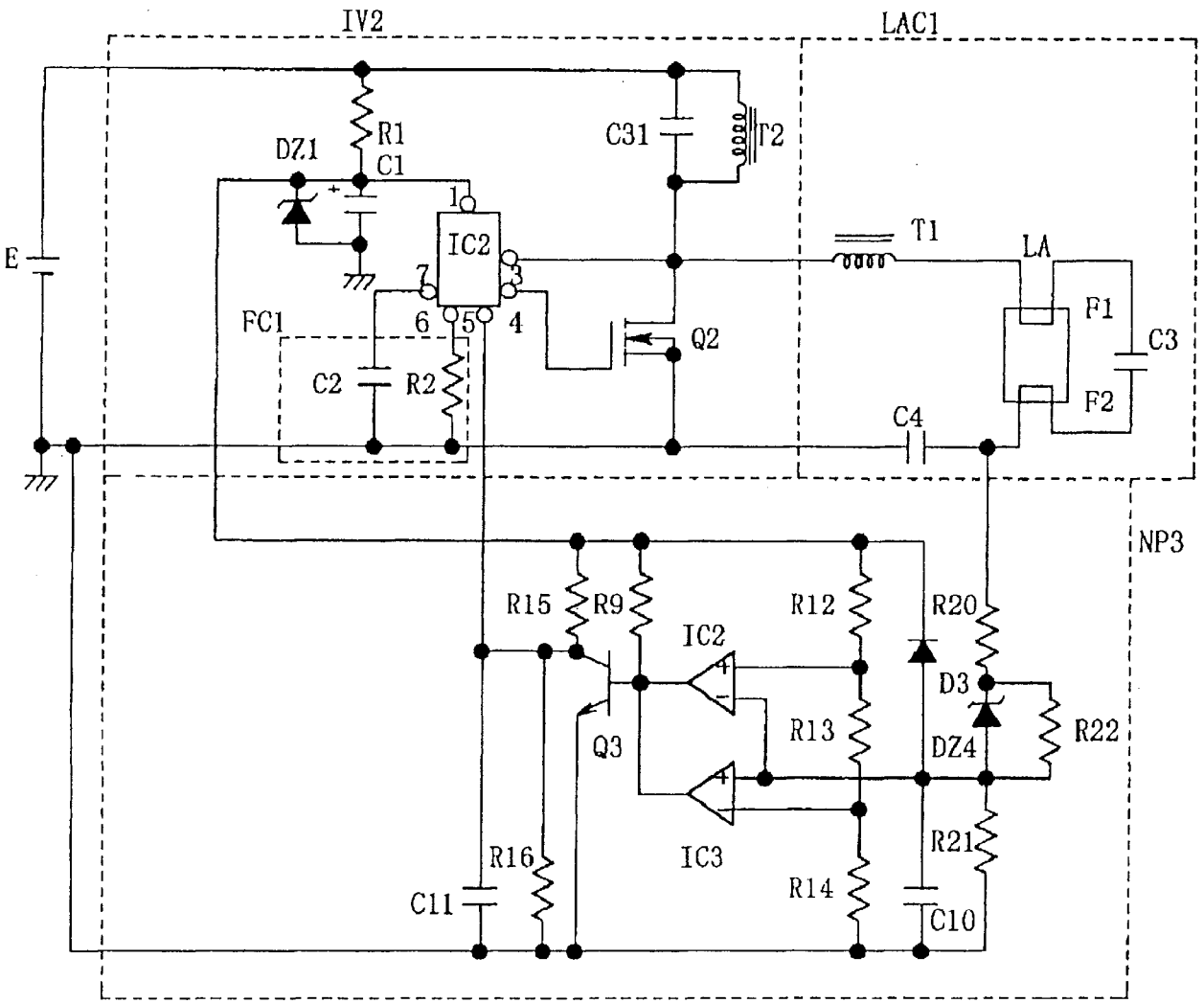
FIG. 28 is a circuit diagram showing a construction of a discharge lamp lighting apparatus according to a ninth embodiment of the present invention.

FIG. 28 is a circuit diagram showing a construction of a discharge lamp lighting apparatus according to a ninth embodiment of the present invention. In this ninth embodiment, a voltage resonance type one stone circuit is applied as a inverter circuit IV2. In place of the switching element Q1, a parallel resonance circuit comprising an oscillation transformer T2 and a resonance capacitor C31 is connected, and an oscillation terminal of an IV control circuit IC2 is connected to only switching element Q2. Like reference numerals are used to designate the same portion as the second embodiment (FIG. 9) or the portion corresponding thereto, and the details are omitted.

Figure 29:
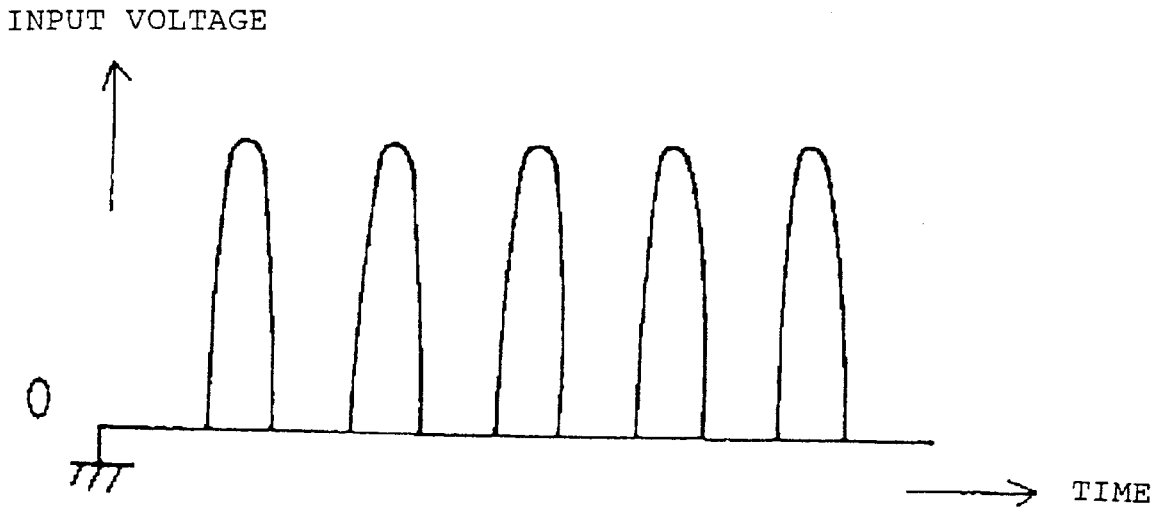
FIG. 29 is a view showing a voltage waveform between terminals of a switching element of the discharge lamp lighting apparatus according to the ninth embodiment of the present invention.

The following is a description on a difference in the operation between this ninth embodiment and the second embodiment. In this ninth embodiment, FIG. 29 shows a voltage waveform applied to the discharge lamp load circuit LAC1 when the discharge lamp LA is normally lighting, that is, a high frequency voltage waveform between terminals of the switching element Q2. By a resonance operation of a resonance capacitor C31, the ballast chock T1 and an oscillation transformer T2, the high frequency voltage waveform becomes a sine half wave (rectangular wave as shown in FIG. 2(*a*) in the second embodiment). However, the high frequency voltage waveform becomes the substantially same as the second embodiment in an equivalent circuit; for this reason, a change of voltage of the coupling capacitor C4 in normal and fault states of the discharge lamp LA is the same as the second embodiment. Therefore, the protective circuit NP3 is applicable to a discharge lamp lighting apparatus which employs the above voltage resonance type one stone circuit like the above second embodiment, and the same protective operation is performed.

TENTH EMBODIMENT

Figure 30:
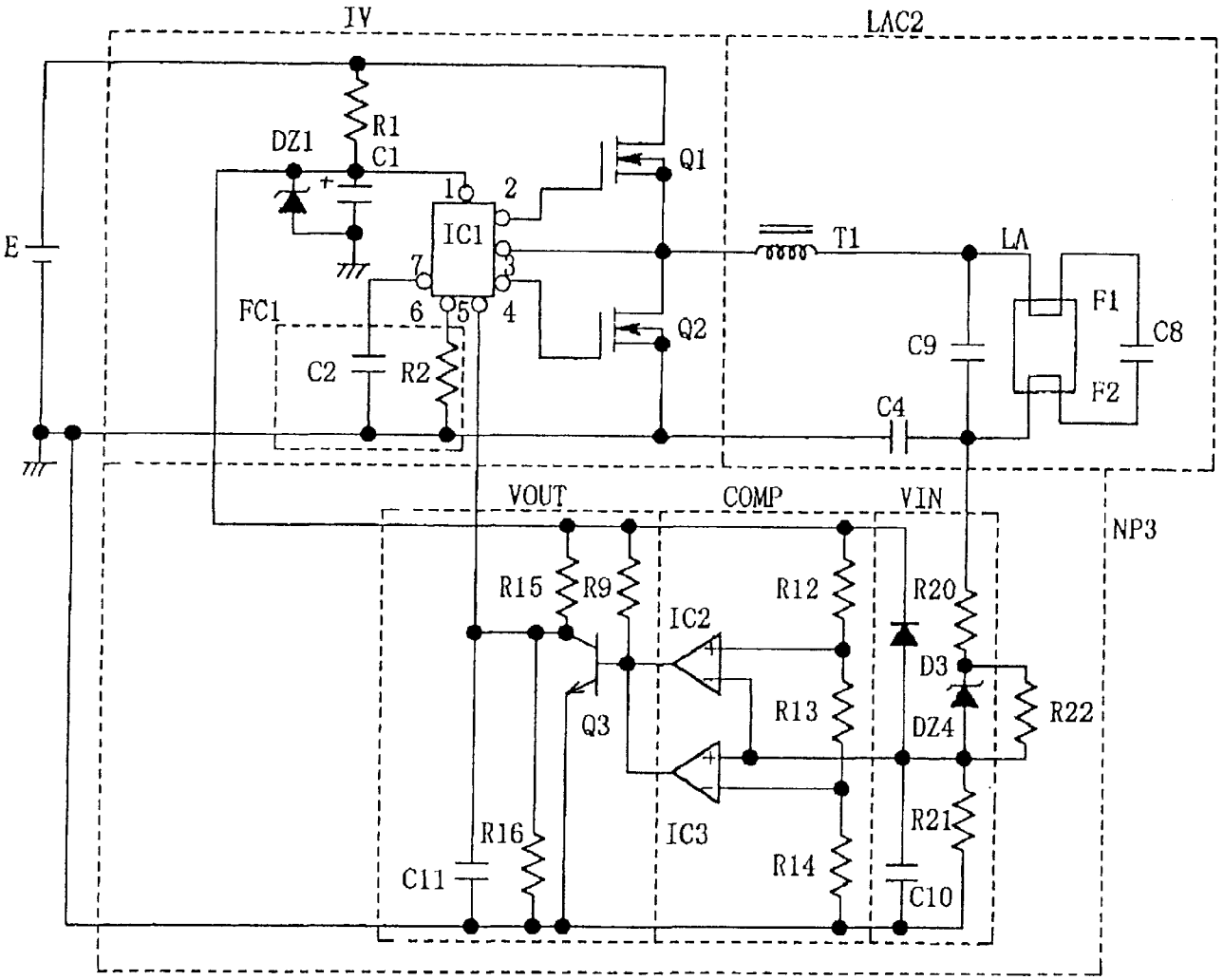
FIG. 30 is a circuit diagram showing a construction of a discharge lamp lighting apparatus according to a tenth embodiment of the present invention.

FIG. 30 is a circuit diagram showing a construction of a discharge lamp lighting apparatus according to a tenth embodiment of the present invention. In this tenth embodiment, in order to reduce an electrode loss during discharge lamp LA lighting, the starting capacitor C3 of the above second embodiment (FIG. 9) is divided into two separate starting capacitors C8 and C9 (resultant capacity of the C8 and C9 is the substantially same as C3). One of two, that is, the separate starting capacitor C9 is arranged on the switching element Q2 with respect to the discharge lamp LA. Like reference numerals are used to designate the same portion as FIG. 9 or the portion corresponding thereto, and the details are omitted.

As described above, according to this tenth embodiment, the starting capacitor C3 is divided into a plurality of separate starting capacitors C8 and C9, and at least one of two, that is, the separate starting capacitor C9 is arranged on the switching element Q2 with respect to the discharge lamp LA. Therefore, when the discharge lamp LA is normally lighting, a high frequency current flowing through the ballast chock T1 dispersively flows through both the separate starting capacitor C8 (equal to an electrode current flowing through the electrodes F1 and F2) and the separate starting capacitor C9, and then, a current flowing through the separate starting capacitor C9 bypasses the electrodes F1 and F2. As a result, an electric power (electrode loss) consumed in the electrodes of the discharge lamp LA becomes small, and an energy efficiency can be improved as compared with the second embodiment.

Moreover, according to this tenth embodiment, it is possible to realize the operation and effect of the protective circuit NP3 by the same equivalent circuit as the second embodiment, and to obtain the same effect as the above embodiments described thus far.

As shown in the fourth embodiment (FIG. 16), in the discharge lamp lighting apparatus which has a dimming function by the frequency control circuit FC2, with the reduce lumen output operation of the discharge lamp LA, a voltage and frequency between both electrodes of the discharge lamp LA rise, and thereby, the discharge lamp lighting apparatus has a characteristic such that a current of the starting capacitor increases as compared with the fully lighting state. Thus, the above construction such that the starting capacitor is dispersively arranged is applied to the discharge lamp lighting apparatus, and thereby, the current of the starting capacitor increases by the reduced lumen output operation, and it is possible to prevent an electrode loss from rapidly increasing.

This tenth embodiment (FIG. 30) has described a circuit to which the protective circuit NP3 or the like is added. The effect of the above separate starting capacitors C8 and C9 is evident from the operating principle, and is common to the discharge lamp lighting apparatus applying the inverter circuit IV. Thus, the same effect can be obtained regardless of the presence of the protective circuit and the instantaneous blackout restoring circuit SH.

ELEVENTH EMBODIMENT

Figure 31:
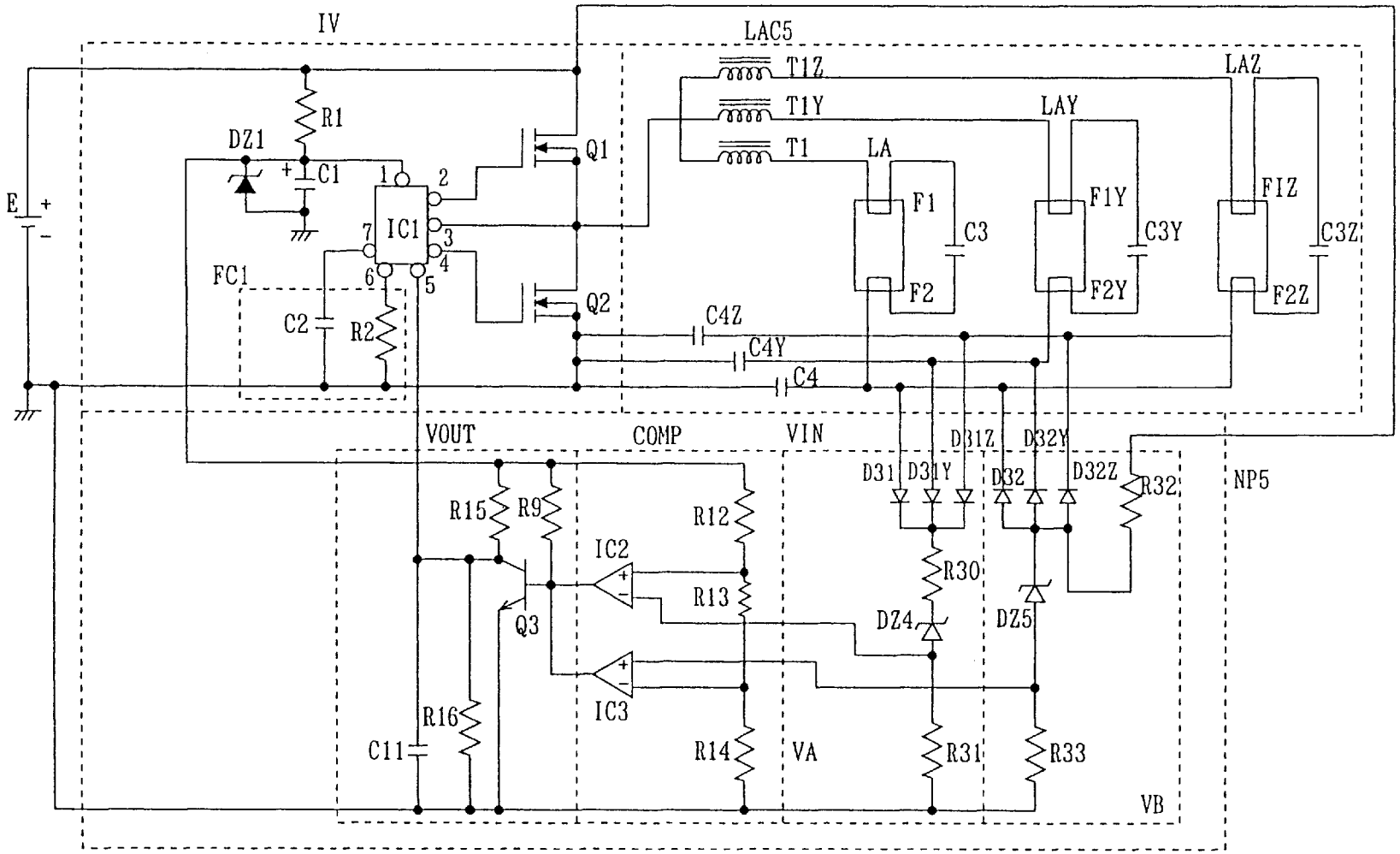
FIG. 31 is a circuit diagram showing a construction of a discharge lamp lighting apparatus according to an eleventh embodiment of the present invention.

FIG. 31 is a circuit diagram showing a construction of a discharge lamp lighting apparatus according to an eleventh embodiment of the present invention. In this eleventh embodiment, as a discharge lamp load circuit LAC5, like the above fifth embodiment, in addition to the discharge lamp load circuit comprising the discharge lamp LA (connected parallel with the starting capacitor C3), the coupling capacitor C4 and the ballast chock T1, a discharge lamp load circuit comprising two discharge lamps LAY and LAZ (parallel with a starting capacitor C3Y and C3Z), two coupling capacitors C4Y and C4Z and two ballast chocks T1Y and T1Z, is connected in parallel.

Moreover, in the case where a plurality of discharge lamp load circuits are provided, in the above fifth embodiment, in accordance with an increase of the discharge lamp load circuits, a comparator unit and a voltage detecting unit have been provided independently from those. In this eleventh embodiment, the voltage detecting unit for one comparator unit is divided into two, that is, a first voltage detecting unit for detecting a stepped-up voltage of the coupling capacitor and a second voltage detecting unit for detecting a dropped voltage of the coupling capacitor. By doing so, the number of the divided resistors and reverse current blocking diodes is increased in accordance with an increase of the discharge lamp load circuit, and thereby, it is possible to make a coupling voltage detection of one inverter parallel lighting. Like reference numerals are used to designate the same portion as the above fifth embodiment or the portion corresponding thereto, and the details are omitted.

The following is a description on a detailed construction of a voltage detecting unit VIN.

The voltage detecting unit VIN of this eleventh embodiment is composed of a first voltage detecting unit VA and a second voltage detecting unit VB. More specifically, the first voltage detecting unit VA detects each step-up voltage of the coupling capacitors C4, C4Y and C4Z, and then, converts it into a direct current voltage, and further, inputs the detection voltage to an inverting input terminal of the first comparator IC2, and the second voltage detecting unit VB detects each drop voltage of the coupling capacitors C4, C4Y and C4Z, and then, converts it into a direct current voltage, and further, inputs the detection voltage to a non-inverting input terminal of the second comparator IC3.

The first voltage detecting unit VA has diodes D31, D31Y and D31Z whose each anode is connected to each of coupling capacitors C4, C4Y and C4Z, a divided resistor R30 connected to each cathode of diodes D31, D31Y and D31Z, a constant voltage diode DZ4 whose cathode is connected to the divided resistor R30, and a divided resistor R31 which has one end connected to the anode of the constant voltage diode DZ4 and the other end grounded. A connecting point of the constant voltage diode DZ4 and the divided resistor R31 is connected to the inverting input terminal of the first comparator IC2.

On the other hand, the second voltage detecting unit VB has diodes D32, D32Y and D32Z whose each cathode is connected to each of coupling capacitors C4, C4Y and C4Z, a constant voltage diode DZ5 whose cathode is connected to the anode of each of diodes D32, D32Y and D32Z, and a divided resistor R33 which has one end connected to the anode of the constant voltage diode DZ5 and the other end grounded. A connecting point of the constant voltage diode DZ5 and the divided resistor R33 is connected to the non-inverting input terminal of the comparator IC3, and further, the cathode of the constant voltage diode DZ5 is connected to a plus side of the direct current power supply E via a divided resistor R32.

The following is a description on an operation of this eleventh embodiment.

In FIG. 31, when the discharge lamps LA, LAY and LAZ are all normally lighting, each direct current voltage of the coupling capacitors C4, C4Y and C4Z is detected by the first voltage detecting unit VA, and a detection voltage outputted to the first comparator IC2 from the first voltage detecting unit VA is set so as to become less than a reference voltage of the first comparator IC2. Thus, an output of the first comparator IC2 becomes HIHG.

Moreover, in the second voltage detecting unit VB, a direct current voltage of the direct current power supply E is divided by the divided resistors R32 and R33, and the constant voltage diode DZ5, and a voltage thus divided is outputted to the second comparator IC3, and further, the voltage is set so as to become high than a reference voltage of the second comparator IC3. Thus, an output of the second comparator IC3 also becomes HIGH. Therefore, the transistor Q3 is in an on state; for this reason, the protective circuit NP5 outputs no oscillation stop signal, and thereby, the discharge lamps LA, LAY and LAZ continue a normal lighting state.

As described above, when the discharge lamps LA, LAY and LAZ are all normally lighting, the voltage detected by the second voltage detecting unit VB is a voltage obtained by dividing a voltage of the direct current power supply E by the divided resistor R32, the constant voltage diode DZ5 and the resistor R33.

Moreover, in the case where any of the discharge lamps LA, LAY and LAZ is in a fault state, in other words, for example, in the case where the discharge lamp LA is in a rectification lighting 1 state and a direct current voltage of the coupling capacitor C4 of the discharge lamp LA rises up as compared with the fully normal lighting state, the highest direct current voltage among the coupling capacitors is applied to the divided resistor R30 on the side of the D31 of the first voltage detecting unit VA, through diodes D31, D31Y and D31Z connected in parallel. Thus, the direct current voltage (a stepped-up voltage) of the coupling capacitor C4 is reduced by a voltage drop in the diode D31 and a voltage of the constant voltage diode DZ4, and further, divided by the resistors R30 and R31. The devide4d direct current voltage is inputted to a minus pin which is an inverting input terminal of the first comparator IC2. Then, the direct current voltage exceeds a reference voltage inputted to a plus pin which is a non-inverting input terminal of the first comparator IC2; for this reason, the output of the first comparator IC2 is inverted. Whereupon the transistor Q3 becomes an off state, the oscillation stop signal is outputted to the terminal 5 of the IC1 so as to stop an oscillation of the inverter circuit IV.

In addition, in the case where any of the discharge lamps LA, LAY and LAZ is in a fault state, in other words, for example, in the case where the discharge lamp LA is in a rectification lighting 2 state or no-lighting state and a direct current voltage of the coupling capacitor C4 of the discharge lamp LA drops down as compared with the fully normal lighting state, or in the case where the direct current voltage of the coupling capacitor C4 of the discharge lamp LA becomes 0 V in a no-load state such that the discharge lamp LA is dismounted, a direct current voltage detected by the second voltage detecting unit VB becomes 0 V. The direct current voltage is inputted as a dropped voltage to a plus pin which is a non-inverting input terminal of the second comparator IC3, and then, is less than a reference voltage inputted to a minus pin which is an inverting input terminal of the second comparator IC3; for this reason, the output of the comparator IC3 is inverted. Whereupon the transistor Q3 becomes an off state, the oscillation stop signal is outputted to the terminal 5 of the IC1 so as to stop an oscillation of the inverter circuit IV.

As described above, the reason why the direct current voltage detected by the second voltage detecting unit VB becomes 0 V, is as follows. When the direct current voltage of the coupling capacitor C4 of the discharge lamp LA drops down or becomes 0 V, a voltage on the anode side of the reverse current blocking diode D32 among the diodes D32, D32Y and D32Z connected to the divided resistor R32 for diving a direct current voltage of the direct current power supply E, becomes high; for this reason, the reverse current blocking diode D32 becomes an on state, and then, the direct current voltage of the direct current power supply E is applied to the coupling capacitor C4 via the divided resistor R32.

As described above, according to this eleventh embodiment, in the discharge lamp lighting apparatus having plurality of discharge lamp load circuits, the voltage detecting unit VIN is divided into two, that is, the first voltage detecting unit VA for detecting a stepped-up voltage (a maximum voltage in this embodiment) of each coupling capacitor connected to each of a plurality of discharge lamps, and the second voltage detecting unit VB for detecting a dropped voltage (in this embodiment, 0 volt is outputted after detecting a minimum voltage). By doing so, the number of divided resistors and reverse current blocking diodes is increased in accordance with an increase of the discharge lamp load circuit, and thereby, it is possible to make a coupling voltage detection of one inverter parallel lighting, and to reduce the number of components as compared with the case where the comparator unit and the voltage detecting unit are independently provided in response to the number of increased discharge lamp load circuits like the fifth embodiment. Therefore, in this eleventh embodiment, in accordance with an increase of the number of discharge lamp load circuits, the number of components can be reduced.

Moreover, even if the number of discharge lamp load circuits is increased, it is possible to detect the presence of discharge lamp which is in the following states; more specifically, in a state such that any of the plurality of discharge lamps is in a fault state, that is, in a rectification lighting 1 state such that a detection voltage steps up as compared with the fully normal lighting state, in a rectification lighting 2 state such that a detection voltage drops as compared with the fully normal lighting state, and a detection voltage becomes 0 V by the removal of the discharge lamp. In this case, the presence of discharge lamp can be detected; however, it is impossible to make a distinction between the presence of discharge lamp and the presence of fault.

The first voltage detecting unit VA outputs a voltage divided by the divided resistors R30 and R31 and the constant voltage diode DZ4 to the first comparator IC2, and the second voltage detecting unit VB outputs a voltage divided by the divided resistors R32 and R33 and the constant voltage diode DZS to the second comparator IC3 in the case where any voltage of the coupling capacitors C4, C4Y and C4Z is higher than a predetermined voltage. Therefore, it is possible to largely set a difference in a reference voltage between normal and abnormal lighting states in the first and second comparator IC2 and IC3, and thus, to further improve a reliability of the protective circuit.

In FIG. 31, there is shown the case where the discharge lamp load circuit is three. Of course, this eleventh embodiment is applicable to three or more plural parallel lighting circuits.

TWELFTH EMBODIMENT

Figure 32:
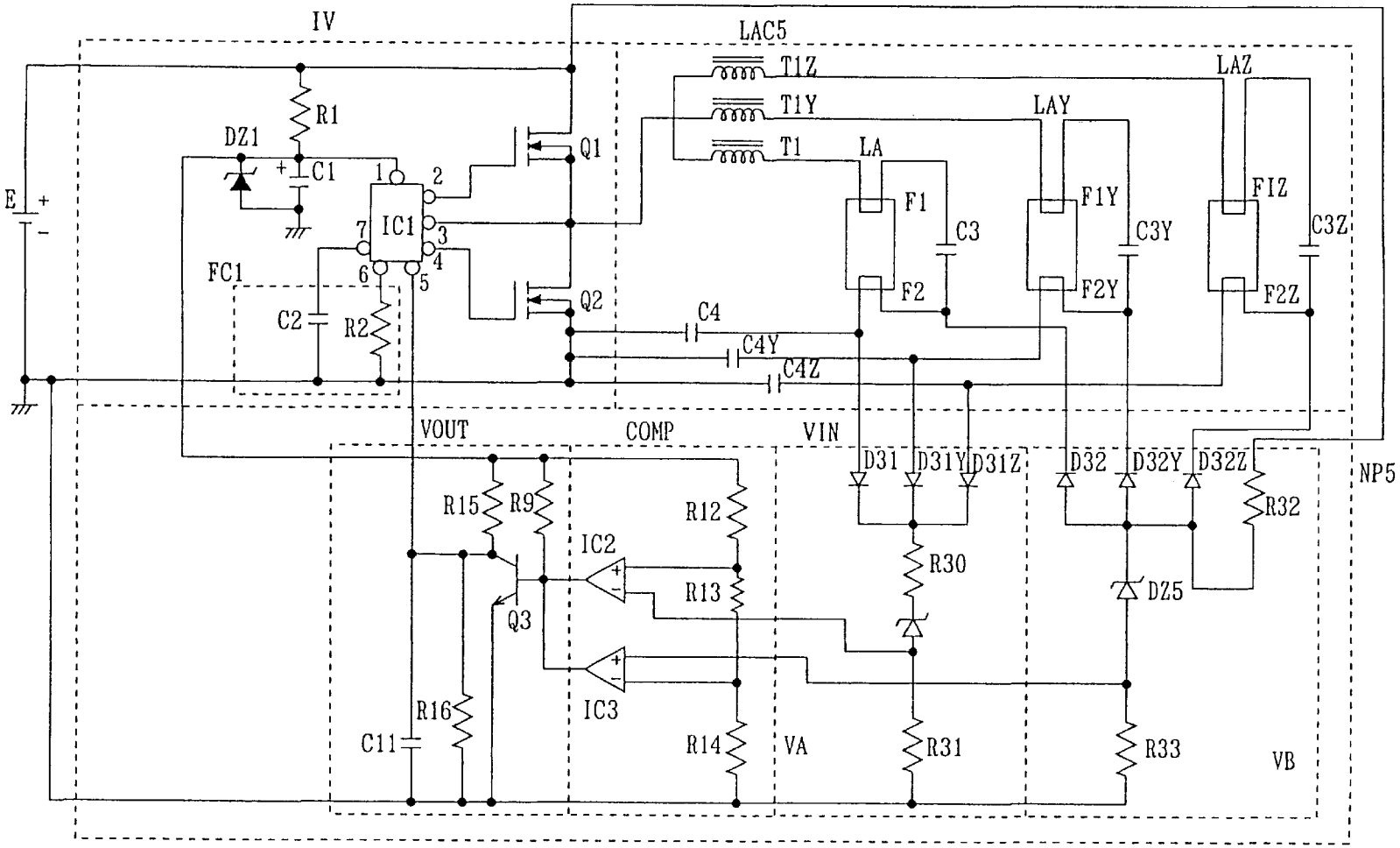
FIG. 32 is a circuit diagram showing a construction of a discharge lamp lighting apparatus according to a twelfth embodiment of the present invention.

FIG. 32 is a circuit diagram showing a construction of a discharge lamp lighting apparatus according to a twelfth embodiment of the present invention. This twelfth embodiment is a modification example of the eleventh embodiment, and is different from the above eleventh embodiment in a position of detecting a voltage of the coupling capacitor of the second voltage detecting unit VB.

More specifically, in this twelfth embodiment, one terminal of reverse current blocking diodes D32, D32Y and D32Z of the second voltage detecting unit VB is connected a starting capacitor side of the discharge lamps LA, LAY and LAZ.

Therefore, in the case where any of the discharge lamps LA, LAY and LAZ is in a fault state, for example, in the case where the direct current voltage of the coupling capacitor C4 of the discharge lamp LA drops down because the discharge lamp LA is in a rectifying 2 state or no-lighting state as compared with the fully normal lighting state, a direct current voltage detected by the second voltage detecting unit VB becomes 0 V, and the direct current voltage is inputted to a plus pin which is a non-inverting input terminal of the comparator IC3, and is less than a reference voltage inputted to a minus pin which is an inverting input terminal of the comparator IC2. As a result, an output of the comparator IC3 is inverted. Whereupon the transistor Q3 becomes an off state, and then, an oscillation stop signal is outputted to the terminal 5 of the IC1 so as to stop an oscillation of the inverter circuit IV.

For example, in the case where a discharge lamp F1Z is removed, in the second voltage detecting unit VB, a circuit of the coupling capacitor C4Z of the discharge lamp LAZ and the reverse current blocking diode D32Z is shut off; for this reason, the discharge lamps LA, LAY and LAZ all becomes a normal state. A voltage detected by the second voltage detecting unit VB becomes a voltage obtained by dividing a direct current voltage of the direct current power supply E by the divided resistor R32, the constant voltage diode DZ5 and the divided resistor R33. The voltage is inputted to the second comparator IC3; therefore, an output of the second comparator IC3 becomes HIGH as it is, and then, the transistor Q3 is in an on state. As a result, the protective circuit NP5 outputs no oscillation stop signal. As seen from the above description, when the number of discharge lamp load circuits is increased, in the case of no-load removing any of the discharge lamps is removed, the presence of discharge lamp is not detected.

THIRTEENTH EMBODIMENT

Figure 33:
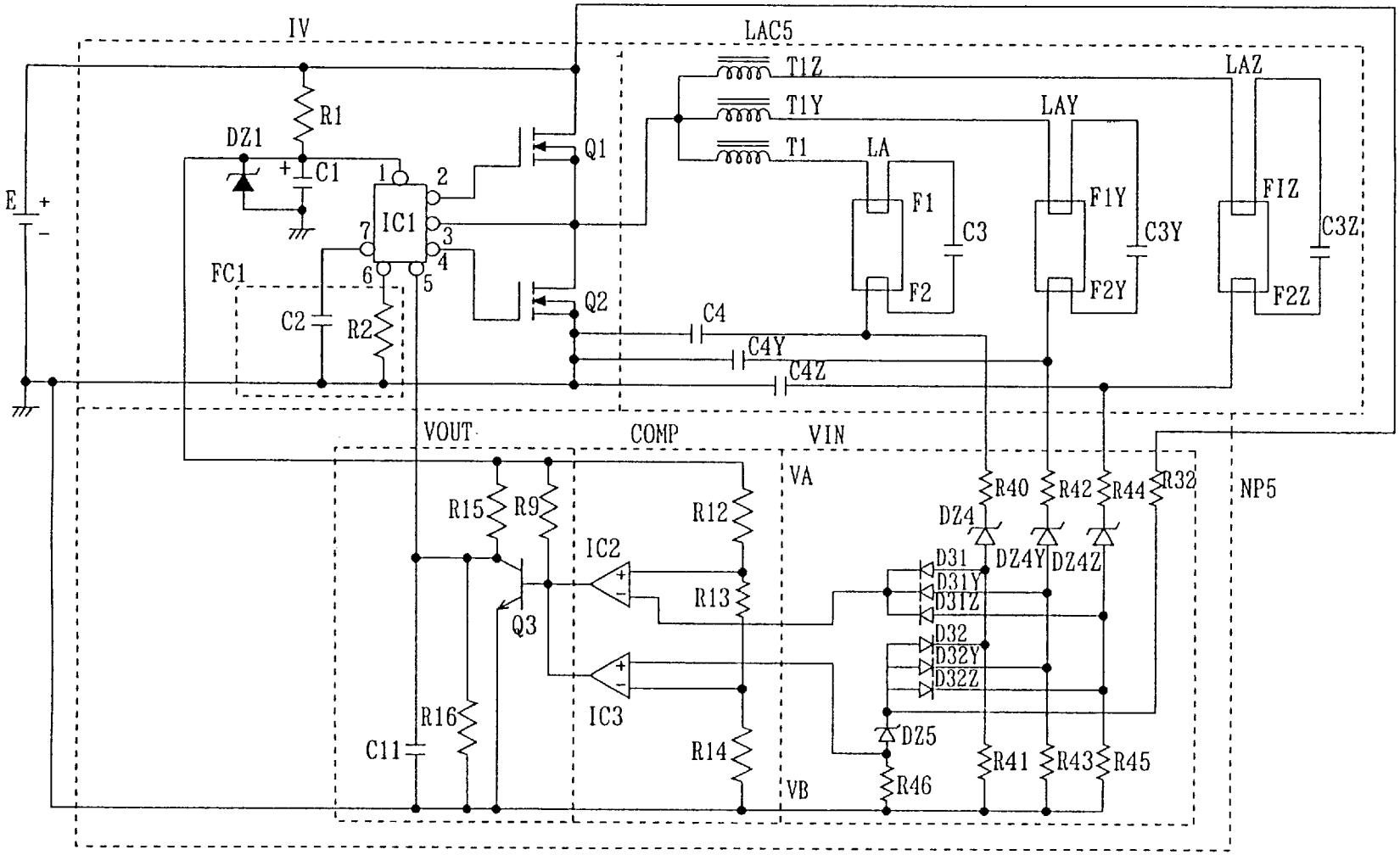
FIG. 33 is a circuit diagram showing a construction of a discharge lamp lighting apparatus according to a thirteenth embodiment of the present invention.

FIG. 33 is a circuit diagram showing a construction of a discharge lamp lighting apparatus according to a thirteenth embodiment of the present invention. This thirteenth embodiment is another modification example of the eleventh embodiment, and is different from the above eleventh embodiment in a position of providing a reverse current blocking diode constituting an OR circuit of the first voltage detecting unit VA and the second voltage detecting unit VB.

In this thirteenth embodiment, the first voltage detecting unit VA is composed of: divided resistors R40, R42 and R44 connected to coupling capacitors C4, C4Y and C4Z; constant voltage diodes DZ4, DZ4Y and DZ4Z whose cathodes are connected to divided resistors R40, R42 and R44; divided resistors R41, R43 and R45 having one end connected to each anode of constant voltage diodes DZ4, DZ4Y and DZ4Z, and the other end grounded; reverse current blocking diodes D31, D31Y and D31Z whose anodes are connected to connecting point of constant voltage diodes DZ4, DZ4Y and DZ4Z and divided resistors R41, R43 and R45, and whose cathode is connected to the inverting input terminals of the first comparator IC2.

The second voltage detecting unit VB has divided resistors R40, R42 and R44, constant voltage diodes DZ4, DZ4Y and DZ4Z, divided resistors R41, R43 and R45 which are common to the first voltage detecting unit VA. Further, the second voltage detecting unit VB includes reverse current blocking diodes D32, D32Y and D32Z whose anodes are connected to connecting point of constant voltage diodes DZ4, DZ4Y and DZ4Z and divided resistors R41, R43 and R45, another constant voltage diode DZ5 connected to the anode and cathode of the reverse current blocking diodes D32, D32Y and D32Z, and a divided resistor R46 which has one end connected to the anode of the constant voltage diode DZ5, and the other end grounded. A connecting point of the constant voltage diode DZ5 and the divided resistor R46 is connected to the non-inverting input terminal of the second comparator IC3, and further, the cathode of the constant voltage diode DZ5 is connected to a plus side of the direct current power supply E via the divided resistor R32.

According to this thirteenth embodiment, each direct current voltage of the coupling capacitors C4, C4Y and C4Z is divided by a divided circuit comprising the divided resistor R40, the constant voltage diode DZ4 and the divided resistor R41, a divided circuit comprising the divided resistor R42, the constant voltage diode DZ4Y and the divided resistor R43, and a divided circuit comprising the divided resistor R44, the constant voltage diode DZ4Z and the divided resistor R45. Then, the divided voltage is inputted to the first comparator unit IC2 via the reverse current blocking diodes D31, D31Y and D31Z, and a direct current voltage of the direct current power supply E is divided by a divided circuit comprising the divided resistor R32, the constant voltage diode DZ5 and the divided resistor R46. Further, the divided voltage is inputted to the coupling capacitors C4, C4Y and C4Z via the reverse current blocking diodes D32, D32Y and D32Z. Therefore, it is possible to use the reverse current blocking diodes D31, D31Y, D31Z, D32, D32Y and D32Z, which have a withstand voltage lower than the eleventh embodiment.

Other operation and effect are the same as the eleventh embodiment, and therefore, the explanation of the operation and effect is omitted.

We claim:

1. A discharge lamp lighting apparatus comprising:

a voltage detecting unit for detecting a voltage generated in a coupling capacitor, and converting the detected voltage into a direct current voltage; a comparator unit for comparing the direct current voltage detected and converted by the voltage detecting unit with a reference voltage; and a control signal output unit for generating and outputting a control signal on the basis of the comparative result made by the comparator unit.

2. The discharge lamp lighting apparatus according to claim 1, wherein the voltage detecting unit includes a divided resistor and a constant voltage diode for dividing a voltage inputted to the voltage detecting unit from the coupling capacitor, and is constructed so as to output a voltage divided by the divided resistor and the constant voltage diode to the comparator unit.

3. The discharge lamp lighting apparatus according to claim 1, wherein the comparator unit has at least two different reference voltages, and a window type comparator which is constructed so as to compare a direct current voltage outputted from the voltage detecting unit with the at least two reference voltages.

4. The discharge lamp lighting apparatus according to claim 1, wherein the reference voltage of the comparator unit is set so as to be variable.

5. The discharge lamp lighting apparatus according to claim 3, wherein the direct current voltage outputted from the voltage detecting unit is compared with two different reference voltages by the comparator unit, and when the voltage becomes lower than a reference voltage on a low voltage side or becomes higher than a reference voltage on a high voltage side, the control signal output unit outputs a stop signal or an output reducing signal of the switching element to the switching element control circuit.

6. The discharge lamp lighting apparatus according to claim 1, wherein a protective circuit is provided with a mask circuit for masking a control signal outputted from the protective circuit for a predetermined time.

7. The discharge lamp lighting apparatus according to claim 6, further comprising an over resonance detection circuit for detecting a high frequency current supplied to the discharge lamp load circuit and outputting a control signal to the switching element control circuit, so that when the high frequency current detected by the over resonance detection circuit reaches a predetermined current value, even during a masking time of the protective circuit, the over resonance detection circuit outputs a stop signal or an output reducing signal of the switching element to the switching element control circuit.

8. The discharge lamp lighting apparatus according to claim 6, further comprising a service interruption restoring circuit for automatically resetting the mask circuit in the case when a feed from the direct current power supply is shut off, so that after the feed is restored, the mask circuit is operated so as to mask a control signal outputted from the protective circuit to the switching element control circuit for a predetermined time.

9. The discharge lamp lighting apparatus according to claim 8, wherein a power supply obtained by rectifying and smoothening a commercial alternating current by a diode bridge and a smoothing capacitor is used as the direct current power supply.

10. The discharge lamp lighting apparatus according to claim 1, wherein a switching frequency of the switching element is controlled by the switching element control circuit so that a lamp current supplied to the discharge lamp is varied so as to perform a dimming operation of the discharge lamp.

11. The discharge lamp lighting apparatus according to claim 1, wherein a plurality of starting capacitors are connected in parallel with the discharge lamp, and at least one of the starting capacitors is connected to the switching element side with respect to the discharge lamp.

12. The discharge lamp lighting apparatus according to claim 1, further comprising:

a direct current power supply;

a switching element for switching a direct current supplied from the direct current power supply so as to generate a high frequency current;

a discharge lamp load circuit which is constructed in a manner that a discharge lamp and a coupling capacitor are connected in series, and the discharge lamp is lit by a high frequency current generated by the switching element;

a switching element control circuit for controlling the switching element; and a plurality of starting capacitors which are connected in parallel with the discharge lamp, at least one of the starting capacitors being connected to the switching element side with respect to the discharge lamp.

13. A discharge lamp lighting apparatus having a plurality of discharge lamp load circuits each having a coupling capacitor and a discharge lamp are driven by a high frequency current outputted from a switching element, and a protective circuit is provided with voltage detecting units each for detecting a voltage generated in the coupling capacitor of each of the discharge lamp load circuits, and converting the detected voltage into a direct current voltage; comparator units each for comparing the direct current voltage detected and converted by the voltage detecting unit with a reference voltage; and a control signal output unit for collecting outputs from the comparator units provided for the plurality of discharge lamp load circuits so as to generate a single control signal, and outputting the single control signal to a switching element control circuit.

14. A discharge lamp lighting apparatus comprising an over resonance detection circuit for detecting a high frequency current supplied to a discharge lamp load circuit and outputting a first control signal to a switching element control circuit, so that a switching element is controlled by a second control signal from a protective circuit and the first control signal from the over resonance detecting circuit via the switching element control circuit.

15. A discharge lamp lighting apparatus having a plurality of discharge lamp load circuits each having a coupling capacitor and a discharge lamp driven by a high frequency current outputted from a switching element, and a protective circuit is provided with a first voltage detecting unit for detecting a stepped-up voltage of each coupling capacitor of the discharge lamp load circuits, and converting the detected voltage into a direct current voltage; a second voltage detecting unit for detecting a dropped voltage of each coupling capacitor, and converting the detected voltage into a direct current voltage; a first comparator unit for comparing the stepped-up direct current voltage detected and converted by the first voltage detecting unit with a reference voltage; a second comparator unit for comparing the drop direct current voltage detected and converted by the second voltage detecting unit with a reference voltage; and a control signal output unit for generating a control signal on the basis of an output from any of the first or second comparator units, and outputting the single control signal to a switching element control circuit.

16. The discharge lamp lighting apparatus according to claim 15, wherein the first voltage detecting unit includes a divided resistor and a constant voltage diode for dividing a voltage of each coupling capacitor, and reverse current blocking diodes interposed between the divided resistor and each coupling capacitor, and outputs the voltage divided by the divided resistor and the constant voltage diode to the first comparator unit, and the second voltage detecting unit includes a divided resistor and a constant voltage diode for dividing a predetermined voltage, and reverse current blocking diodes interposed between the divided resistor and each coupling capacitor, and outputs the voltage divided by the divided resistor and the constant voltage diode to the second comparator unit in the case where any voltage of each coupling capacitor is higher than the predetermined voltage, and further, is constructed in a manner that in the case where any voltage of each coupling capacitor is lower than the predetermined voltage, the predetermined voltage is applied to a coupling capacitor having a lower voltage via a reverse current blocking diode.

17. The discharge lamp lighting apparatus according to claim 16, wherein one end of each reverse current blocking diode of the second voltage detecting unit is connected to a starting capacitor side of the discharge lamp.

18. The discharge lamp lighting apparatus according to claim 15, wherein the first voltage detecting unit includes divided resistors and constant voltage diodes each for dividing a voltage of each coupling capacitor, and reverse current blocking diodes interposed between the constant voltage diodes and the first comparator unit, and outputs the voltage divided by the divided resistor and the constant voltage to the first comparator unit via the diode reverse current blocking diodes, and the second voltage detecting unit includes a divided resistor and a constant voltage diode for dividing a predetermined voltage, and reverse current blocking diodes interposed between the constant voltage diode and each of the constant voltage diodes of the first voltage detecting unit, and outputs the voltage divided by the divided resistor and the constant voltage diode to the second comparator unit in the case where any voltage of each coupling capacitor is higher than the predetermined voltage, and further, is constructed in a manner that in the case where any voltage of each coupling capacitor is lower than the predetermined voltage, the predetermined voltage is applied to a coupling capacitor having a lower voltage via a reverse current blocking diode, a divided resistor of the first voltage detecting unit and a constant voltage diode.

* * * * *